US005602375A

United States Patent [19]

Sunahara et al.

[11] Patent Number: 5,602,375

[45] Date of Patent: Feb. 11, 1997

[54] AUTOMATIC DEBITING SYSTEM SUITABLE FOR FREE LANE TRAVELING

[75] Inventors: Shuichi Sunahara, Aichi-ken; Souichi Ishikawa, Nagoya; Takehiko Okuda, Toyota; Hajime Amano, Aichi-ken; Kouichi Yagi; Masanori Omae, both of Toyota, all of Japan

[73] Assignee: Toyota Jidosha Kabushiki Kaisha, Toyota, Japan

[21] Appl. No.: 661,703

[22] Filed: Jun. 11, 1996

Related U.S. Application Data

[63] Continuation of Ser. No. 420,687, Apr. 12, 1995, abandoned.

[30] Foreign Application Priority Data

| | | | |
|---|---|---|---|
| Apr. 13, 1994 | [JP] | Japan | 6-074659 |
| Feb. 21, 1995 | [JP] | Japan | 7-032142 |
| Apr. 7, 1995 | [JP] | Japan | 7-082523 |

[51] Int. Cl.[6] ..... G07B 15/02

[52] U.S. Cl. ..... 235/384; 235/375

[58] Field of Search ..... 235/375, 384

[56] References Cited

U.S. PATENT DOCUMENTS

| | | | |
|---|---|---|---|
| 5,144,553 | 9/1992 | Hassett | 235/384 |
| 5,204,675 | 4/1993 | Sekine . | |

FOREIGN PATENT DOCUMENTS

| | | |
|---|---|---|
| 126958 | 12/1984 | European Pat. Off. . |
| 413948A1 | 2/1991 | European Pat. Off. . |
| 585718A1 | 3/1994 | European Pat. Off. . |
| 616302A2 | 9/1994 | European Pat. Off. . |
| 401192 | 12/1990 | France . |
| 4234548C1 | 9/1993 | Germany . |
| 60-204099 | 10/1985 | Japan . |
| 3189798 | 8/1991 | Japan . |
| 4034684 | 2/1992 | Japan . |
| WO92/15978 | 9/1992 | WIPO . |

OTHER PUBLICATIONS

Ishikawa, et al: "Development of Vehicle–mounted ID Tag and Its Use in Road Traffic Systems", Journal of the Society of Automotive Engineers of Japan, vol. 48, Jan. 1, 1994, pp. 43–48.

Technology A Generation Ahead, Amtech, Selected Amtech Installations, Jan. 15, 1993, p. 3 Hughes, "The Hughes Electronic Toll Collection System", Jan. 1993.

Nell Thorpe and Peter Hills, "The scope of automated pricing system", Traffic Engineering +Control, Jul. 1991, pp. 364–370.

P. T. Blythe and P. J. Hills, "The technology", Traffic Engineering +Control, May 1991 pp. 240–245.

P. T. Blythe and P. J. Hills, "Achievements of the Pamela Project within the Drive I Programme" Dec. 1992, pp. 385–392.

*Primary Examiner*—Harold Pitts

*Attorney, Agent, or Firm*—Cushman, Darby & Cushman IP Group of Pillsbury Madison & Sutro LLP

[57] ABSTRACT

An automatic debiting system and method suitable for free lane traveling. Debiting antennas disposed on a first gantry are used to communicate with an in-vehicle unit (IU) mounted on the vehicle for debiting. The passages of the vehicles are detected by the loop coils or line scanners, and the license plates, etc., of the vehicles are photographed by the enforcement cameras. Debiting confirmation antennas on second gantry are used to communicate with the IU for the confirmation of debiting. When the normal debiting is confirmed, a local controller informs a system central controller of the fact, whereas when abnormal debiting is confirmed, images of the license plate, etc., of the illegal vehicle are transmitted to the system central controller as illegal vehicle images. The debiting is thus possible at the time of free lane traveling.

24 Claims, 37 Drawing Sheets

LINE SCANNER 581 ——— LOOP COILS 601, 602, 603

LINE SCANNER 582 ——— LOOP COILS 603, 604, 605

AUTOMATIC DEBITING SYSTEM SUITABLE FOR FREE LANE TRAVELING

This is a continuation of application Ser. No. 08/420,687, filed on Apr. 12, 1995, which was abandoned upon the filing hereof.

BACKGROUND OF THE INVENTION

1. Field of the Invention

The present invention relates to an automatic debiting system for automatically debiting (including prepayment by prepaid cards and settlement by IC cards or credit cards) tolls against vehicles traveling a toll road, etc., or vehicles passing through a tollgate.

2. Description of the Related Arts

A variety of systems have hitherto been proposed in order to debit tolls against vehicles traveling a toll road. FIG. 2 illustrates an external appearance of such a system disclosed in Japanese Patent Laid-open Pub. No. Hei 4-34684.

A vehicle 10 is shown just about to enter a tollgate. Entry of the vehicle 10 into the tollgate is optically detected by vehicle separators 12 and 14 provided at the entrance of the tollgate, and an automatic toll collector 30 is informed of the detection. To also optically detect the entry of the vehicle 10, vehicle separators 16 and 18 are disposed on a downstream side of the vehicle separators 12 and 14. These two pairs of vehicle separators 12, 14 and 16, 18 cooperate with each other so that when a plurality of vehicles 10 enter the tollgate in tandem, individual vehicles can be separated and that the direction of entry of the entered vehicles can be properly recognized.

On the downstream side of the vehicle separators 16 and 18 overhang detectors 20 and 21 are further disposed as well as vehicle length detectors 24 and 26, each serving to optically detect the entry of the vehicle 10. In accordance with the output of the overhang detectors 20 and 22, the automatic toll collector 30 detects the presence or absence of the front overhang of the vehicle 10 to identify the types of vehicles (identification of whether the vehicle 10 is, for example, a bus or car). The automatic toll collector 30 also detects the length of the vehicle 10 (vehicle length) on the basis of the output of the vehicle length detectors 24 and 26. A camera 28 is located on a downstream side of the vehicle length detectors 24 and 26, and photographs a front number plate or license plate of the vehicle which is entering the tollgate.

In the case of this system, the vehicle driver pays the toll in cash to the automatic toll collector 30 when the vehicle 10 reaches the collector 30. The instant the toll is collected, downstream toll bars 32 and 34 are opened. On the downstream side of the toll bars 32 and 34 two pairs of vehicle separators 36, 38 and 40, 42 are situated, serving to prevent following vehicles from passing through the toll bars 32 and 34 without paying tolls while the bars 32 and 34 are open.

For the execution of such system, however, a tollgate must be provided for permitting incoming vehicles to pass through one by one. To provide such a tollgate, the toll road needs to be of the interchange type, not a main road type. This will limit the place where this system can be executed to a place allowing provision of the interchange. Also, provision of the tollgate will necessitate additional costs for installation, maintenance, management, etc., (for example, including facility construction costs and labor costs). Depending on the environment, the provision of the tollgate may give rise to traffic jams, since the tollgate blocks high-speed passage therethrough. Particular attention must be paid to application of the above-described toll debiting system to superhighways so that the introduction of the toll debiting system does not bar high-speed traffic which is an original object of providing the superhighways. However, a tollgate is indispensable to the above debiting system. If the provision of the tollgate inevitably results in the occurrence of traffic jams, it would be difficult to apply the above debiting system to superhighways.

One of the major objects when providing the tollgate lies in secure debiting against each vehicle and in detection of vehicles paying no tolls. In the above-described prior art example, the entry of a vehicle, the direction thereof, the type of the vehicle, the vehicle length, etc., are detected and identified by the optical means arranged on each tollgate. The detection and identification by use of such means owe to the fact that each lane is provided with one tollgate. With similar optical detecting means (e.g., photoelectric switches) were arranged across a plurality of lanes, it would be impossible to distinguish and separate a plurality of vehicles moving side by side. For this reason, it hitherto been impossible to do away with the tollgate.

SUMMARY OF THE INVENTION

A first object of the present invention is to enable a plurality of vehicles to be separately detected, for example, in the case of free lane travel where the plurality of vehicles travel side by side in a plurality of lanes.

A second object of the present invention is to obviate a tollgate by the implementation of the above functions of separately detecting the vehicles traveling side by side.

A third object of the present invention is, as a result of obviating the tollgate, to allow an automatic debiting system to be provided on a main road without requiring interchanges, as well as to ensure easier and inexpensive execution thereof.

A fourth object of the present invention is, by use of radio techniques in addition to the obviating of the tollgate, to debit tolls against vehicles and to confirm the debit, thereby enabling both the collection and the detection of illegal vehicles (such as vehicles paying no tolls) to be executed irrespective of high-speed traveling of the vehicles.

A fifth object of the present invention is to execute both the toll collection and the illegal vehicle detection while the vehicles are traveling at high-speed, thereby preventing the occurrence of a traffic jam.

A sixth object of the present invention is to improve vehicle detection means and processing as well as the arrangement of the means, thereby enabling a plurality of vehicles traveling side by side or in tandem to be separately detected at higher precision and higher speed.

A seventh object of the present invention is to eliminate dead spots in detection, by improving detection means and processing as well as the arrangement thereof.

An eighth object of the present invention is to ensure an accurate judgment of the types of vehicles, by providing improved vehicle detection means and processing and improved arrangement thereof.

A ninth object of the present invention is to accurately execute the judgment of the positions and types of vehicles and to detect speeds of the vehicles so that illegal vehicles can be photographed at appropriate timing.

A tenth object of the present invention is to facilitate the identification of illegal vehicles by an improved data processing method.

SUMMARY OF THE INVENTION

According to a first aspect of the present invention, there is provided an automatic debiting system comprising first a gantry disposed so as to span a road having a predetermined number of lanes; a second gantry disposed so as to span the road on the downstream side of the first gantry in the vehicle advancing direction; debiting means arranged on the first gantry for radio communication with vehicles traveling on the road to impose tolls thereon; debiting confirmation means arranged on the second gantry for radio communication with the vehicles traveling on the road to confirm that tolls have been correctly imposed thereon; passage position detection means for detecting passage positions in the lane crossing direction of the vehicles traveling on the road; photography point decision means for deciding points to be photographed in accordance with the passage positions in the lane crossing direction so as to photograph vehicles from which confirmations have not been obtained that at least tolls have been correctly imposed thereon; and illegal vehicle photography means for photographing the points to be photographed which have been determined by the photography point decision means.

According to a second aspect of the present invention, there is provided a method of debiting comprising the steps of executing radio communication for imposing tolls on a vehicle between a first gantry disposed so as to span a road having a predetermined number of lanes and the vehicle traveling on the road; executing radio communication for confirming that tolls are normally imposed on the vehicle between second gantry, disposed so as to span the road and arranged on a downstream side of the first gantry, and the vehicles traveling on the road; detecting a passage position in the lane crossing direction of the vehicle traveling on the road; determining the points to be photographed in accordance with the passage position in the lane crossing direction so as to photograph at least the vehicle from which confirmation that the toll has been normally imposed thereon has not been obtained; and photographing the points to be photographed determined by the photography point determination means.

In the present invention, the first and the second gantries are arranged so as to generally span a plurality of lanes. The second gantry is positioned on the downstream side of the first gantry when viewed along the flow of the vehicles. The system of the present invention is further provided with debiting means, debiting confirmation means, passage position detection means, photography position decision means, and illegal vehicle photography means. The debiting means arranged on the first gantry communicates with the vehicles passing along the road to impose tolls on the vehicles (debiting). The debiting confirmation means arranged on the second gantry communicates with the vehicles passing along the road to confirm whether the debiting has taken place normally or not (debiting confirmation). The passage position detection means detects the passage positions in the lane crossing direction of the vehicles passing along the road. Then, at least the vehicles which have not undergone the normal debiting are photographed. Which vehicle is to be photographed as an illegal vehicle is determined by use of the passage position in the lane crossing direction detected by the passage position detection means.

In the present invention, in this manner, the debiting is performed through the communication between the debiting means and the vehicles, and hence there is no need for the users to insert the tolls in cash into the toll collectors. Furthermore, the debiting confirmation is performed through communication between the debiting confirmation means and the vehicles, to photograph the illegal vehicles, and hence there is no need to provide tollgates for barring the passage of the illegal vehicles. Moreover, the specification of the illegal vehicles is performed on the basis of the passage positions in the lane crossing direction which are detected by the passage position detection means, and therefore even in the presence of a plurality of lanes under the first and second gantries and in the case where the vehicles are free lane traveling along the lanes, the vehicles can be separately detected. Accordingly, the photography of the illegal vehicles and the attendant processing (for example, report of the illegal vehicles) can be accurately carried out.

Also, in the present invention, a series of functions such as debiting, debiting confirmation, and violator detection can be implemented without providing tollgates, and hence the automatic debiting system can be implemented on the main road, and not on the interchanges. It is also possible to debit against the vehicles free lane traveling along the plurality of lanes. This will result in easy and inexpensive execution of the automatic debiting system. With the obviating of the tollgates, the debiting and the debiting confirmation are carried out by the radio communication with the vehicles, whereupon high-speed traveling of the vehicles can be dealt with, thus preventing the occurrence of traffic jams.

For the detection of the vehicle passage in the present invention, use is first made of a plurality of detection elements embedded for each lane in the lane crossing direction, secondly of a light and shade pattern formed on the road, and thirdly of the triangulation using photo sensing technique.

First, consideration will be given of the use of the detection elements. The detection elements can be, by way of example, inductors such as loop coils. When the vehicle passes over the inductors, the variety of magnetic materials constituting the vehicle causes the inductance of the inductors to vary, thus resulting in the change of the output signal values (amplitude or phase) of the inductors. If a plurality of detection elements having such a nature, that is, such that output signal values vary when the vehicle passes through the vicinity thereof, are embedded for each lane, the passage position of the vehicle in the lane crossing direction can be recognized at a needed resolution in accordance with the positions of the detection elements. Even though the plurality of vehicles travel side by side, irrespective of the spacings therebetween, the passage positions of these vehicles can be separately detected vehicle by vehicle, by performing analysis based on the output of the inductors.

Further, by comparing the output signal values of the detection elements whose output signal values have changed with the output signal values of the other detection elements, the type of the passing vehicle can be identified. When for example, only a single inductor exhibits a change in output signal value, but the other inductors adjoining or in proximity to it exhibit no change of output signal values, the passing vehicle can be regarded as a vehicle having a narrow width such as a motorcycle. Conversely, if a change of the output signal value appears in the plurality of inductors adjoining or in proximity thereto, the passing vehicle can be regarded as a vehicle having a wide width such as an automobile. The identification of the vehicle type can be done using other techniques, but the utilization of the detection elements can implement at the same time, the passage position detection in the lane crossing direction and the vehicle type identification. Moreover, by utilizing the result of the vehicle type identification, the passage position in the lane crossing direction can be more accurately determined.

In order to perform this vehicle type identification by relatively simple means when carrying out the vehicle type identification by use of the detection elements such as inductors, the following method a change has appeared in the output signal value of the inductor, it is judged whether the output signal value after change is a relatively small value or a relatively large value. Then, for the inductor of which an output signal value after change is a relatively small value, it is estimated that the vehicle which has passed through its vicinity is a lightweight vehicle having a relatively small mass. Conversely, for the inductor of which output signal value after change is a relatively large value, it is estimated that the vehicle which has passed through its vicinity is a heavyweight vehicle having a relatively large mass. In other words, the passage detection in the present invention is performed utilizing the two kinds of sensitivity, and the identification of the vehicle type is performed of the combination of the detection results by the two sensitivities.

The utilization of the results of the passage detection by the two kinds of sensitivity will ensure an accurate estimation of the passage positions in the lane crossing direction.

For example, assume a vehicle which has passed through the vicinity of a first inductor has been estimated to be a lightweight vehicle. Also assume that a vehicle passing through the vicinity of another inductor adjacent or in proximity to first inductor has been estimated to be a heavyweight vehicle. If the distance between the two inductors is less than the reference distance, it is considered that the vehicles which have passed through the vicinities of the two inductors are one and the same. Therefore, by making use of, for example, the positions at which the inductors are embedded, the timing at which the output signals values vary, etc., for the execution of quadric curve approximation, the position, in the lane crossing direction, at which the vehicle passed through the vicinities of the two conductors can be more accurately estimated. If it is difficult to execute the quadric curve approximation due to the deficient number of inductors detecting the same vehicle, then alternative approximation points may be found for the deficient number of approximation points in accordance with the timing at which the output signal changes appear form any inductors. If the distance between the two inductors is larger than the reference distance, it can be estimated that the vehicles which have passed through the vicinities of the two inductors are separate vehicles.

In the case of the existence of a plurality of inductors in proximity to each other exhibiting signal variations, as a result of a vehicle passing through the vicinities thereof, that indicate that the vehicle is a heavyweight vehicle, the passage position in the lane crossing direction, of this vehicle can be estimated in accordance with the positions of these inductors, and the timing of the change of the output signal values.

By utilizing the results of the passage detections using two kinds of sensitivity, there is possible to separately detect a plurality of vehicles traveling in tandem. In this case, it is a problem of how to distinguish the plurality of vehicles traveling in tandem from a single vehicle having a longer length.

In both the case of a plurality of vehicles traveling in tandem and of a single vehicle having a longer length, the output signal values of the inductors first change into relatively small values and into relatively large values, and then temporarily change into relatively small values and again into relatively large values. Compared with the initial transitional time during which the output signal values change for the first time from the relatively small values into the relatively large values, the intermediate transitional time during which the output signal values change for the second time from the relatively small values into the relatively large values is longer for the plurality of vehicles in tandem, but is shorter for the single vehicle having the longer length. Accordingly, by detecting the initial transitional time and the intermediate transitional time and comparing them, the two cases can be distinguished from each other.

A method of detecting the passage positions in the lane crossing direction of the vehicles includes not only the method of utilizing the detection elements but also a method of making use of the light and shade pattern formed on the surface of the road. In the absence of the vehicles lying on this light and shade pattern, the images obtained by photographing the light and shade pattern contain the images representing the light and shade pattern. When a vehicle passes over the light and shade pattern, the presence of the vehicle will disturb the light and shade pattern in the images. Therefore, based on the disturbance of the light and shade pattern in the images being photographed, the passage of the vehicle over the light and shade pattern can be detected. Also, the points at which the disturbances have occurred can be detected as the vehicle passage positions. In the case of the use of the light and shade pattern in this manner, the difference in reflectivities between the "light" parts and the "shade" parts may be utilized for calibration of the photography and detection of the light and shade pattern, thereby reducing the influences of the variations in sunshine or the occurrence of shaded portions.

The means for photographing the light and shade patterns are preferably disposed at positions allowing the photography of the vicinities of the boundaries of the lanes. Such an arrangement will reduce the dead spots in detecting the vehicle passages by use of the light and shade pattern. More specifically, in the case of a vehicle having a higher height such as a double-decker bus, traveling in the middle of the lane together with a vehicle having a lower height such as a motorcycle traveling alongside, proper detection of the passage of the vehicle having the lower height can be ensured.

In the present invention, alternatively, a light emitting device and a photo receiving device my be used for position detection. The light emitting device emits the light onto the road, more specifically, onto the white line crossing the lane. The light receiving device receives the light reflected by the road or the vehicle on the road. By scanning the road a long the lane crossing direction and by emitting the light at descrete points of time using the light emitting device, the position at which the vehicle crosses the white line on the road and the width there of can be detected without using the black and white pattern. Therefore, the position detection can be performed with less suffering the rain, dust or the like.

In the present invention, the speeds of the vehicles which have passed under the first gantry are detected and the photographing timing is regulated in accordance with the detected speeds. Accordingly, the photography of the license plates is executed at appropriate timing according to the vehicle speeds.

Then, in the present invention, the results of the communication between the debiting means and the vehicles are correlated with the vehicles photographed by the illegal vehicle photography means by the vehicle specification means. This will allow correct and easy specification of the illegal vehicles.

BRIEF DESCRIPTION OF THE DRAWINGS

These and other objects, advantages and features of the present invention will become more apparent from the following detailed description when read in conjunction with the accompanying drawings wherein like elements are referenced by like numerals, and wherein.

DETAILED DESCRIPTION OF THE PREFERRED EMBODIMENTS

A preferred embodiment of the present invention will now be described with reference to the accompanying drawings.

(1) System Appearance

Figure 1:
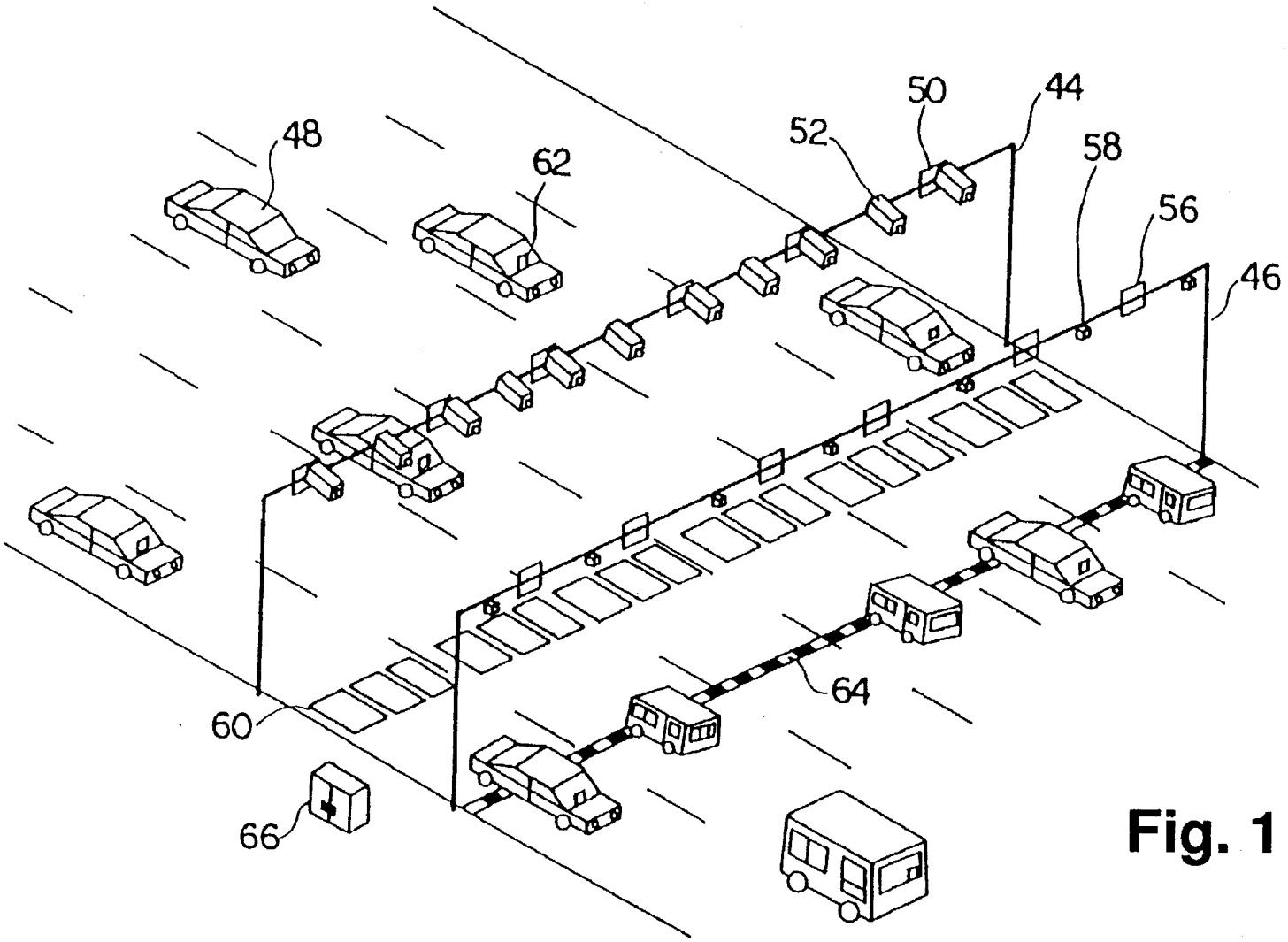
FIG. 1 is a perspective view showing an external appearance of a system according to an embodiment of the present invention, particularly, in the vicinity of first and second gantries.
Figure 2:
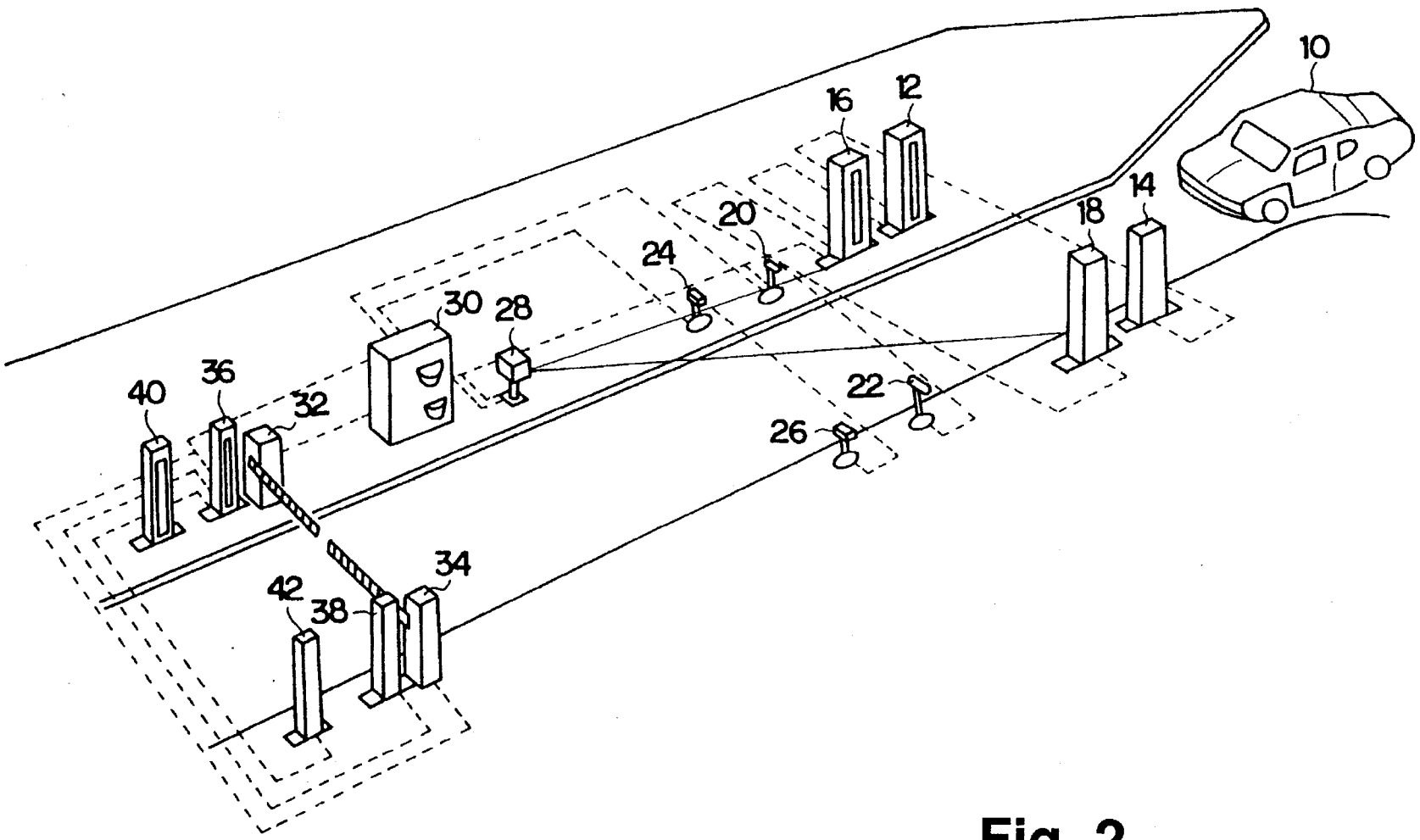
FIG. 2 is a perspective view showing an external appearance of a system according to a prior art example, particularly, in the vicinity of a tollgate.

Referring first to FIG. 1, there is depicted an external appearance of an automatic debiting system according to an embodiment of the present invention, particularly, in the vicinity of first and second gantries. This embodiment includes no tollgates. In place of the tollgates there are provided a first gantry 44 and second gantry 46 each spanning a plurality of lanes (six lanes are shown). That is, the system of this embodiment is carried out on a main road without providing any interchanges. Naturally, the present invention may also be applied to a single-lane road.

Vehicles 48 are free lane traveling from the upper left of the diagram toward the lower right. The first 44 and second 46 gantries are disposed upstream and downstream, respectively, in the advancing direction of the vehicles 48. The distance between the first 44 and second 46 gantries is determined depending on the legal speed limit of the vehicles 48 to be detected. More specifically, for at least vehicles 48 traveling slower than the legal speed limit, the distance is so set as to complete processing such as debiting, debiting confirmation, and illegal vehicle identification by the time the vehicles 48 pass under the second gantry 46 after the passage under the first gantry 44.

On the spanning portion of the first gantry 44 are arranged debiting antennas 50 and enforcement cameras 52. The debiting antennas 50 are each provided for each of the lanes, and communicate for debiting with the vehicles 48 (more precisely, with their IU's 62 which will be described later) traveling on the corresponding lanes. The enforcement cameras are each used to photograph license plates of the vehicles 48 traveling on the lane. As shown, the number of the enforcement cameras to be arranged may be for example 2n–1 for n lanes (n: natural numbers). Furthermore, the object to be photographed is not restricted to the license plate. That is, to identify the type of a vehicle, parts other than the license plate may be photographed. Alternatives may include a front or rear view of the vehicle, or the vehicle driver. Such arrangement of the enforcement cameras 52, so there are more cameras than lanes, will ensure a substantially enhanced horizontal resolution by integrating all the enforcement cameras 52 irrespective of a reduced number of pixels in the horizontal direction of individual enforcement cameras 52.

Figure 3:
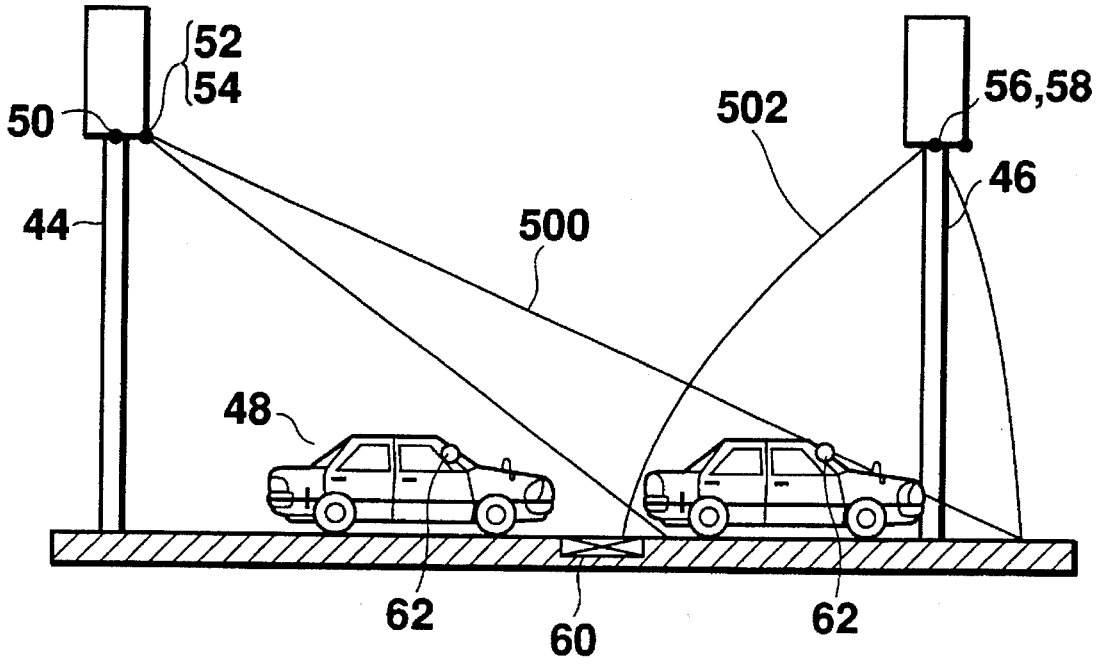
FIG. 3 is a side elevational view showing equipment arranged on the first and second gantry.

Together with lighting units 54 not shown in FIG. 1, the enforcement cameras 52 are positioned, for example, 5.7 meters above the surface of the road (see FIG. 3). The enforcement cameras 52 and associated lighting units 54 are located, for example, 0.5 meters downstream from the debiting antennas 50. Although not shown, the debiting antennas 50 are directed directly below or slightly upstream for radio communication with the IU's 62. The enforcement cameras 52 are arranged in such a manner as to be able to photograph license plates of the vehicles 48 which have passed over loop coils 60 described later. More specifically, depressions of the enforcement cameras 52 are so set that the license plates of the vehicles 48 enter capture zones 500 at a point of time after the vehicles 48 have passed over the loop coils 60. It is to be noted that the arrangement positions of the enforcement cameras 52 must be determined depending on the positions of the loop coils 60, etc., and the speeds of the vehicles 48. Accordingly, the enforcement cameras 52 may possibly be provided on the second gantry 46. The lighting units 54 throw light onto at least their respective camera capture zones 500.

On the spanning portion of the second gantry 46 are debiting confirmation antennas 56 and line scanners 58. In the same manner as the debiting antennas 50, the debiting confirmation antennas 56 are individually associated with each of the lanes, and communicate for debiting confirmation with the IU's 62 of the vehicles 48 traveling on the corresponding lanes. In order to eliminate dead spots, as will be described later, the number of the line scanners 58 to be arranged is n+1 for n lanes. As is apparent from FIG. 3, the debiting confirmation antennas 56 and the line scanners 58 are disposed at the same level as the debiting antennas 50 above the surface of the road. Communication zones 502 of the debiting confirmation antennas 56 are also set so as to allow communication with the IU's 62 on the vehicles 48 at a point of time after the vehicles 48 have passed over the loop coils 60.

Figure 4:
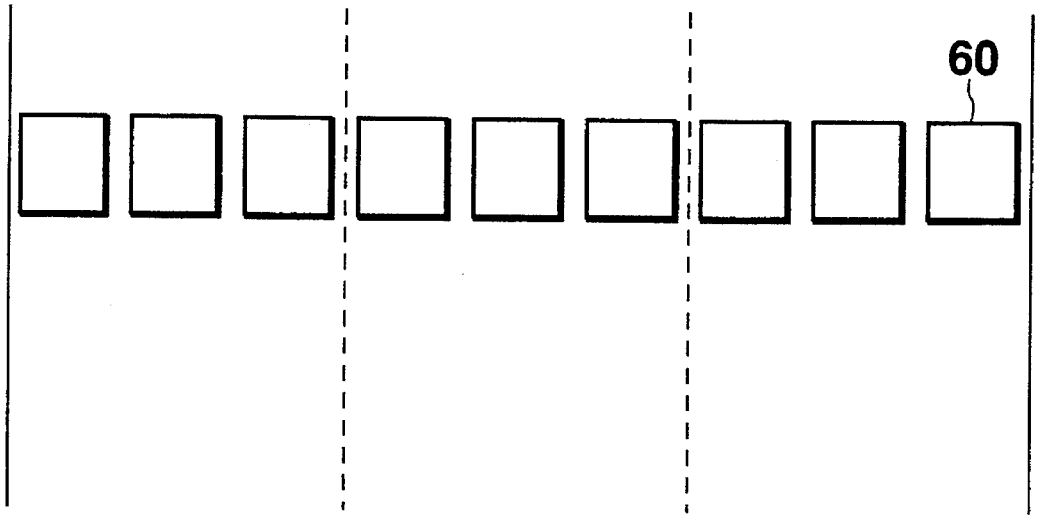
FIG. 4 is a diagram depicting, by way of example, an arrangement of loop coils.
Figure 5:
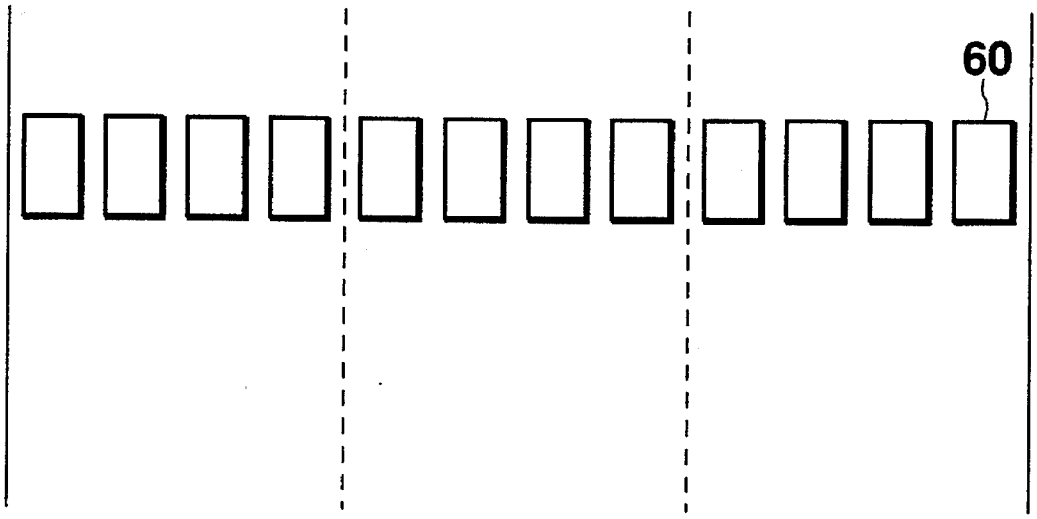
FIG. 5 is a diagram depicting another arrangement of the loop coils.

Arranged on the road side are the loop coils 60 which are coils embedded in the ground and whose embedded positions are indicated by rectangular frames in FIG. 1. In response to the passage of the vehicles 48 (more generally, magnetic materials) thereover, inductances of the loop coils 60 vary. Thus, the passage of the vehicles 48 can be detected by detecting changes of voltage amplitudes or phases which may appear in the outputs of the loop coils 60 in accordance with variations of inductances while supplying alternating signals into the loop coils 60. The loop coils 60 are embedded at predetermined points between the first gantry 44 and the second gantry 46, each lane being embedded with two or more loop coils. For example, three loop coils 60 may be disposed within one lane as shown in FIG. 4, or four loop coils 60 may be placed as shown in FIG. 5. The use of such a multiplicity of loop coils 60 for each lane will contribute effectively to detection of vehicle passage positions at higher resolutions in a lane crossing direction. In other words, by detecting which loop coils 60 have their outputs varied, it is possible to detect the passage positions of vehicle 48 at a high resolution. Moreover, based on patterns of variations in outputs of the loop coils 60, it is possible to recognize the type of the vehicle 48 which has passed over those loop coils 60. It will be appreciated that the loop coils 60 may be embedded on the downstream side of the second gantry 46.

A line 64 is further provided on the road side, and this can be used as an alternative to the loop coils 60. The line 64 is composed of an alternate pattern of black-and-white at predetermined intervals. The line scanners 58 are disposed on the second gantry 46 in such a manner that they are capable of photographing the line 64. In the absence of vehicles 48 on the line 64, images photographed by the line scanners 58 show the black-and-white pattern. When the vehicles 48 pass across the line 48, the black-and-white pattern of the images will be obscured. Therefore, from the state of this observing, it is possible to recognize the passages of the vehicles 48, passage positions, and the types of vehicles. Also, a difference in reflectance between the "black" and "white" portions of the pattern can be utilized to perform calibrations for the implementation of detection independent of environmental factors.

The line 64 extending across the lanes is formed, for example, of paint of alternate black and white at predetermined intervals. This will contribute to inexpensive formation of the line 64, but will instead require relatively frequent maintenance (such as repainting). Alternatively, the line 64 may be formed, for example, of ceramics plates or tiles. This will lead to longer duration than the paint and save labor associated with maintenance. Also, a difference in reflectance between white tiles, etc., and the surface of the road is usually larger than the difference in reflectance between the black and white paint, and hence black tiles, etc., need not be employed. In addition, the line 64 may be comprised of reflectors. Due to larger reflectance, the reflectors will more positively ensure effects similar to the case of the tiles and the like. In addition, the line scanners 58 may be fitted with lighting units and receive light reflected from the line 64.

Figure 6:
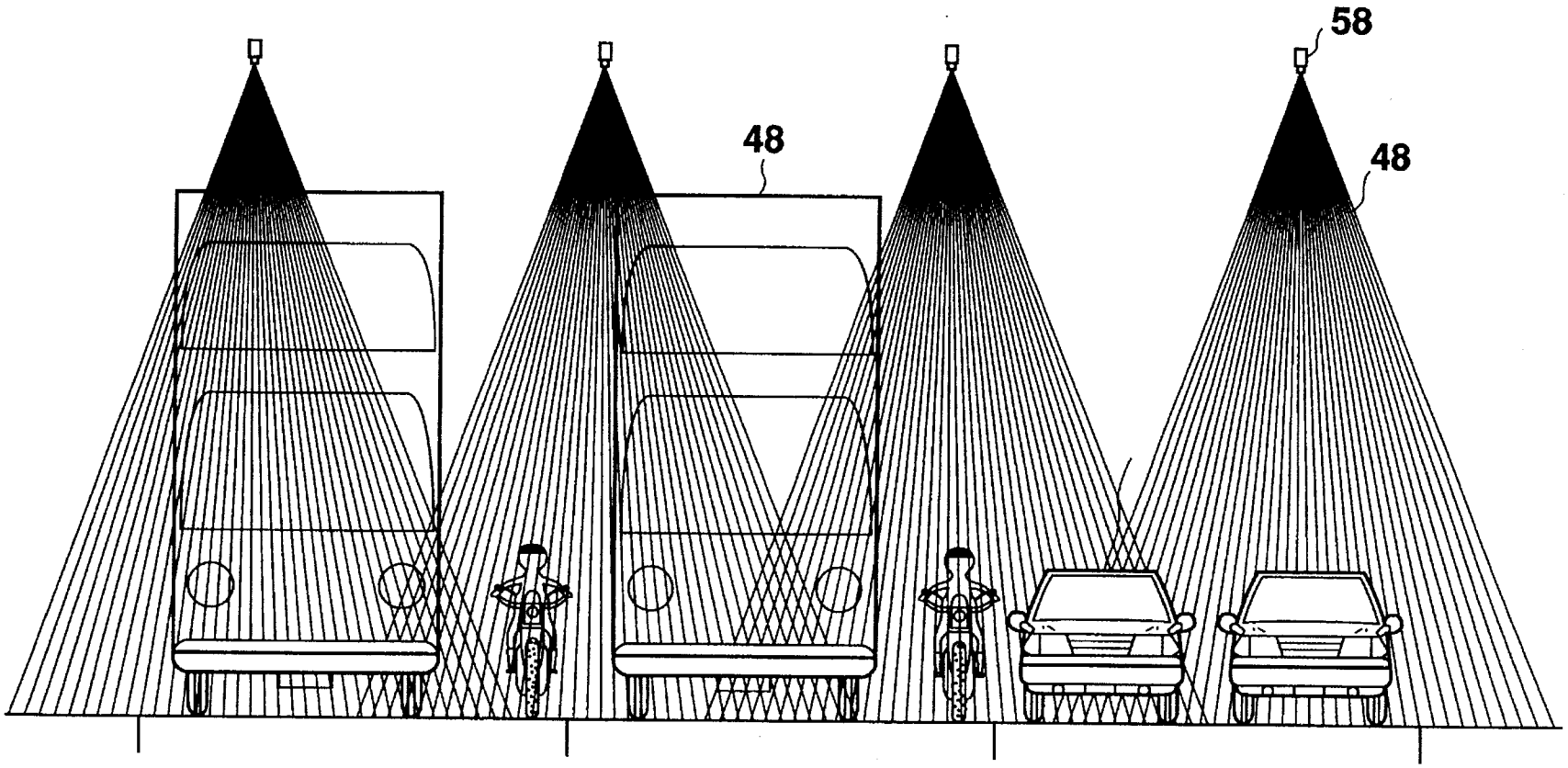
FIG. 6 illustrates by way of example an arrangement of line scanners.
Figure 7:
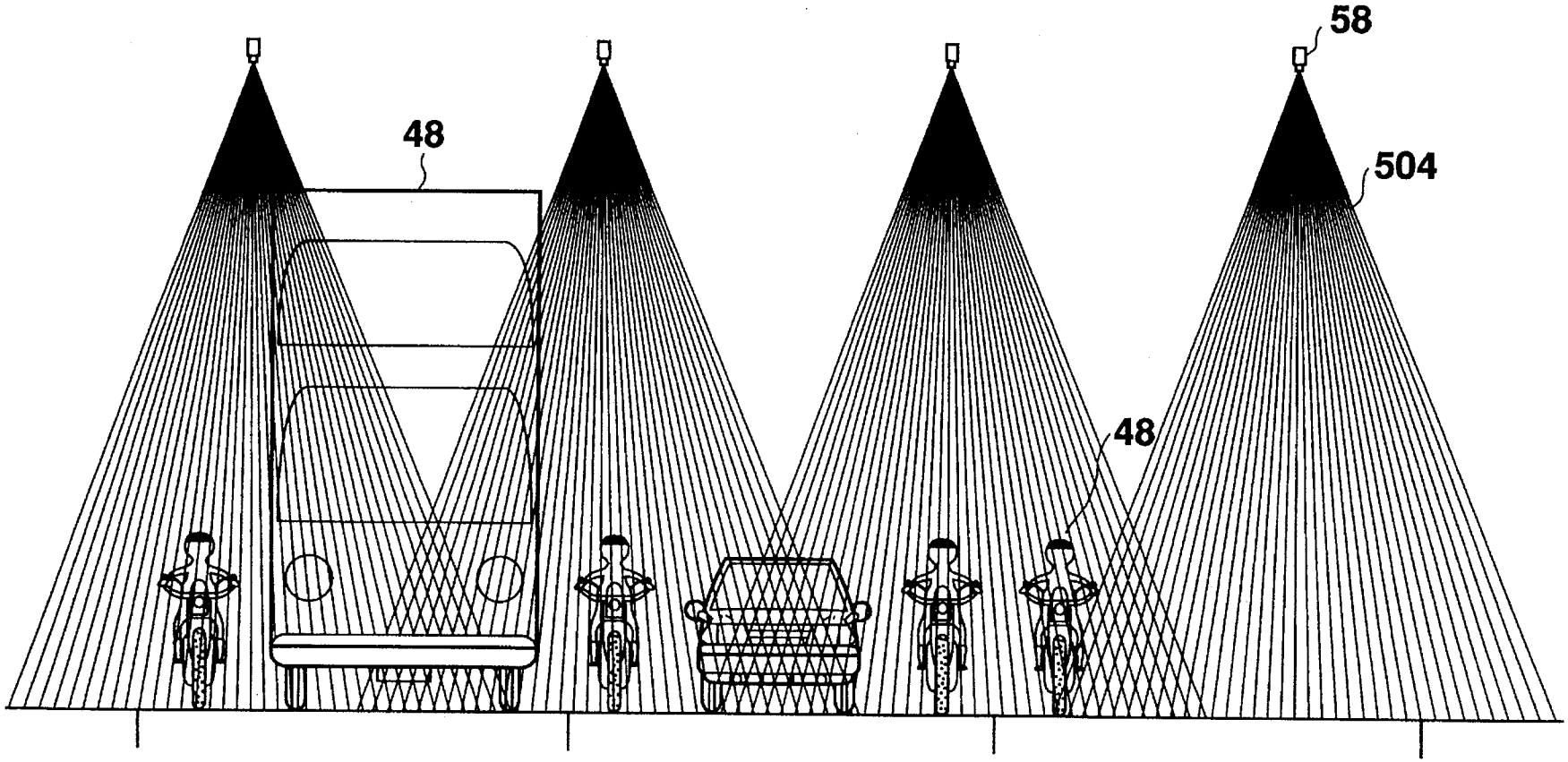
FIG. 7 illustrates an example of the arrangement of the line scanners.

The line scanners 58 are positioned in such a manner as shown in, for example, FIGS. 6 and 7 where four line scanners 58 in total are provided for three lanes. With the number of line scanners 58 being n+1 for n lanes in this manner, the vicinities of lane separating lines would be allowed to fall within the capture zones 504. In the example of FIGS. 6 and 7, the line scanners 58 are each capable of wide-angle photographing, and adjoining line scanners 58 have overlapped capture zones 504. The line scanners 58 at two extreme ends are positioned apart from shoulders approximately 1.1 meters corresponding to the width of the motorcycle plus slight margins. Such an arrangement of the line scanners 58 will allow accurate detections of motorcycles traveling beside a vehicle of larger height, such as a double-decker bus.

Disposed at the side of the road is a local controller 66 serving to control the equipment mounted on the first 44 and second 46 gantries, and making use of this equipment to obtain transaction reports therefrom. The local controller 66 receives commands from a system central controller 68 (see FIG. 8) situated some distance away and transmits the transaction reports to the system central controller 68.

(2) Functions of System Components

Figure 8:
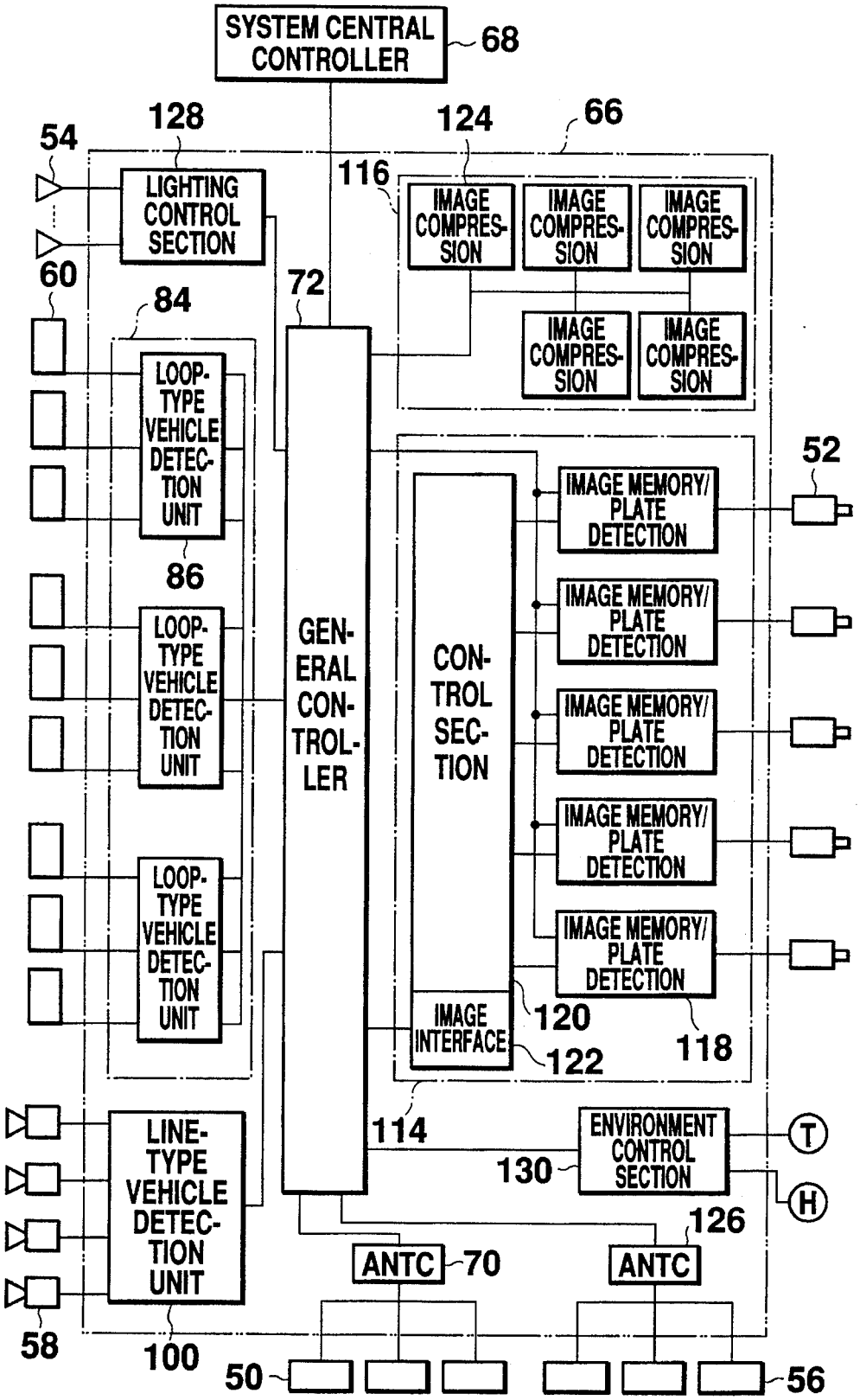
FIG. 8 is a block diagram representing a functional configuration of a local controller.

Referring to FIG. 8 there is depicted a functional configuration of the local controller 66 for three lanes. In the case of an increased number of lanes, additional components are correspondingly provided. For simplicity of representation, a single local controller 66 is provided although in the actual system a plurality of local controllers 66 are typically under the control of one system central controller 68.

The local controller 66 comprises an antenna controller (ANTC) 70 for controlling debiting antennas 50. The debiting antennas 50 are individually provided for each of the lanes, and therefore three debiting antennas 50 are required for the three lanes. The debiting antennas 50 are each used to communicate with the IU 62 mounted on a vehicle 48 for the purpose of debiting. For communication with the IU 62, the ANTC 70 receives commands from a general control section 7. The ANTC 70 processes information obtained as a result of the communication and then supplies it to the general control section 72.

Figure 9:
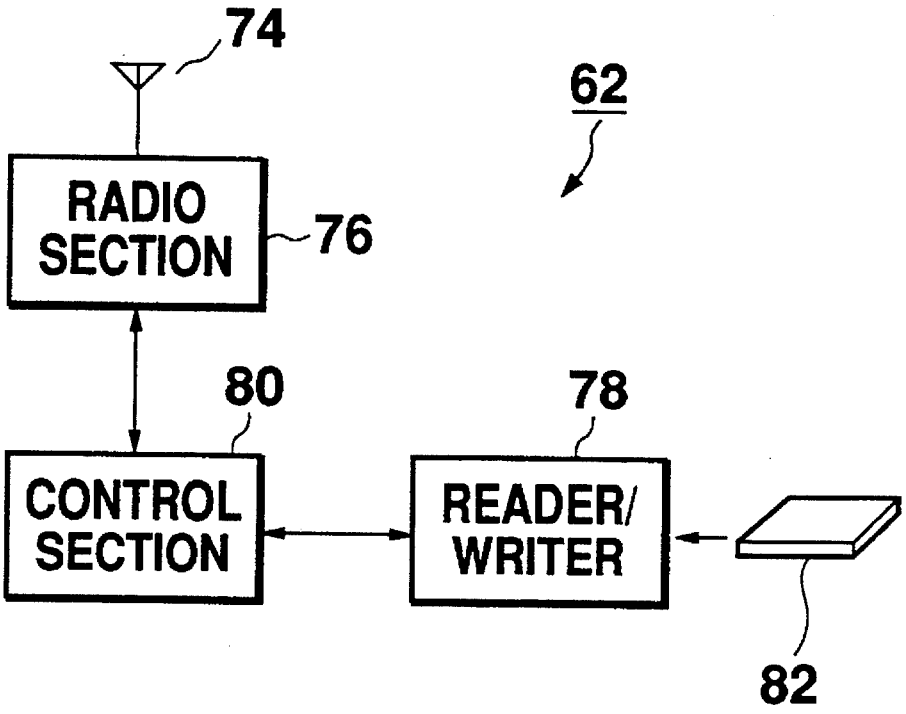
FIG. 9 is a block diagram representing a functional configuration of an in-vehicle unit (IU)

The IU 62 has a configuration, by way of example, such as shown in FIG. 9. The IU 62 is a unit attached to a windshield (for example, below a rear view mirror) of the vehicle 48. As shown, the IU 62 includes an antenna 74, a radio section 76, a reader/writer 78 and a control section 80. The antenna 74 is an antenna for radio communication with the debiting antennas 50 and with debiting confirmation antennas 56. Using the antenna 74, the radio section 76 performs signal communication with the local controller 66. The reader/writer 78 is used to write information into an IC card 82 called a smart card and read information from the smart card 82. In response to power-on, etc., the control section 80 executes mutual authentication between the smart card 82 and the IU 62, and then controls the operation of the IU 62. In the case where the IU 62 is additionally provided with a display, subsequent to debiting confirmation communication, the control section 80 allows the balance of the smart card 82 to appear on a screen of the display.

Referring back to FIG. 8, the local controller 66 comprises a loop-type vehicle detection section 84. The loop-type vehicle detection section 84 includes three loop-type vehicle detection units 86, each corresponding to each of the lanes. The loop-type vehicle detection units 86 each perform processing, upon vehicle detection, by use of loop coils 60 embedded in the corresponding lanes. The loop-type vehicle detection units 86 each serve to detect that the vehicle 48 has passed over the associated loop coils 60 and feed the results to the general control section 72.

Figure 10:
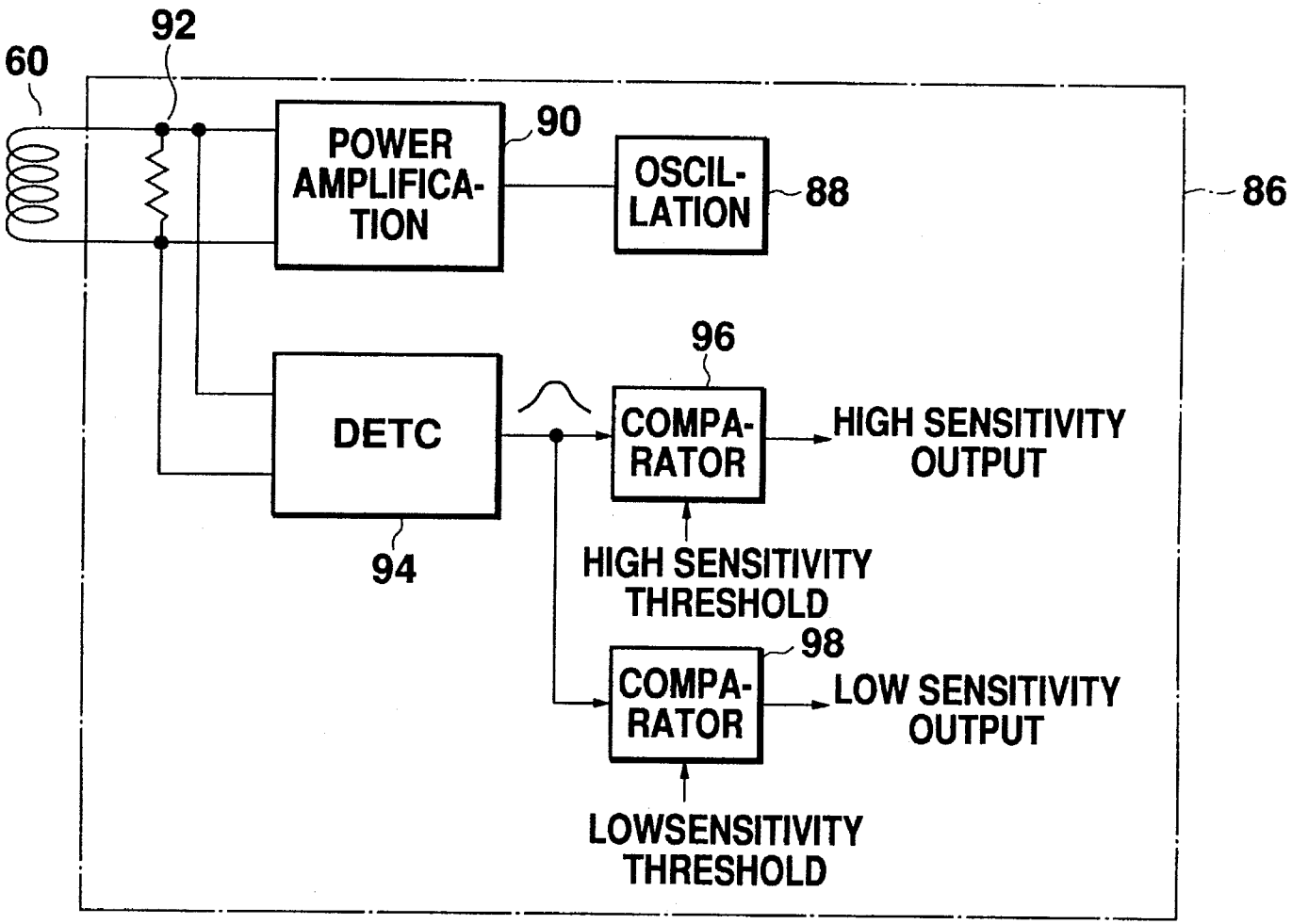
FIG. 10 is a block diagram representing a functional configuration of a loop-type vehicle presence detection unit.

FIG. 10 depicts a functional configuration of the loop-type vehicle detection unit 86. For simplification of representation, the configuration is shown corresponding to one loop coil 60. In the loop-type vehicle detection unit 86, alternating current signals output from an oscillation section 88 are power amplified through a power amplifier section 90 and then supplied to the loop coil 60. In response to the passage of the vehicle 48 over the loop coil 60, the inductance of the loop coil 60 is increased, resulting in a raised voltage at both ends of the loop coil 60. In parallel with the loop coil 60 a detection resistor 92 is connected, by which a variation in the inductance of the loop coil 60 is detected in the form of a change in voltage. The results of detection by the detection resistor 92 are processed by a detector controller (DETC) 94, and then supplied to a couple of comparators 96 and 98. The comparators 96 and 98 compare two respective thresholds which have been set at values different from each other with the output of the DETC 94. The results of comparison are transferred as signals indicating the passage of the vehicle 48 to the general control section 72. Hereinafter, the thresholds associated with the comparators 96 and 98 are referred to as high sensitivity and low sensitivity thresholds, respectively. Similarly, the results of comparison associated with the comparators 96 and 98 are referred to as high sensitivity and low sensitivity outputs. It is to be appreciated that a variation in inductance may be detected as a change in phase although it is detected as a change in voltage in the circuit of this diagram.

The local controller 66 depicted in FIG. 8 further comprises a line-type vehicle detection section 100. Similar to the loop-type vehicle detection section 84, the line-type vehicle detection section 100 is means for detecting the passage of the vehicle 48 and supplying the results to the general control section 72.

Figure 11:
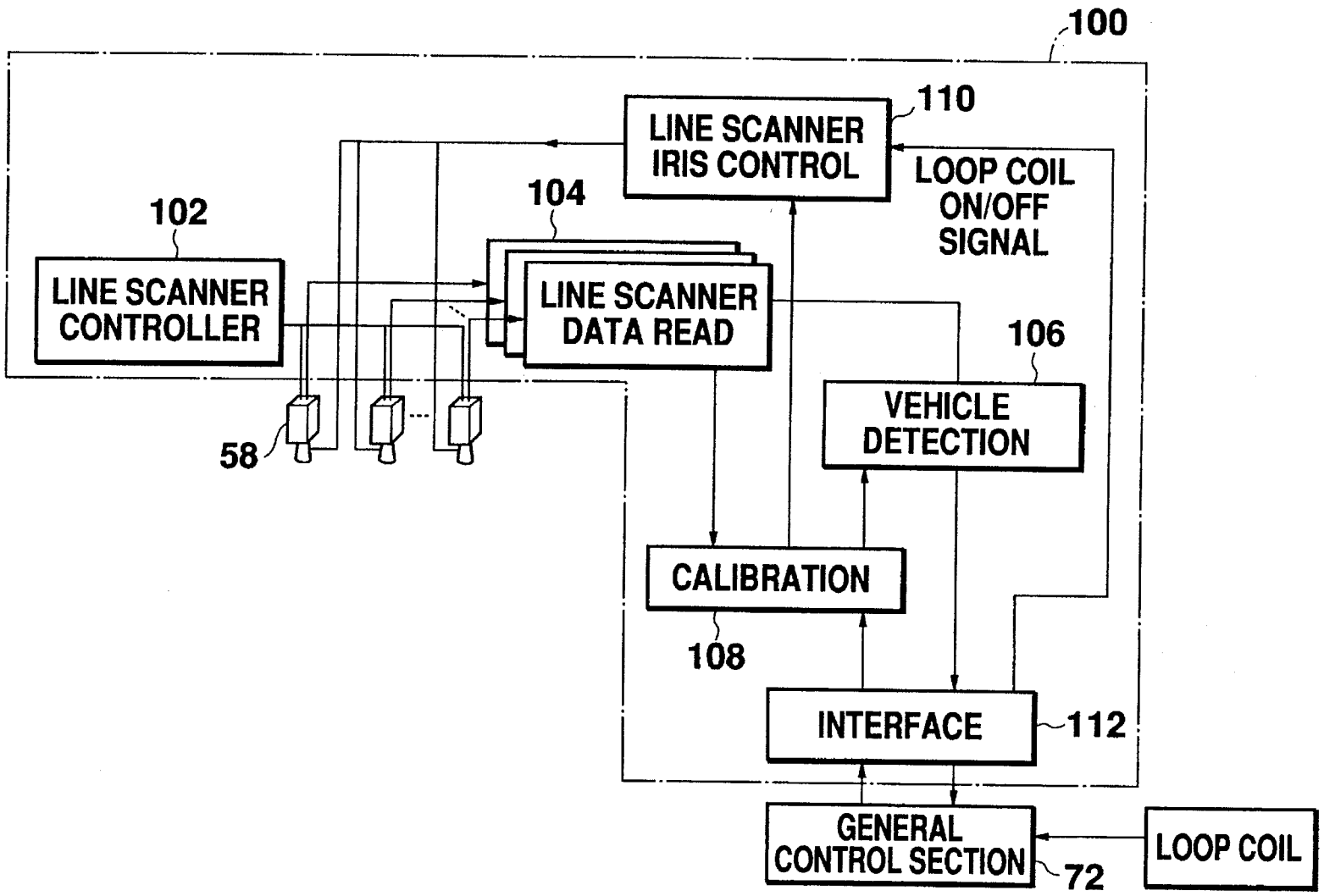
FIG. 11 is a block diagram representing a functional configuration of a line-type vehicle presence detection section.

FIG. 11 depicts a functional configuration of the line-type vehicle detection section 100. As shown, the line-type vehicle detection section includes a line scanner controller 102, line scanner data read sections 104, a vehicle detection section 106, a calibration section 108, a line scanner iris control section 110, and an interface section 112.

The line scanner controller 102 supplies power to the line scanners 58 and imparts clocks thereto for their operations. In response to the clocks, the line scanners 58 photograph a line 64 and supply resultant image signals to the corresponding line scanner data read sections 104. The line scanner data read sections 104 convert the image signals into digital data, and store them in internal image memories. On the basis of the data stored in the image memory, the vehicle detection section 106 performs the processing on detection of the vehicle 48. Transferred to the general control section 72 through the interface section 112 is thus obtained information such as, for example, the presence or absence of the passage of the vehicle 48, and if present, the width of the vehicle 48 which has passed thereover and its passage positions (in lane crossing direction).

The general control section 72, if needed, issues commands via the interface section 112 to the calibration section 108. In compliance with the commands from the general control section 72, the calibration section 108 reads data from the image memories of the line scanner data read sections 104. In accordance with a black-and-white pattern contained in the read data, the calibration section 108 issues commands to the line scanner iris control section 110 which in turn controls the iris of the line scanners 58 in response to the commands. Irrespective of variations in sunshine, etc., this control allows data showing the black-and-white pattern to be formed in the image memories of the line scanner data read section 104.

The local controller 66 further comprises a vehicle photography section 114 for the processing and control pertaining to enforcement cameras 52, and an image compression section 116 for the data compression of images obtained by the photography. The vehicle photography section 114 includes image memory/plate detection units 118 provided in correspondence to the enforcement cameras 52, a control section 120 for controlling the image memory/plate detection units 118, and an image interface section 122 consisting of an interface associated with image output. The image compression section 116 includes image compression units 124 provided in correspondence to the enforcement cameras 52.

In response to the detection of passage of the vehicle 48 by the loop-type vehicle detection section 84 or the line-type vehicle detection section 100, the general control section 72 issues a shutter command to one of the enforcement cameras 52, through a corresponding image memory/plate detection unit 118, to initiate photography of the license plate by the enforcement cameras 52. In order to ensure that the license plate of the vehicle 48 is substantially centered on a photograph, the general control section 72 determines which enforcement camera 52 is to receive the shutter command, depending on the passage position of the vehicle 48 to be detected by the loop-type vehicle detection section 84 or the line-type vehicle detection section 100. This procedure will be described in detail later.

An image obtained by the photography is stored in the image memory of the corresponding image memory/plate detection unit 118. The image memory/plate detection unit 118 extracts the image of the license plate of the vehicle 48 from images stored in its image memory, and supplies the thus extracted license plate image via the image interface section 122 to the corresponding image compression unit 124. The control section 120 controls the image processing (including the extraction of the license plate image) in the image memory/plate detection unit 118, and repeatedly imparts shutter commands to the specific enforcement camera 52 until a preferred license plate image is obtained. The image memory/plate detection unit 118 has sufficient capacity to store a plurality of images produced in response to a series of shutter commands so as to allow a plurality of vehicles 48 coming into its visual field (camera capture zone 500) to be photographed. The image compression unit 124 performs data compression of the image supplied from the corresponding image memory/plate detection unit 118, and then delivers the thus compressed image to the general control section 72 which in turn sends the compressed image to the system central controller 68.

The local controller 66 further comprises an antenna controller (ANTC) 126 for controlling the transmission/reception of signals by the debiting confirmation antennas 56. The ANTC 126 communicates by radio with the IU 62 on the vehicle 48 to confirm whether or not the debiting has been positively executed or not. In response to the result of this confirmation, the general control section 72 sends necessary information to the system central controller 68. In case the execution of debiting has been confirmed, for example, the license plate image produced by the enforcement camera 52 is transferred as an evidential photograph of a violation together with predetermined data to the system central controller 68.

The local controller 66 additionally comprises a lighting control section 128 and an environment control section 130. The lighting control section 128 permits the lighting units 54 to light up the surface of the road when the illuminance on the surface of the road goes down to a predetermined value or below, and turns off the lighting units 54 when it goes up to the predetermined value or over. This will ensure a preferred photography of the license plate irrespective of weather or the time of day or night. The environment control section 130 detects ambient temperatures and humidities, and imparts the results to the general control section 72. In response to the results of detection, the general control section 72 controls the components of the local controller 66 so that they function normally and properly. Should the environmental conditions worsen to such a degree that the components do not work properly or to a degree allowing the possibility of improper functioning, the general control section 72 reports that fact to the system central controller 68.

(3) Summary of Debiting Processing

Figure 12:
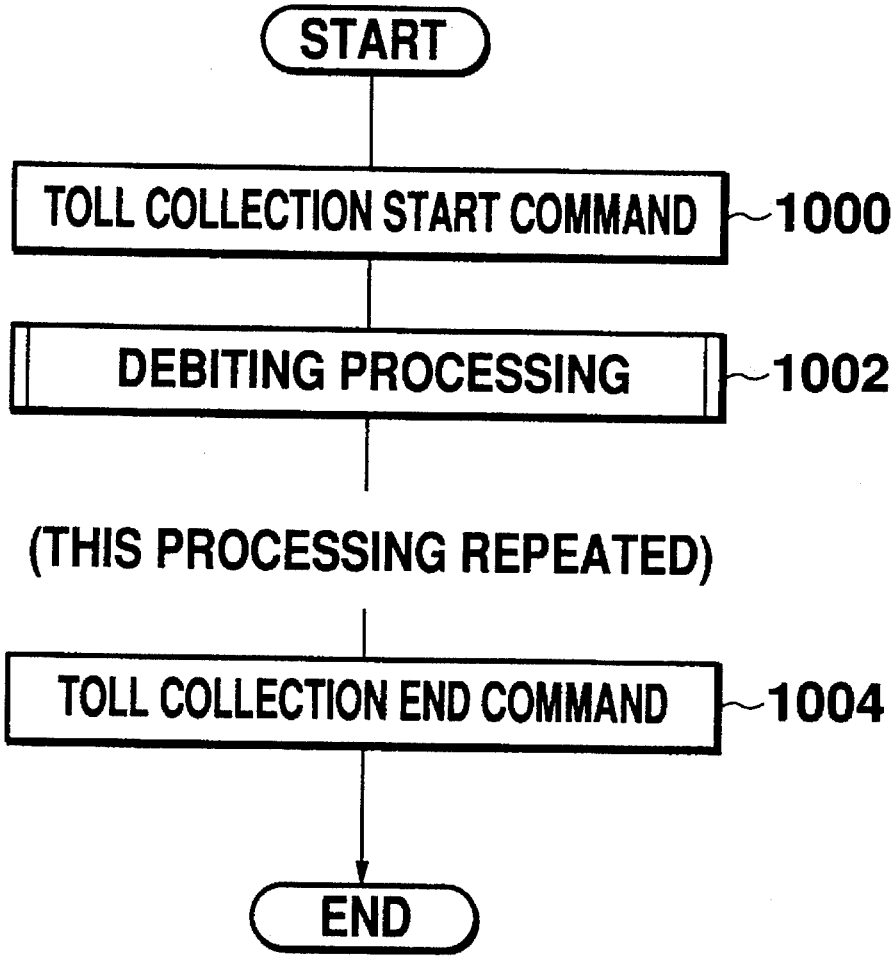
FIG. 12 is a flowchart showing a flow of overall processing in this embodiment.
Figure 13:
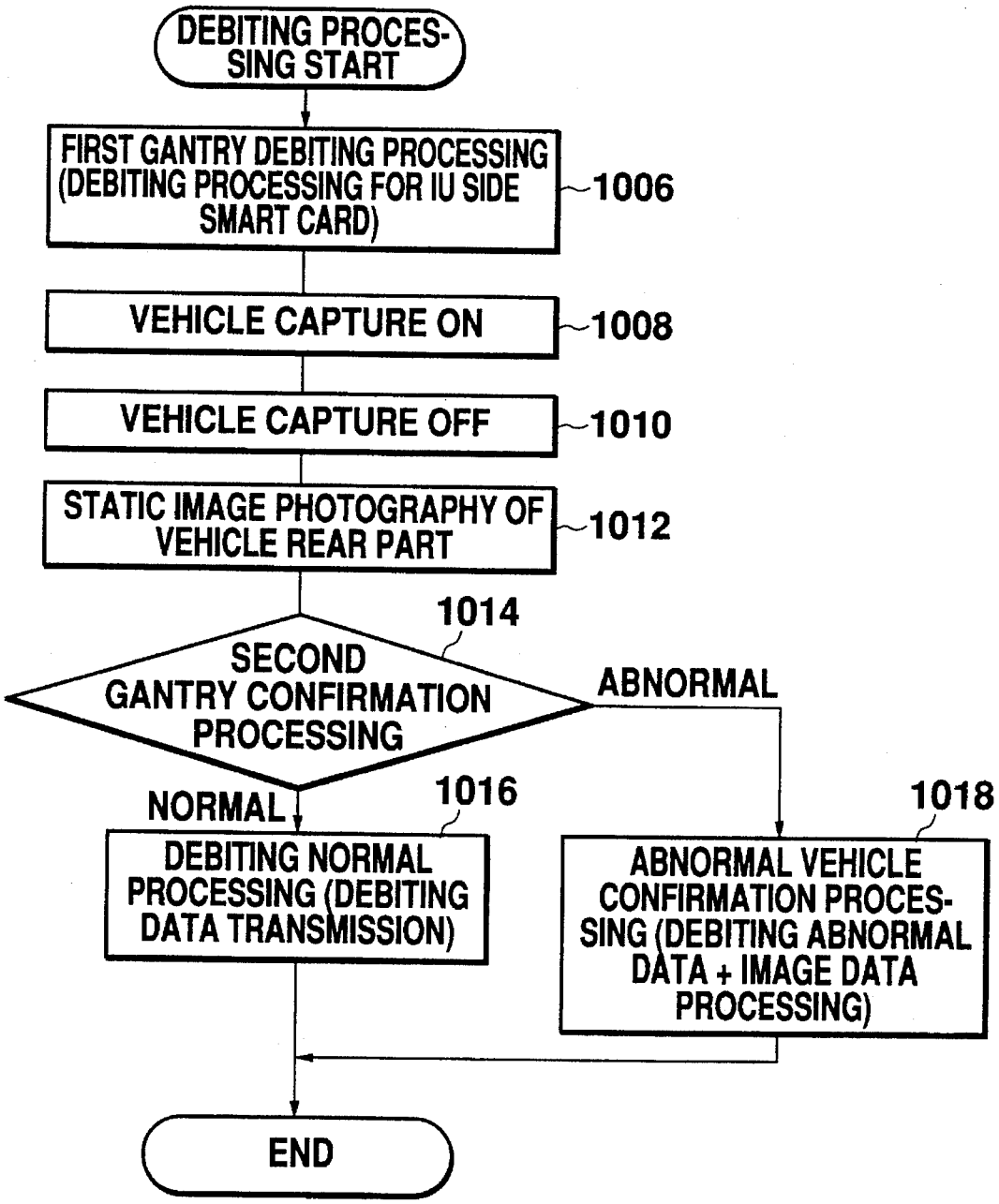
FIG. 13 is a flowchart showing a flow of debiting processing.

Referring to FIGS. 12 and 13, there are depicted a flow of overall processing and a schematic flow of debiting processing, respectively, of this embodiment.

In this embodiment, as shown in FIG. 12, the system central controller 68 first issues a toll collection start command to each of the local controllers 66 (1000). At the same time, information required for debiting processing is also transmitted from the system central controller 68 to the local controllers 66. Upon receipt of these commands and information, the local controllers 66 carry out the debiting processing (1002). Each of the local controllers 66 repeats the debiting processing until it receives a toll collection end command from the system central controller 68 (1004).

The debiting processing executed in each of the local controllers 66 generally follows the flow depicted in FIG. 13.

Under the control of the ANTC 70, the debiting antennas 50 issue a call by radio to the vehicle 48 which is just about to pass under the first gantry 44. As long as a normal IU 62 is mounted on the vehicle 48 just about to pass under the first gantry 44, the IU 62 performs radio transmission of predetermined control information. The control information transmitted from the IU 62 includes information on, for example, the type of the vehicle, the owner, the license number, and an identification code appropriate to the IU 62. Such information is held in the control section 80 or alternatively is read from the smart card 82 by means of the reader/writer 78. The debiting antennas 50 receive the control information from the IU 62, and then transmit the information to the general control section 72. The general control section 72 determines the sum of the toll to be collected using the information on the type of the vehicle out of the control information received from the IU 62. While specifying the IU 62 to be received in accordance with the identification code appropriate to the IU 62 out of the received control information, the general control section 72 transmits the thus determined sum to the vehicle 48 side through the debiting antennas 50. At that time, the general control section 72 may search a valid list (a list of IU's which have been sold on the market) and a black list (a list of habitual debiting violators, etc.) in accordance with the identification code appropriate to the IU 62 or the like. The IU 62 records the sum of the toll to be collected on the smart code 82 and it is then transmitted through the debiting antennas 50 (for instance, the sum may be deducted from an available limit set on the smart card 82). This brings the debiting processing by use of the first gantry 44 to a termination (1006). This processing must be completed at the latest before the vehicle 48 reaches the communication zones 502 of the debiting confirmation antennas 56.

Subsequently, the local controller 66 detects the vehicle 48 by using the loop coils 60 or the line scanners 58 (1008, 1010), and then produces a static image of the rear (more restrictively, a portion mounted with the rear license plate) of the vehicle 48 (1012). The loop-coils 60 and the line scanners 58 both being means for detecting the vehicle 48, may either be solely employed although the cooperation of the two will ensure improved reliability in the vehicle detection. As an alternative to these means, use may be made of, for example, detectors utilizing the principle of triangulation.

Using the debiting confirmation antennas 56 mounted on the second gantry 46, the local controller 66 communicates with the IU 62 on the vehicle 48. More specifically, the local controller 66 requires the IU 62 to send information for the confirmation of debiting, whereupon if normal, the IU 62 responds to this (1014). When the execution of normal debiting is confirmed by the communication through the debiting confirmation antennas 56, the general control section 72 transmits the fact that the debiting has been normally executed along with the data-compressed license plate image (1016) to the system control controller 68. Conversely, in the case where the IU 62 makes no response or where, regardless of a response from the IU 62, the contents of the response indicate incompletion of the debiting (e.g., when exceeding the available limit set on the master card 82), the general control section 72 regards the vehicle 48 mounted with this IU 62 as an illegal vehicle, and transmits the data-compressed license plate image as the image of the illegal vehicle together with the data indicating that the debiting has resulted in an abnormal termination (1018).

(4) Principle of Vehicle Detection with Loop Coils

As describe above, this embodiment includes the loop coils 60 and the line scanners 58 as means of vehicle detection. Description will now be given of a principle of the vehicle detection by means of the loop coils 60.

Figure 14:
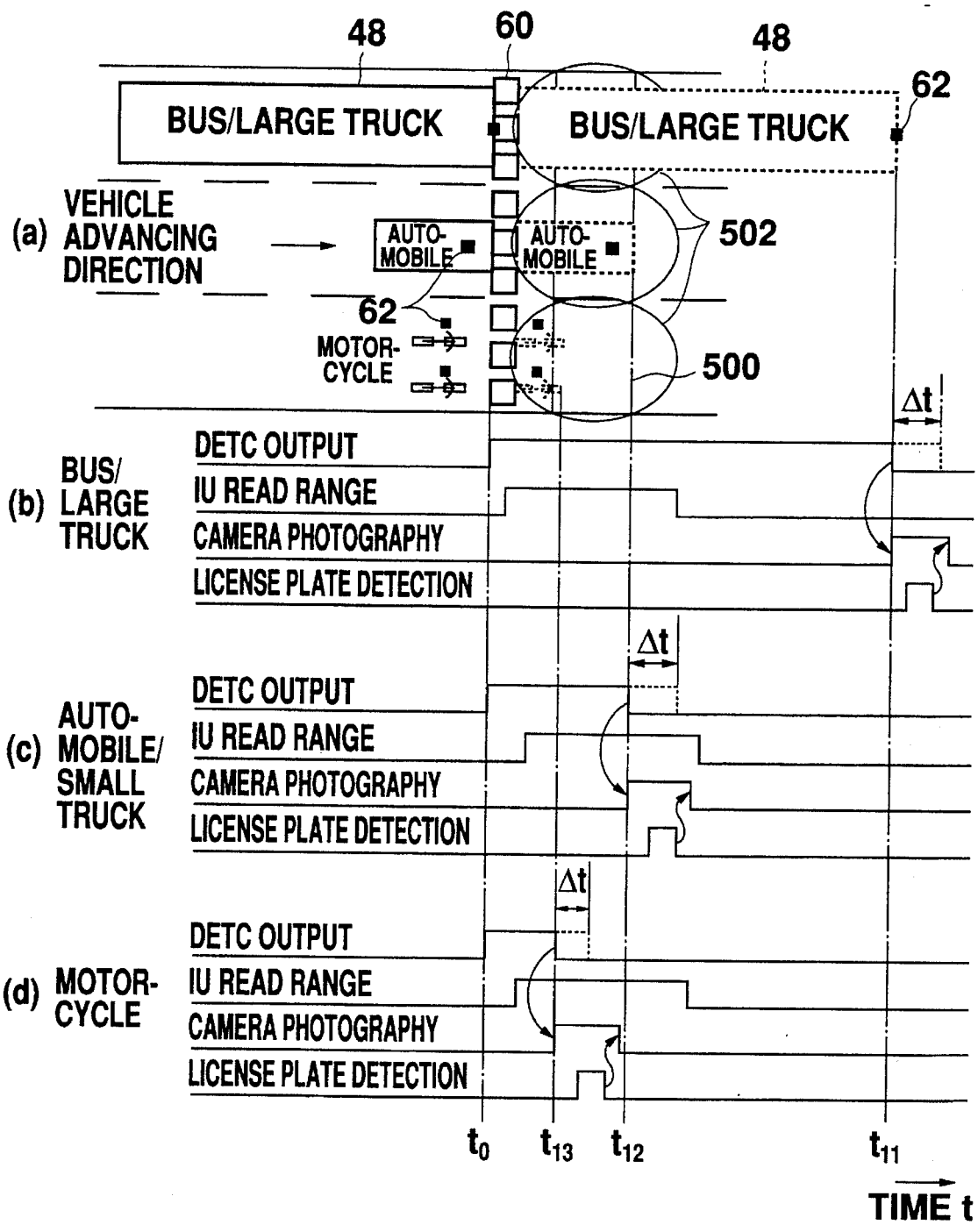
FIG. 14 is a diagram representing relationships between vehicle presence detection by use of the loop coils and timing of photographing a number plate or license plate, in which (a) shows a planar positional relationship among vehicles, loop coils, camera capture zones, and debiting confirmation antenna coverages, (b) shows signal timing where the vehicle is a bus or a large-sized truck, (c) shows signal timing where the vehicle is an automobile or a small-sized truck, and (d) shows signal timing where the vehicle is a motorcycle.

When a vehicle 48 travels along the road, the front of the vehicle 48 (more concretely, a portion of the front wheel axle occupying a relatively large part of the magnetic mass of the vehicle 48) approaches the loop coils 60 at a certain point in time (1008) as indicated by a solid line in FIG. 14(*a*). In response to this, the inductance of the loop coil 60 varies with the result that an output waveform of the DETC 94 rises (timing t0 of FIG. 14(*b*) to (*d*)). It is to be noted that for simplicity of description, dissimilar to FIG. 10, a single comparators is assumedly provided herein to identify the output waveform of the DETC 94 with an output waveform of the comparator.

When the vehicle 48 advances to bring its IU 62 into the debiting confirmation antenna communication zones 502 as indicated by ellipses in FIG. 14(*a*), communication with the IU 62 can be established by way of the debiting confirmation antennas 56. The local controller 66 issues a call for debiting confirmation to the IU 62. In response to the call issued through the debiting confirmation antennas from the local controller 66, the IU 62 reads the debiting information stored in the smart card 82 by means of the reader/writer 78 and sends it through the radio section 76 to the local controller 66. The debiting information is received by the local controller 66 through the debiting confirmation antennas 56.

With further advancement of the vehicle 48, the rear of the vehicle 48 (more concretely, a portion of the rear wheel axle occupying a relatively large part of the magnetic mass of the vehicle 48) leaves the loop coils 60 as indicated by a dotted line in FIG. 14(*a*). In response to this, the output of the DETC 94 falls (1010). In FIG. 14(*b*) to (*d*), the fall timing is designated by t11, t12, and t13 for bus/large-sized truck, automobile/small-sized truck, and motorcycle, respectively. In synchronism with this fall timing, the general control section 72 imparts shutter commands to the enforcement cameras 52 (1012). The image memory/plate detection unit 118 extracts license plate images from the images photographed by the corresponding enforcement camera 52. When the vehicle 48 comes into the camera capture zone 500 indicated by a rectangle in FIG. 14(*a*) and brings the license plate into a preferred position, the license plate image extraction processing by the image memory/plate detection unit 118 is completed, in response to which the photography of the license number by use of the enforcement camera 52 comes to an end.

Figure 15:
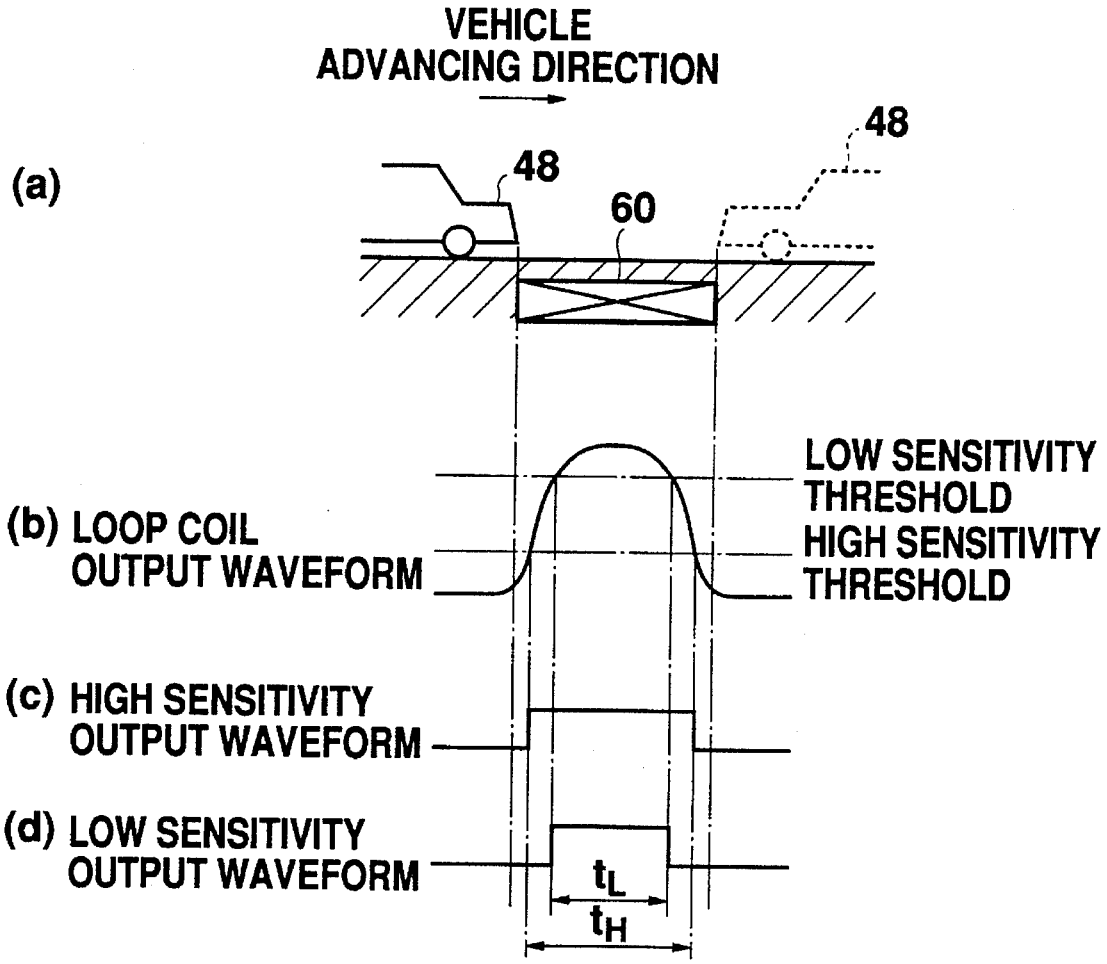
FIG. 15 is a diagram representing a principle for identifying the types of vehicles by use of the loop-type vehicle presence detection section having outputs of high and low sensitivity, in which (a) shows a positional relationship between the loop coil and the vehicle, (b) shows an output waveform of the loop coil, (c) shows a high sensitivity output waveform, and (d) shows a low sensitivity output waveform.

In the case of detecting the vehicle 48 with the loop coils 60, the types of vehicle can be identified by the execution of two kinds of comparison as shown in FIG. 10. When the vehicle 48 approaches the loop coil 60 as indicated by a solid line in FIG. 15(*a*), an output waveform of the DETC 94 gradually rises as shown in FIG. 15(*b*). Providing that a threshold associated with the comparator 96 (high sensitivity threshold) is set to be smaller than a threshold associated with the comparator 98 (low sensitivity threshold), an output waveform (high sensitivity output waveform) of the comparator 96 shown in FIG. 15(*c*) will rise earlier than an output waveform (low sensitivity output waveform) of the comparator 98 shown in FIG. 15(*d*). In the process of the advancement of the vehicle 48 into a position indicated by a broken line in FIG. 15(*a*), the output waveform of the DETC 94 gradually falls as shown in FIG. 15(*b*). In this process, the low sensitivity output waveform will fall earlier than the high sensitivity output waveform.

Accordingly, the use of two kinds of threshold in this manner will bring into existence both the high sensitivity output waveform rising during the time tH and the low sensitivity output waveform rising during the time tL (tL<tH). For the vehicle having a smaller magnetic mass such as a motorcycle, due to smaller variation in the inductance of the loop coil 60, the peak of the output wave of the DETC 94 is reduced, resulting in tL=0. In other words, no low sensitivity output waveform appears. It is thus possible to identify the types of vehicle by collectively judging the high sensitivity and low sensitivity output waveforms in the general control section 72. The results of identification of the types of vehicle are used for the confirmation of debiting or the specification of illegal vehicles. It is to be appreciated that the present invention is not limited to the two kinds of threshold.

As depicted in FIGS. 4 and 5, a plurality of (e.g., three or four) loop coils 60 are provided for each of the lanes. It is thus possible to recognize the position and lane on which the vehicle 48 travels by judging, in the general control section 72 the loop coil 60 over which the vehicle 48 has passed. Given that the traveling vehicle 48 is a motorcycle, an output waveform showing the presence of the vehicle 48 appears in only one of, e.g., three loop coils placed for each lane. Therefore, if one of the loop coils 60 is exclusively subjected to the variation in output, it is detected that the motorcycle has passed over this loop coil 60, enabling not only the position of passage but also the type of vehicle to be recognized.

Also, in the case of plurality of vehicles 48 traveling side by side, no variations in outputs will appear in the loop coils disposed between the plurality of vehicles as long as there is some degree of spacing between the vehicles, whereby these vehicles can be distinguished from one another.

Provided that a plurality of (e.g., three) motorcycles are traveling on the same lane, an output waveform representing the presence of a vehicle may possibly appear in all of a plurality of (e.g., three) loop coils 60. However, since the use of two kinds of threshold enables the types of vehicle to be identified, the traveling of the plurality of motorcycles on the same lane can be distinguished from the traveling of, e.g., a single automobile which may cause an output waveform representing the presence of a vehicle in the three loop coils 60.

In addition, the timing at which to cease photographing by the enforcement camera 52 is given by the completion of extraction of the license plate images by the image memory/plate detection unit 118, whereupon it is influenced to a lesser degree by off time delay indicated as t in FIG. 14(*b*) to (*d*).

For comparison, the photographing of the license plate takes place once or a predetermined number of times in response to the fall in the output of the loop coil 60. In such a configuration, with an assumption of speed of the vehicle 48 at a certain speed, setting must be made for both the positions of the loop coils 60 and the angles of depression of the enforcement cameras 52 so as to ensure preferred photographing of the license plate of the vehicle 48 traveling at the assumed speed. A speed of the vehicle 48 remarkably higher than the assumed speed would result in missing of preferred photographing timing due to the traveling of the vehicle 48 during the delay time Δt. Values of the delay time delta Δt depend on the types of vehicle.

Such inconvenience will disappear by virtue of this embodiment in which the commencement of photographing is given by the fall in the output of the loop coil 60 and the conclusion thereof is given by the completion of the extraction of the license plate images. More specifically, the capture zones 500 of the enforcement cameras 52 are separated from the positions of the loop coils 60 so as to allow for the maximum of the delay time Δt, thereby ensuring accurate photographing of the license plates irrespective of the speeds of the vehicles 48 ranging from 0 to 120 km/hour and irrespective of the capture zones 500 of the enforcement cameras 52 extending four meters in the direction of length of the road.

Further, this embodiment makes use of the results of detection by the loop coils 60, which will be described hereinafter, to regulate the timing at which to commence photographing by the enforcement cameras 52. Thus, regardless of the speeds of the vehicles the license plates can be photographed at appropriate timing.

(5) Principle of Vehicle Detection with Line Scanners

Figure 16:
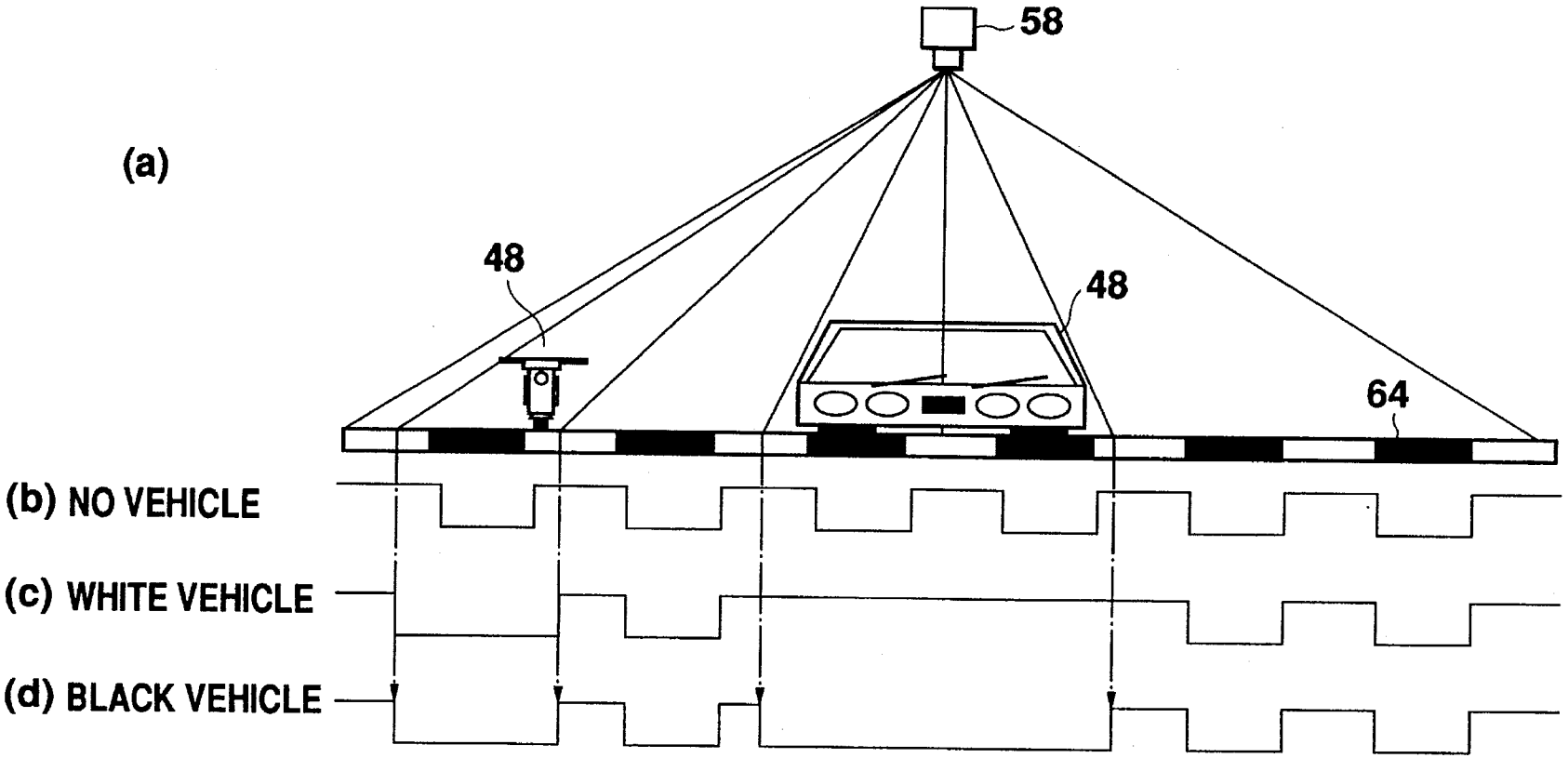
FIG. 16 is a diagram representing a principle for identifying the types of vehicles by use of the line-type vehicle presence detection section, in which (a) shows a positional relationship between a line and vehicles, (b) shows the contents of data derived from a line scanner in the absence of the vehicle on the line, (c) shows the contents of data obtained by the line scanner in the presence of a white vehicle on the line, and (d) shows the contents of data obtained by the line scanner in the presence of a black vehicle on the line.

Description will be given of a principle of vehicle detection using the line scanners 58. Referring to FIG. 16, there are depicted variations in the output of the line scanner 58 caused by the passage of the vehicle 48 over the line 64.

As heretofore explained, the line 64 is photographed by the line scanners 58, and the resultant image signals are read, through conversion into digital data, into the image memories of the line scanner data read sections 104. In accordance with the data, the calibration section 108 controls the line scanner iris control section 110 to attain the data correspondent with the black-and-white pattern constituting the line 64. In the absence of any vehicles over the line 64, such a calibration will result in the data as depicted in FIG. 16(*b*).

In the presence of vehicles 48 on top of the line 64 as shown in FIG. 16(*a*), data are obtained correspondent with colors of the vehicles 48. Assume first that the colors of the vehicles 48 crossing the line 64 are white or other colors presenting reflection analogous to white. If the colors of the vehicle 48 have high reflectivities in this manner, then the line scanners 58 will detect data of these vehicles 48 as the same data as the white pattern. In other words, from the areas corresponding to the vehicles 48, the line scanners 58 will receive luminance levels approximate to the level of white.

On the contrary, assume that the colors of the vehicles 48 crossing the line 64 are black or other colors presenting the reflection analogous to black. If the colors of the vehicles 48 have low reflectivities in this manner, the line scanners 58 will detect data of these vehicles 48 as the same data as the black pattern. In other words the line scanners 58 will receive luminance levels approximate to the level of black from the areas corresponding to the vehicles 48.

Thus, the vehicles 48 in white or other colors analogous thereto would result in data as shown in FIG. 16(*c*) diagram is wrong, whereas the vehicles 48 in black or other colors analogous thereto would result in data as shown in FIG. 16(*d*). More specifically, the data for the "white" vehicles involve a disturbance such that portions that are originally black in the absence of the vehicles 48 result in white, whereas the data for the "black" vehicles involve a disturbance such that portions that are originally white in the absence of the vehicles 48 result in black.

The vehicle detection section 106 detects disturbances involved in the data obtained, and on the basis of the results performs detection of vehicles 48, detection of positions thereof, and judgment of the types of the vehicle. Firstly, the detection of the presence of disturbances in the data will enable the passage of the vehicles 48 to be recognized. Secondly, the positions on the data where disturbances have occurred will enable passage positions of the vehicles 48 to be recognized. Thirdly, the widths of disturbances will allow the identification of the types of vehicles. Fourthly, tracking with time of the occurrence of disturbances will enable the passage of a plurality of vehicles 48 traveling in tandem to be detected individually for each of the vehicles. Fifthly, a plurality of vehicles 48 traveling side by side can be separately detected. The enforcement cameras may receive shutter commands in response to the detection of passage of the vehicles 48 by the vehicle detection section 106.

Accordingly, this embodiment will ensure accurate detection of vehicles 48 by means of the line scanners 58. In addition, iris control (calibration) by the feedback of data along with the use of the black and white pattern as the line 64 will contribute to preferred detection of the vehicles 48 of intermediate color, and to resistance to variations in environment such as sunshine.

Put more clearly, suppose a single white line in place of line 64 for the sake of comparison. In such a configuration, the passage of the vehicles 48 over the white line will be detected by partial depressions in luminance of the signals obtained by the line scanners 58. The depressions in luminance are however caused by not only the bodies of the vehicles 48 but also shades thereof. Moreover, the manner in which the shades appear vary depending on the position of the sun, the latitude, the season, etc. The degree of the depression in luminance also depends on the color of the vehicle 48. It is therefore difficult to ensure accurate detection of the passage of the vehicle irrespective of the execution of calibration. It is also difficult to set a threshold for use in making image signals into binary signals. The same applies to the configuration of a single black line.

For further comparison, suppose a configuration having no line. In such configuration, due to uneven reflectivity of the surface of the road, accurate detection of the passage of the vehicle 48 is difficult to perform irrespective of the execution of calibration.

This embodiment eliminates the above inconveniences by the provision of a pattern of alternate "white" having a high reflectivity and "black" having a low reflectivity. For instance, the reflectivity of the "black" paint is in the order of $10^{-3}$ that of the "white" paint, and this relationship is not influenced by the level of sunshine or other environmental factors. Accordingly, the appropriate execution of the calibration will ensure accurate detection of the vehicle 48 independent of variations in environmental conditions. Thus, irrespective of outdoor use of this embodiment system, which may be subjected to severe environmental conditions, accurate detection of the passage of the vehicle 48 is constantly ensured. Even though the color of the vehicle 48 is an intermediate one, the presence of the vehicle can be detected as the disturbance of either white or black.

As depicted in FIGS. 6 and 7, the number of line scanners 58 to be provided in this embodiment is n+1 for n lanes. The line scanners 58 are each fitted with an wide-angle lens, and visual fields of the adjoining line scanners 58 overlap each other. Accordingly, even in the case of a vehicle (e.g., a motorcycle) having a small height traveling between vehicles (e.g. double-decker buses) of large heights, it is possible to distinctly identify these vehicles. Namely, no dead spots appears. In addition, the use of the wide-angle lens will minimize the number of the line scanners 58 to be used.

(6) Details of Vehicle Detection with Loop Coils

FIGS. 17 to 29 illustrate procedures of vehicle detection processing by use of the loop coils 60, in particular, of vehicle center position judgment processing in the road crossing direction, and FIGS. 30 to 37 depict the flows of these procedures. Implemented by the processing shown in these diagrams is a function to properly separate a plurality of vehicles 48 traveling side by side or to properly separate the plurality of vehicles 48 traveling in tandem with narrow distances therebetween, as well as a function to properly detect passage positions in the width direction of the road. Also implemented is a measure to deal with a wider range of speeds since depending on the speeds of the vehicles 48, the vehicle photography section 114 is capable of controlling the time required up to the commencement of photographing by the enforcement cameras 52 from the point of time of vehicle passage detected by the loop coils 60. Furthermore, the utilization of low sensitivity and high sensitivity outputs of the loop coils 60, as well as the approximation to a quadric curve, ensures accurate execution of judgment of vehicle types and judgment of vehicle center positions.

The vehicle center position judgment processing in this embodiment comprises procedures for judging, upon the entry of a vehicle 48 into the zone of the loop coils 60, what type the vehicle 48 is and where the vehicle center position is (in the direction crossing the road), the processing being generally implemented by following three procedures. In the following description, an i-th loop coil 60 is designated by $L_i$, and singly hatched in the diagrams is a period of time during which only the high sensitivity output of the loop coil is on, while doubly hatched is a period of time during which both the high sensitivity and low sensitivity outputs thereof are on.

i. First Procedure

A first procedure includes a step of temporarily regarding the vehicle 48 which has entered the zone of a loop coil 60 as a motorcycle, and estimating that its vehicle center position lies on this loop coil 60. Entrance of the vehicle 48 into the zone of the loop coil 60 can be recognized by the fact that the high sensitivity output of each loop coil 60 has turned on. That is, in the first procedure, the general control section 72 of the local controller 66 when the high sensitivity output has turned on temporarily estimates that a motorcycle has entered the zone of the loop coil 60 without considering whether the vehicle which has entered the loop coil zone is actually the motorcycle or an automobile. In the following description, the term "motorcycle" refers to a vehicle having a narrow width not allowing outputs of a plurality of loop coils 60 to simultaneously occur, for example, a two-wheeled vehicle. Also, the term "automobile" refers to a vehicle having a wide width allowing outputs of a plurality of loop coils 60 to simultaneously occur, for example, a four-wheeled vehicle.

Figure 17:
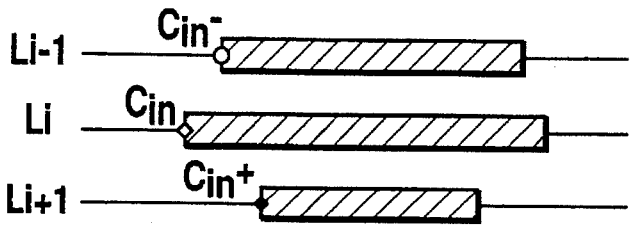
FIG. 17 is a conceptual diagram for explaining a first procedure constituting a vehicle position judgment processing.

For example, as shown in FIG. 17, assume that at substantially the same time or in rapid sequence the (i−1)th loop coil $L_{i-1}$, i-th loop coil $L_i$, and (i+1)th loop coil $L_{i+1}$ have turned on. In this case, it is impossible to identify from only the information shown, whether a single automobile spanning the loop coils $L_{i-1}$, $L_i$ and $L_{i+1}$ has entered the loop coil zones or three motorcycles have separately enter the zones of the loop coils $L_{i-1}$, $L_i$, and $L_{i+1}$. Thus, the general control section 72 temporarily assumes that three motorcycles have individually entered the zones of the loop coils $L_{i-1}$, $L_i$, and $L_{i+1}$ (first procedure).

At the same time, the general control section 72 estimates that vehicle center positions of these imaginary motorcycles lie on positions where the loop coils $L_{i-1}$, $L_i$, and $L_{i+1}$ are embedded. In other words, the general control section 72 estimates that the vehicle center positions of the vehicles 48 which have caused the high sensitivity outputs of the loop coils $L_{i-1}$, $L_i$, and $L_{i+1}$ to turn on will be coincident with positions $C_{in-}$, $C_{in}$, and $C_{in+}$ indicated respectively by a white circle, a white diamond and a black diamond in the diagram.

ii. Second Procedure

A second procedure includes steps of confirming whether or not it was correct that the vehicle was temporarily estimated to be a motorcycle in the first procedure and judging the first estimation is judged to have been incorrect, that the vehicle is an automobile. More specifically, in the case for example, where detection data as shown in FIG. 17 are obtained from each loop coil, then the general control section 72 performs judgment processing for identifying whether a single automobile spanning the loop coils $L_{i-1}$, $L_i$, and $L_{i+1}$ has entered the loop coil zones or three motorcycles have individually entered the zones of the loop coils $L_{i-1}$, $L_i$, and $L_{i+1}$. For this judgment, use is made of the low sensitivity output of each loop coil 60.

Figure 18:
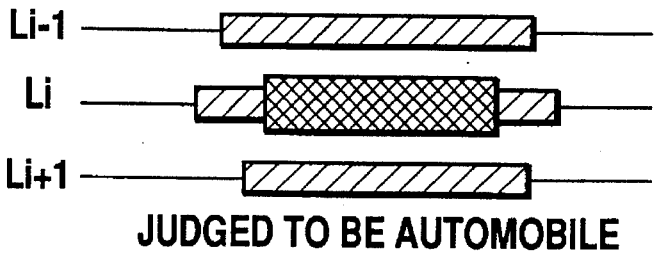
FIG. 18 is a conceptual diagram for explaining a second procedure constituting the vehicle position judgment processing, in particular, showing an example in which the judgment results in an automobile.
Figure 19:
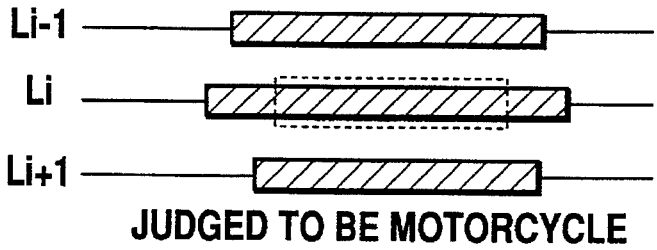
FIG. 19 is a conceptual diagram for explaining a second procedure making up the vehicle position judgment processing, in particular, showing an example in which the judgment results in a motorcycle.

The low sensitivity output of the loop coil 60 is permitted to turn on only when the magnetic mass of the vehicle passing over the loop coil 60 is sufficiently large, but remains off when it is small. Accordingly, in general, if the vehicle passing over the loop coil 60 is an automobile, the low sensitivity output of the loop coil 60 turns on, but remains off if it is a motorcycle. Thus, if the low sensitivity output of the loop coil $L_i$ has turned on as shown in FIG. 18, then the general control section 72 judges that an automobile has passed over the loop coil $L_i$. On the contrary, providing that the high sensitivity output has turned off with the loop coil $L_i$ remaining off as shown in FIG. 19, the general control section 72 judges that the automobile has passed over the loop coil $L_i$.

iii. Third Procedure

Through the execution of the first and second procedures, (1) the positions of the loop coils 60 whose high sensitivity outputs have turned on are estimated to coincide with the vehicle center positions of the vehicles 48 which have entered the zone of the loop coil 60, (2) a judgment is made that an automobile has entered zones of the loop coils 60 whose high sensitivity and low sensitivity outputs have both turned on, and (3) a judgment is made that motorcycles have entered the zones of the loop coils 60 of which high sensitivity outputs have turned on with the low sensitivity outputs remaining off. However, these are insufficient for the judgment of the types of vehicle and vehicle center positions.

First, upon estimation that two loop coils 60 adjacent or in close proximity to each other both have their high sensitivity outputs are both on, suppose that the low sensitivity output of a first loop coil 60 thereof remains off but the low sensitivity output of a second loop coil 60 is on. The first loop coil 60 may have caught the entrance that the same automobile as entered the zone of the second loop coil 60, or otherwise it may have caught the entrance of quite a different vehicle 48 from that automobile. Therefore, for the first loop coil 60, inaccuracy will remain as long as the estimated result in the first procedure is maintained, namely, the estimation result that motorcycle has entered the zone of this loop coil 60.

Second, upon the estimation that three loop coils 60 adjacent or in close proximity to each other all have their high sensitivity outputs on, suppose that the low sensitivity output of at least a first loop coil 60 is on. The vehicle 48 caught by the first loop coil 60 is an automobile (or has at least a high probability of being an automobile) as has been judged by the second procedure. Accordingly, the fact the high sensitivity outputs (as well as the low sensitivity outputs, as the case may be) of the second and third loop coils adjacent or in close proximity to the first loop coil are both on may largely arise from the vehicle 48 caught by the first coil 60. Thus, decision should be made of the vehicle center position caught by the first loop coil 60, in view of not only the position where the first loop coil 60 is embedded but also the positions where the second and third loop coils 60 are embedded. In other words, merely defining the position estimated by the first procedure as the vehicle center position of the vehicle 48 caught by the first loop coil 60 will still allow inaccuracy. In addition, allowance must be made for a possibility that the vehicle which has caused the high sensitivity and low sensitivity outputs of the second and third loop coils 60 to turn on may not coincide with the vehicle 48 caught by the first loop coil 60.

Thus, in order to find a true vehicle center position, the general control section 72 executes a third procedure including the following contents, using the results of the first and second procedures while using quadric curve approximation, etc., if needed.

a) When Judged to be Motorcycle by Second Procedure

Figure 20:
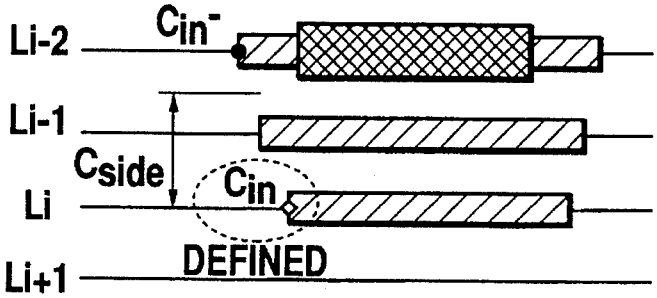
FIGS. 20 to 29 are conceptual diagrams each explaining a third procedure making up the vehicle position judgment processing.
Figure 21:
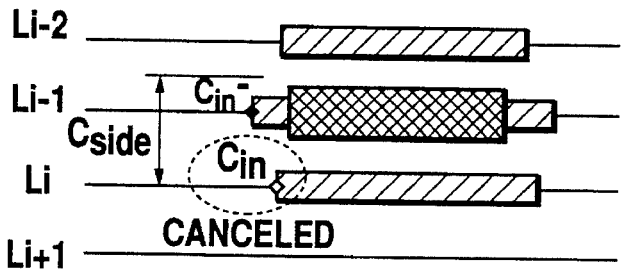

Consideration will be first given to the loop coil 60 whose low sensitivity output has not turned on before its high sensitivity output turns off after been having turned on. For such type of loop coils 60, it may be construed that it has caught the automobile caught by the other loop coils 60 or that it has caught a vehicle 48 (e.g., a motorcycle) which has not been caught by the other loop coils 60. This embodiment rigidly distinguishes both cases by a distance judgment. As depicted in FIGS. 20 and 21, assume that the low sensitivity output of the loop coil $L_i$ has not turned on before its high sensitivity output turns off after having been turned on. In other words, suppose it has not yet been judged that the vehicle 48 lying on the loop coil $L_i$ is an automobile before its high sensitivity output turns off. In this instance, at the time when the high sensitivity output of the loop coil $L_i$ has turned off, the general control section 72 compares a distance between the loop coil $L_i$ and the other loop coil 60 closest to the loop coil $L_{i1}$ among the loop coils 60 for which judgment was made that an automobile has passed thereover in the second procedure with a predetermined reference distance $C_{side}$. With this distance less than the reference distance $C_{side}$, both the loop coils could be assumed to have caught the same vehicle 48 (the same automobile in this case). On the contrary, with this distance exceeding the reference distance $C_{side}$, both the loop coils could be assumed to have individually caught different vehicles 48.

Assume, for example, the reference distance $C_{side}$ is set at a distance 1.5 times the loop coil embedment intervals. As depicted in FIG. 20, suppose that the other loop coil 60 closest to the loop coil $L_i$, among the loop coils 60 for which judgment was made that an automobile has passed thereover in the second procedure is a loop coil $L_{i-2}$ having a distance twice the loop coil embedment intervals relative to the loop coil $L_i$. Since in this case the loop coil $L_i$ is far apart from the loop coil $L_{i-2}$, the vehicle 48 which has passed over the loop coil $L_i$ is supposedly different from the vehicle 48 which has passed over the loop coil $L_{i-2}$. The general control section 72 detects this fact from the comparison of the reference distance $C_{side}$ with the distance between the loop coil $L_i$ and the loop coil $L_{i-2}$. In accordance with this detection, the general control section 72 judges that the vehicle 48 which has passed over the loop coil $L_i$ is distinctly different from the vehicle 48 which has passed over the loop coil $L_{i-2}$ and that the vehicle center position of the vehicle 48 which has passed over the loop coil $L_i$ lies on the loop coil $L_i$ 60 as indicated by a white diamond and $C_{in}$ in the diagram. Since the vehicle 48 which has passed over the loop coil $L_i$ is judged to be a motorcycle in the second procedure, this will define the type and vehicle center position of the vehicle 48 which has passed over the loop coil $L_i$.

As depicted in FIG. 21, suppose that the other loop coil 60 closest to the loop coil $V_i$ among the loop coils 60 for which judgment was made that an automobile has passed thereover in the second procedure is a loop coil $L_{i-1}$ having a distance equal to the loop coil embedment intervals relative to the loop coil $L_i$. Since in this case the loop coil $L_i$ is sufficiently close to the loop coil $L_{i-1}$, the vehicle 48 which has passed over the loop coil $L_i$ is assumed to be the very same as the vehicle 48 which has passed over the loop coil $L_{i-1}$. The general control section 72 detects this fact from the comparison of the reference distance $C_{side}$ with the distance between the loop coil $L_i$ and the loop coil $L_{i-1}$. In accordance with this detection, the general control section 72 judges that the vehicle 48 which has passed over the loop coil $L_i$ is the very same as the vehicle 48 which has passed over the loop coil $L_{i-1}$ and that the vehicle center position of the vehicle 48 which has passed over the loop coil $L_i$ assumedly lies on the loop coil $L_{i-1}$ 60 as indicated by a black diamond and $C_{in-}$ in the diagram, but on the position indicated by a white diamond and $C_{in}$ in the diagram. From this judgment result both the vehicle center position estimation result in the first procedure and the vehicle type judgment result in the second procedure are canceled for the vehicle 48 which has passed over the loop coil $L_i$.

Regarding the vehicle 48 which has passed over the loop coil $L_{i-2}$ in the example of FIG. 20 and the vehicle 48 which has passed over the loop coil $L_{i-1}$ in the example of FIG. 21 the judgment result that "the type of the vehicle is an automobile" obtained by the second procedure is established. However, its vehicle center position remains unestablished due to the necessity of taking into consideration both the manner of outputs of the loop coils 60 adjacent to or in close proximity to the loop coil $L_{i-2}$ or the loop coil $L_{i-1}$ and the possibility that the vehicle 48 may cause the low sensitivity outputs of a plurality of loop coils 60 to simultaneously be on. Processing for definitely deciding this will become apparent from the following description.

b) When Judged to be Automobile by Second Procedure

With regard to the loop coil 60 whose low sensitivity output has turned on before its high sensitivity output has turned off after having been turned on, judgment is made that "the type of the vehicle 48 which has passed thereover is an automobile" by the second procedure. Also, for the other loop coils 60 having distances less than the reference distance $C_{side}$ relative to such a loop coil 60, and whose high sensitivity outputs have turned on, both the vehicle center estimation result in the first procedure and the vehicle type judgment result are canceled by the step a) of the third procedure. Thus, as to the loop coil 60 low sensitivity output has turned on before its high sensitivity output has turned off after having been turned on, there is a need to establish the vehicle center position of the vehicle 48 which has passed thereover, taking into consideration the embedment positions of the other loop coils having distances less than the reference distance $C_{side}$ relative to such a loop coil 60 and whose high sensitivity outputs have turned on.

Figure 22:
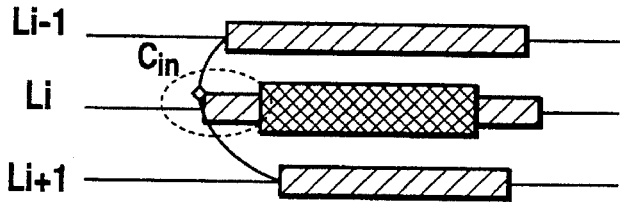

For this reason, at the time when the low sensitivity output has turned off, the general control section 72 corrects the vehicle center position estimated by the first procedure. The correction comprises the step of using quadric curve approximation. This will ensure that the general control section 72 is capable of more accurately finding the vehicle center position of the automobile which is passing over the loop coil 60 whose low sensitivity output has turned on before its high sensitivity output turns off after having been turned on. It is to be appreciated that in definitely determining the vehicle center position by such techniques allowance must be made for the sequence in which the high sensitivity outputs of the loop coils 60 have turned on.

b1) Case in which the high sensitivity output of the loop coil $L_i$ turns on earlier than the high sensitivity outputs of the loop coils $L_{i-1}$ and $L_{1+1}$:

In general, the center of the vehicle 48 has the most magnetic mass distributed therearound. Accordingly, the high sensitivity output of the loop coil 60 whose embedment position is closer to the vehicle center position turns on previous to that of the loop coil whose embedment position is farther from the vehicle center position. For this reason, the high sensitivity output of the loop coil 60 over which a vehicle 48 has passed the type of which type has been judged to be an automobile by the second procedure turns on earlier than the high sensitivity outputs of the loop coils 60 which have caught the same vehicle 48 among the loop coils 60 adjacent to or in proximity thereto. It is therefore typically envisaged that the high sensitivity outputs turn on in the sequence as shown in FIG. 22.

As is clear from this diagram, the high sensitivity output of the loop coil $L_i$ over which a vehicle 48 has passed the type of which has been judged to be an automobile by the second procedure is on previous to the high sensitivity output of the loop coils $L_{i-1}$ and $L_{i+1}$ embedded on both sides of the loop coil $L_i$. In this case, the general control section 72 applies to a quadric curve the time when the outputs of the three loop coils $L_{i-1}$, $L_i$, and $L_{i+1}$ have turned on (quadric curve approximation). The resultant quadric curve represents a distribution of the magnetic mass in the vehicle 48 which is passing over the three loop coils $L_{i-1}$, $L_i$, and $L_{i+1}$. Thus, a peak of the quadric curve (a point where tangential direction of the quadric curve coincides with the road crossing direction, which is designated by a white diamond in the diagram) can be regarded as a position where the most magnetic mass is commonly distributed, that is, a vehicle center position. Then, in accordance with the result of the quadric curve approximation, the general control section 72 corrects the vehicle center position $C_{in}$ estimated by the first procedure. That is, the thus obtained quadric curve peak is employed as an established vehicle center position $C_{in}$ closer to the true value.

A mere application of this quadric curve approximation will be prohibited in the case where both the low sensitivity and high sensitivity outputs have turned off while leaving either or both of the high sensitivity outputs of the loop coils $L_{i-1}$ and $L_{i+1}$ off. To compensate for this, the general control section 72 executes the following processing.

Figure 23:
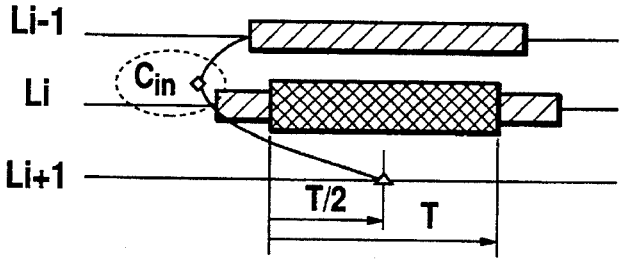

As shown in FIG. 23, assume first that both the low sensitivity and high sensitivity outputs have turned off with either of the high sensitivity outputs of the loop coils $L_{i-1}$ and $L_{i+1}$ (of $L_{i+1}$ in the diagram) remaining off. In this case, among three different times to be originally applied to the quadric curve approximation, it is difficult to obtain the time when the high sensitivity output of the loop coil $L_{i+1}$ has turned on. Therefore, the general control section 62 applies to the quadric curve approximation as an alternative, the time (indicated by white triangle in the diagram) midway between the time when the low sensitivity output of the loop coil $L_i$ has turned on and the time when it has turned off. In other words, a value obtained by adding T/2 (T: the time taken by the time when the low sensitivity output of the loop coil $L_i$ turns off after having turned on) to the time when the low sensitivity output of the loop coil $L_i$ has turned on is used in the quadric curve approximation. The general control section 72 executes the same processing as above in the case of the absence of either of the loop coils $L_{i-1}$ and $L_{i+1}$ (for example, when the loop coil $L_i$ is a loop coil 60 located at the edge of the road).

Figure 24:
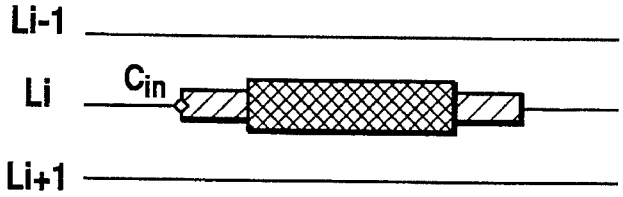

As seen in FIG. 24, assume that the low sensitivity and high sensitivity outputs of the loop coil $L_i$ have turned off with the outputs of the loop coils $L_{i-1}$ and $L_{i+1}$ remaining off. In this case, without performing the quadric curve approximation, the general control section 72 establishes the vehicle center position $C_{in}$ (indicated by white diamond in FIG. 24) estimated by the first procedure intact as the vehicle center position $C_{in}$.

b2) Case in which the high sensitivity output of either the loop coil $L_{i-1}$ or $L_{i+1}$ turns on earlier than or simultaneously with the time when the high sensitivity output of the loop coil $L_i$ turns on:

As stated in the above b1), the high sensitivity output of the loop coil 60 whose embedment position is closer to the vehicle center position generally turns on before that of the loop coil 60 whose embedment position is farther from the vehicle center position. Depending on the shapes or the widths of the vehicles 48, however, the high sensitivity output of the loop coil 60 whose embedment position is farther from the vehicle center position may possibly turn on earlier than or simultaneously with that of the loop coil 60 whose embedment position is closer to the vehicle center position. To deal with such situations, the general control section 72 executes the following processing.

Figure 25:
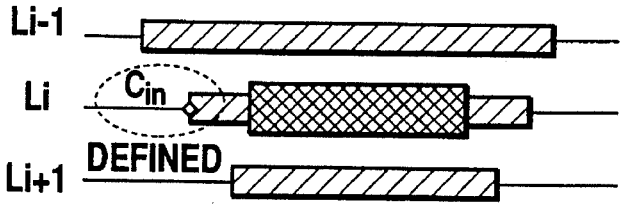
Figure 26:
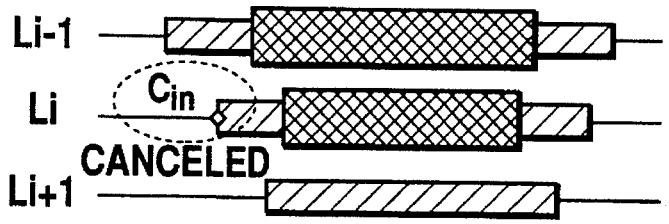

First, as shown in FIGS. 25 and 26, envisage a case where either one of the high sensitivity outputs of the loop coils $L_{i-1}$ and $L_{i+1}$ ($L_{i-1}$ in the diagram) has turned on before the high sensitivity output of the loop coil $L_i$ turns on. More magnetic mass of the vehicle 48 may be assumed to lie on the loop coil $L_i$, provided that the low sensitivity output of the loop coil $L_{i-1}$ is off when the low sensitivity output of the loop coil $L_i$ has turned off (for example, a case where as shown in FIG. 25, the low sensitivity output of the loop coil $L_{i-1}$ remains off till the time when the low sensitivity output of the loop coil $L_i$ turns off after having been turned on, or a case where although not shown, the low sensitivity output of the loop coil $L_{i-1}$ turns on after the low sensitivity output of the loop coil $L_i$ has turned on and the low sensitivity output of the loop coil $L_i$ turns off after the low sensitivity output of the loop coil $L_{i-1}$ has turned off). In consequence, the vehicle center position $C_{in}$ (indicated by a white diamond in the diagram) estimated by the first procedure is definitely determined as the vehicle center position by the general control section 72.

Conversely, more magnetic mass of the vehicle 48 may be assumed to lie on the loop coil $L_{i-1}$, provided that the low sensitivity output of the loop coil $L_{i-1}$ is on when the low sensitivity output of the loop coil $L_i$ has turned off (for example, a case where as shown in FIG. 26, the low sensitivity output of the loop coil $L_i$ turns on after the low sensitivity output of the loop coil $L_{i-1}$ has turned on and furthermore the low sensitivity output of the loop coil $L_{i-1}$ turns off after the low sensitivity output has turned off, or a case where although not shown, the low sensitivity output of the loop coil $L_{i-1}$ turns on after the low sensitivity output of the loop coil $L_i$ has turned on and then the low sensitivity output of the loop coil $L_{i-1}$ turns off after the low sensitivity output of the loop coil $L_i$ has turned off). It is appropriate in this case that the vehicle center position is understood to lie on the loop coil $L_{i-1}$, not on the loop coil $L_i$. Thus, from among the estimation results in the first procedure, the general control section 72 cancels the vehicle center position $C_{in}$ (indicated by a white diamond in the diagram) associated with the loop coil $L_i$, but instead employs the estimation result associated with the loop coil $L_{i-1}$ as the definitely determined vehicle center position.

Figure 27:
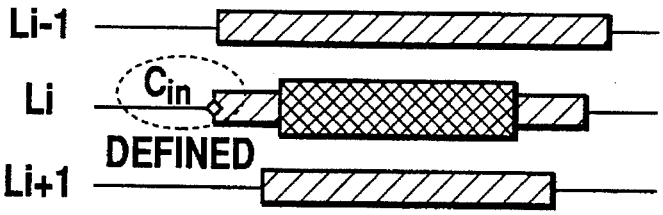

Further, envisage a case where either one of the high sensitivity outputs of the loop coils $L_{i-1}$ and $L_{i+1}$ turns on simultaneously with the high sensitivity output of the loop coil $L_i$. For example, assuming that the high sensitivity outputs of the loop coils $L_i$ and $L_{i-1}$ turns on at the same time, and that the low sensitivity output of the loop coil $L_{i-1}$ remains off at the time when the low sensitivity output of the loop coil $L_i$ has turned off (including a case where as shown in FIG. 27, the low sensitivity output of the loop coil $L_{i-1}$ remains off till the low sensitivity output of the loop coil $L_i$ turns off after having been turned on, or a case although not shown, where the low sensitivity output of the loop coil $L_{i-1}$ turns on after the low sensitivity output of the loop coil $L_i$ has turned on and thereafter the low sensitivity output of the loop coil $L_i$ turns off after the low sensitivity output of the coil $L_{i-1}$ has turned off). In this case, more magnetic mass of the vehicle 48 is assumed to lie on the loop coil $L_i$. Thus, estimated by the first procedure is finally defined by the general control section 72 as the vehicle center position is the vehicle center position $C_{in}$ (indicated by in the diagram).

Figure 28:
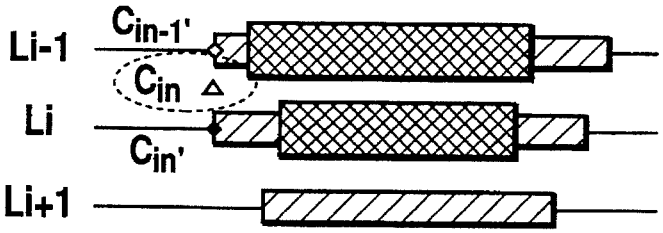

In another example, more magnetic mass may be assumed to lie between the loop coils $L_{i-1}$ and the loop coil $L_i$, providing that the high sensitivity outputs of the loop coils $L_i$ and the loop coil $L_{i-1}$ turn on at the same time, and furthermore that the low sensitivity output of the loop coil $L_{i-1}$ is on at the time when the low sensitivity output of the loop coil $L_i$ has turned off (including a case where as shown in FIG. 28, the low sensitivity output of the loop coil $L_i$ turns on after the low sensitivity output of the loop coil $L_{i-1}$ has turned on and the low sensitivity output of the loop coil $L_{i-1}$ turns off after the low sensitivity output of the loop coil $L_i$ has turned off, or a case where although not shown the low sensitivity output of the loop coil $L_{i-1}$ turns on after the low sensitivity output of the loop coil $L_i$ has turned on and the low sensitivity output of the loop coil $L_{i-1}$ turns off after the low sensitivity output of the loop coil $L_i$ has turned off). Thus, from among the estimation results in the first procedure, the general control section 72 cancels the vehicle center positions $C_{in-1}'$ (indicated by a white diamond in the diagram) and $C_{in}'$ (indicated by a black diamond in the diagram) associated with the loop coils $L_{i-1}$ and $L_i$, respectively, but instead employs their intermediate point $C_{in}$ (indicated by a white triangle) as the definitely determined vehicle center position.

c) When a plurality of Vehicles 48 Pass in Succession over the Same Loop Coil 60

Figure 29:
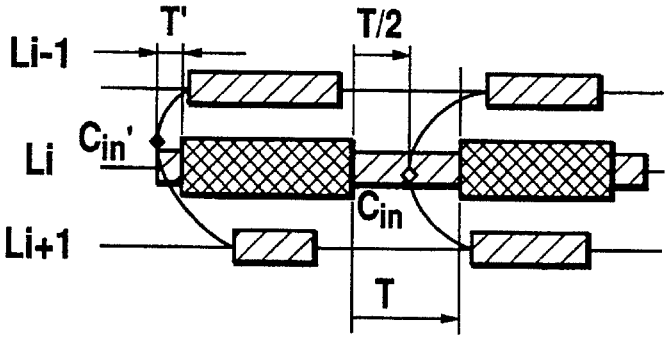

The above procedures are available for the case where the vehicles 48 are traveling with sufficient distances between them. In fact, however, the vehicles may not have sufficient distances to be followed by the loop coils 60. In such situations, a mere application of the above procedures may induce an erroneous recognition, such as a plurality of vehicles 48 being mistaken for a single vehicle 48. For example, in a case where plurality of vehicles 48 with insufficient distances thrumming pass over the loop coil $L_i$ in succession, as shown in FIG. 29, after the high sensitivity output and low sensitivity output of the loop coil $L_i$ have been turned on by the vehicle 48 which has earlier passed thereover, the low sensitivity output may possibly turn on as a result of the subsequent vehicle 48 while leaving that high sensitivity output on, because of the failure of the loop coil 60 to follow the repetitive presence of the vehicles 48. It is difficult in this case to separate the plurality of vehicles 48 using only the temporal relationships between the on/off timing of the high sensitivity output and the on/off timing of the low sensitivity output. To cope with such situations, the general control section 72 executes the following processing.

In the case where after both the high sensitivity output and the low sensitivity output have turned on, the low sensitivity output has turned off leaving that high sensitivity output on and then the low sensitivity output has turned on, the general control section 72 compares the time lapse between the low sensitivity output turning on for second time, while the high sensitivity output on is still on, and the low sensitively output turning off, with the time T' lapse between the low sensitivity output turning on for the first time, and after the high sensitivity output initially turning on.

The comparison results in $T>W_t*T'$, the general control section 72 assumes that a couple of vehicles 48 have passed over the loop coil $_i$ in succession and that the distance therebetween was too short to follow using the output of the loop coil $L_i$. In this case, the general control section 72 assumes that after a lapse of T/2 after the low sensitivity output has turned off, the preceding vehicle 48 has passed over the loop coil $L_i$ and that at the same time the following vehicle 48 has entered the zone of the loop oil $L_i$. The vehicle center position of each of the vehicles 48 is definitely determined by the principles described hereinabove. Conversely, with $T<W_t*T'$, the general control section 72 assumes that a single vehicle 48 has caused an intermittent turning on of the low sensitivity output. This allows for the fact that with large-sized vehicles such as trucks, the low sensitivity output may turn on twice with an off state therebetween, first by the front wheel axle and then by the rear wheel axle.

It is to be noted that in the case of successive passage of three or more vehicles 48, T/2 is used as T' associated with the second or later vehicles. $W_t$ is a value in the order of 2.

iv. Flow of Processing

The first to third procedures described hereinabove can be specifically implemented by the following processing flow.

Figure 30:
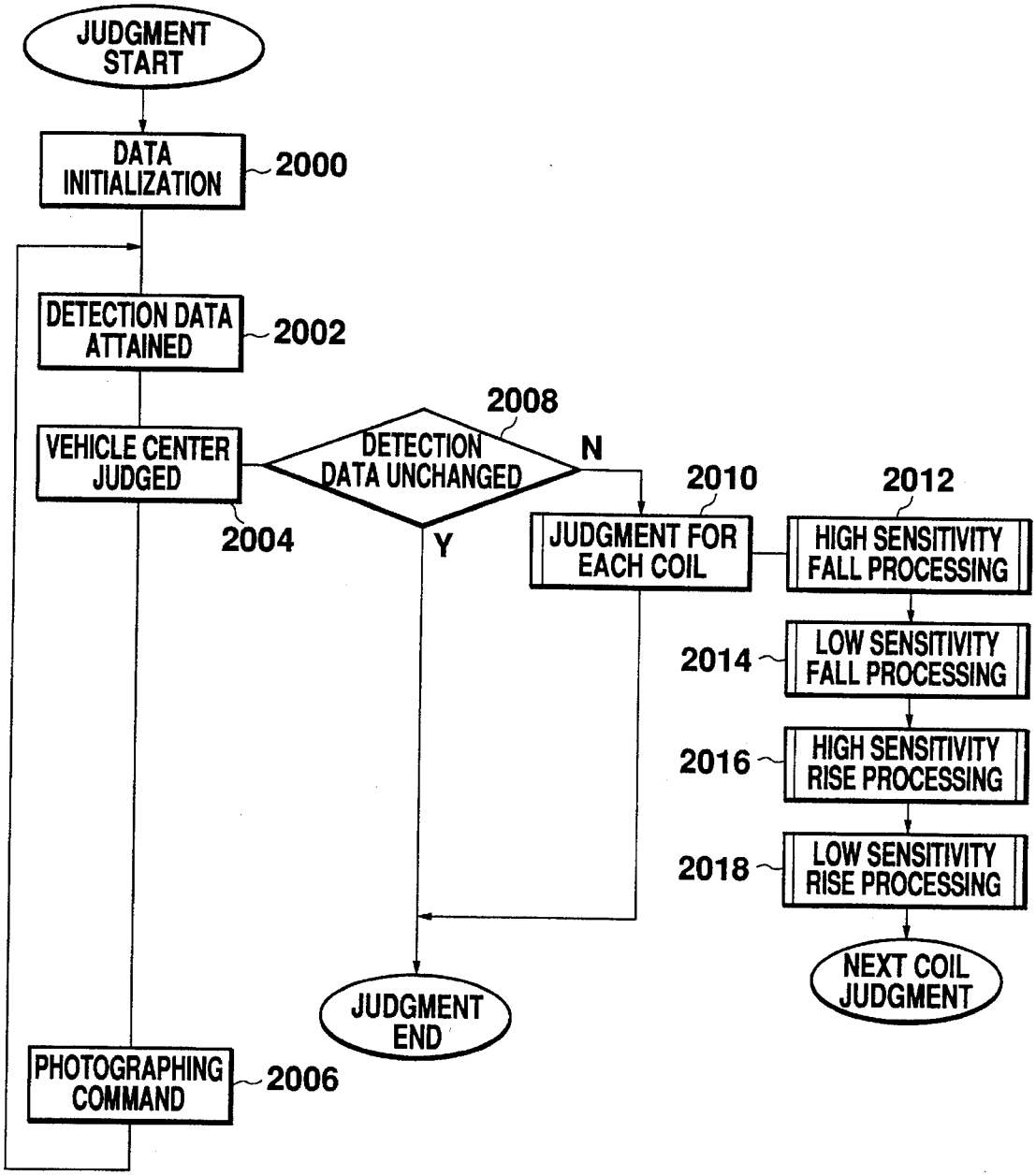
FIG. 30 is a flowchart depicting an overall flow of vehicle center position judgment processing.

Referring to FIG. 30 there is depicted an entire flow pertaining to the first to third procedures among the processing flows of the general control section 72. As shown, in response to energization, etc., the general control section 72 first executes predetermined data initialization processing (2000), and receives detection data from the loop coils 60 in the form of high sensitivity outputs or low sensitivity outputs (2002). In accordance with the thus attained detection data, the general control section 72 carries out the vehicle center position judgment by use of the above first to third procedures, and based on the results sets the contents of a command (a photographing command) as to which enforcement camera 52 is to be used and on how to photograph with the selected camera (2004). The general control section 72 imparts the thus set photographing command to the vehicle photography section 114, and in conformity with this command and under the control of the vehicle photography section 114 the enforcement camera 52 photographs the license plate, etc. (2006).

The vehicle center position judgment by use of the above first to third procedures need not be executed when there is no change in the detection data attained in the step 2002. That is, the above first to third procedures all utilize a fact that the high sensitivity or the low sensitivity output has turned on (rise) or turned off (fall), and hence the general control section 72 completes the step 2004 without setting any photographing commands as long as there is no change in the detection data attained in the step 2002 (2008).

On the contrary, when there is any change in the detection data attained in the step 2002, the general control section 72 executes for each of the loop coils 60 the processing utilizing the on/off timing of its high sensitivity and low sensitivity outputs (2010). In FIG. 30, represented as a high sensitivity fall processing is processing which is triggered when the high sensitivity output of the loop coil 60 has turned off (2012), represented as a low sensitivity fall processing is processing which is triggered when the low sensitivity output has turned off (2014), represented as a high sensitivity rise processing is processing which is triggered when the high sensitivity output has turned on (2016), and represented as a low sensitivity rise processing is processing which is triggered when the low sensitivity output has turned on (2018).

Figure 33:
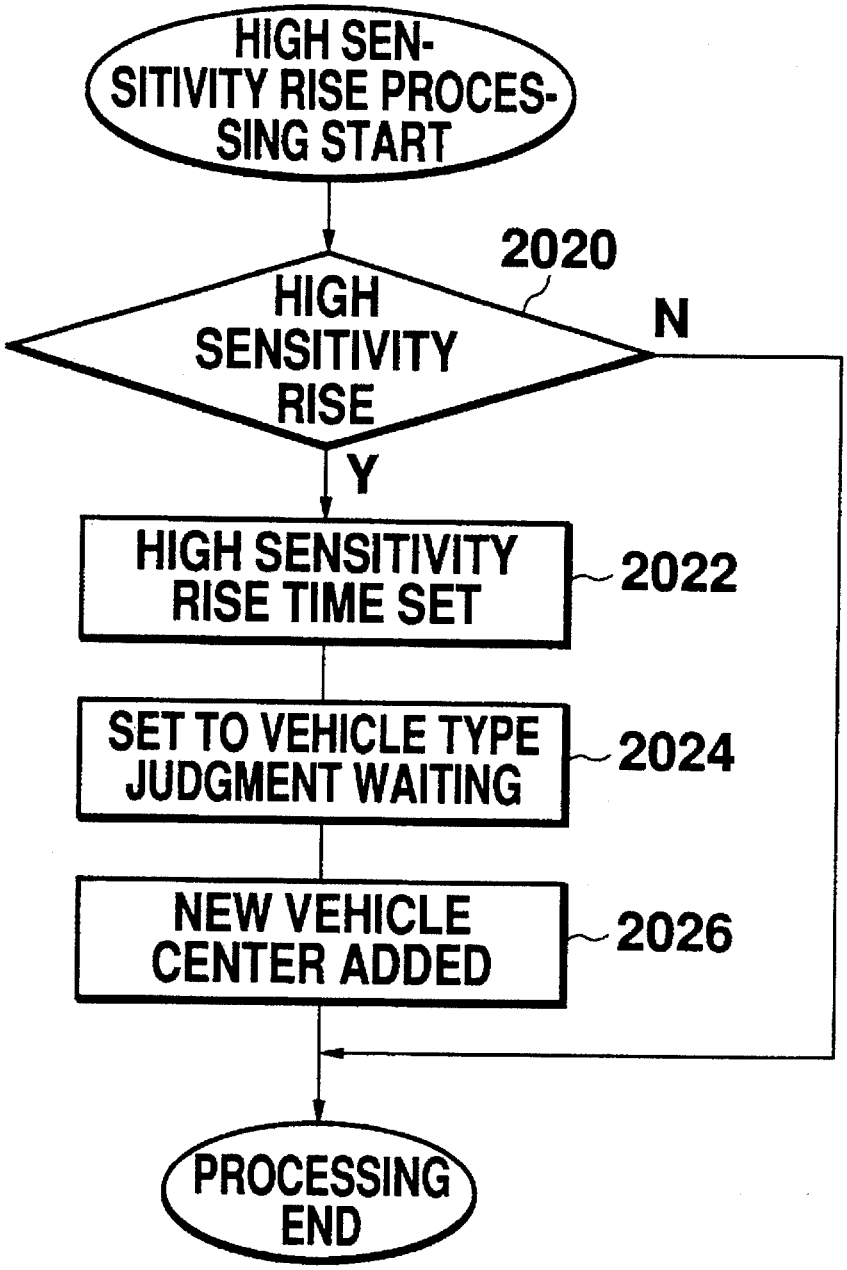
FIG. 33 is a flowchart depicting a flow of high sensitivity rise processing in the vehicle center position judgment processing.

FIGS. 31 to 34 described below depict the contents of these high sensitivity fall processing, low sensitivity fall processing, high sensitivity rise processing, and low sensitivity rise processing. To facilitate the understanding, flows shown in FIGS. 31 to 34 will be explained in accordance with the variations in the output of the loop coil 60.

a) Loop Coil $L_i$ where High Sensitivity Output Turns On and then Turns Off, while its Low Sensitivity Output Remains Off First, assume that the high sensitivity output of the loop coil $L_i$ has turned on at a certain point of time. Then, the high sensitivity fall processing shown in FIG. 33 (2016, 2020) is executed. In FIG. 33, the general control section 72 first stores the time when the high sensitivity output of the loop coil $L_i$ has turned on (2022). Thereupon, the general control section 72 is temporarily "waiting for judgment" of the type of vehicle 48 which has entered the zone of the loop coil $L_i$ (2024), and estimates and stores of the loop coil $L_i$ (2026) as the vehicle center position the embedment position.

Figure 31:
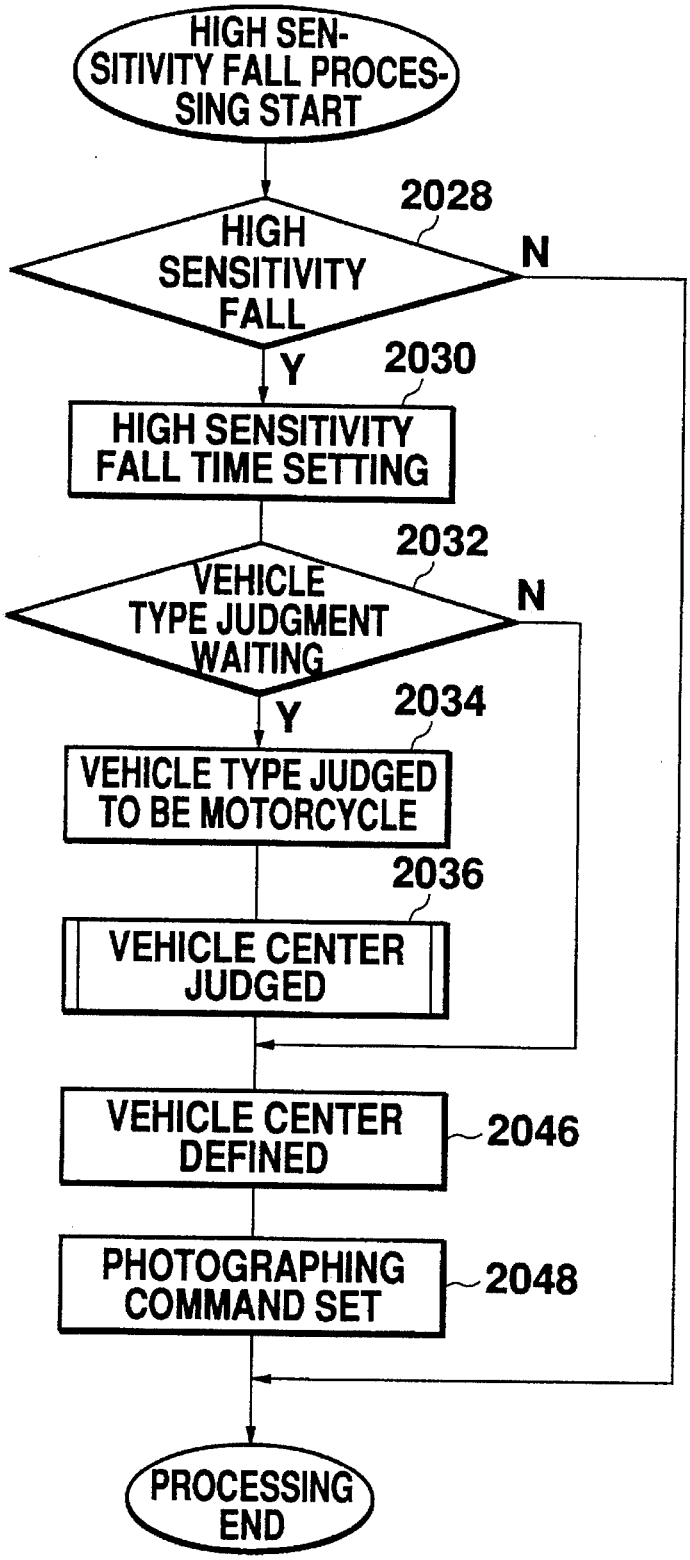
FIG. 31 is a flowchart depicting a flow of high sensitivity fall processing in the vehicle center position judgment processing.

Assume that thereafter the high sensitivity output of the loop coil $L_i$ has turned off with its low sensitivity output remaining off. Then, the high sensitivity fall processing as shown in FIG. 31 (2012, 2028) is executed. In FIG. 31, the general control section 72 first stores the time when the high sensitivity output of the loop coil $L_i$ has turned off (2030). Thereupon, the general control section 72 "waits for judgment" of the type of the vehicle is "waiting for judgment" or not (2030). Since it is "waiting for judgment" at this point, the action of the general control section 72 advances from the step 2032 to the step 2034. It is judged in the step 2034 that the type of the vehicle is a motorcycle. In this manner, the first procedure can be implemented.

Figure 35:
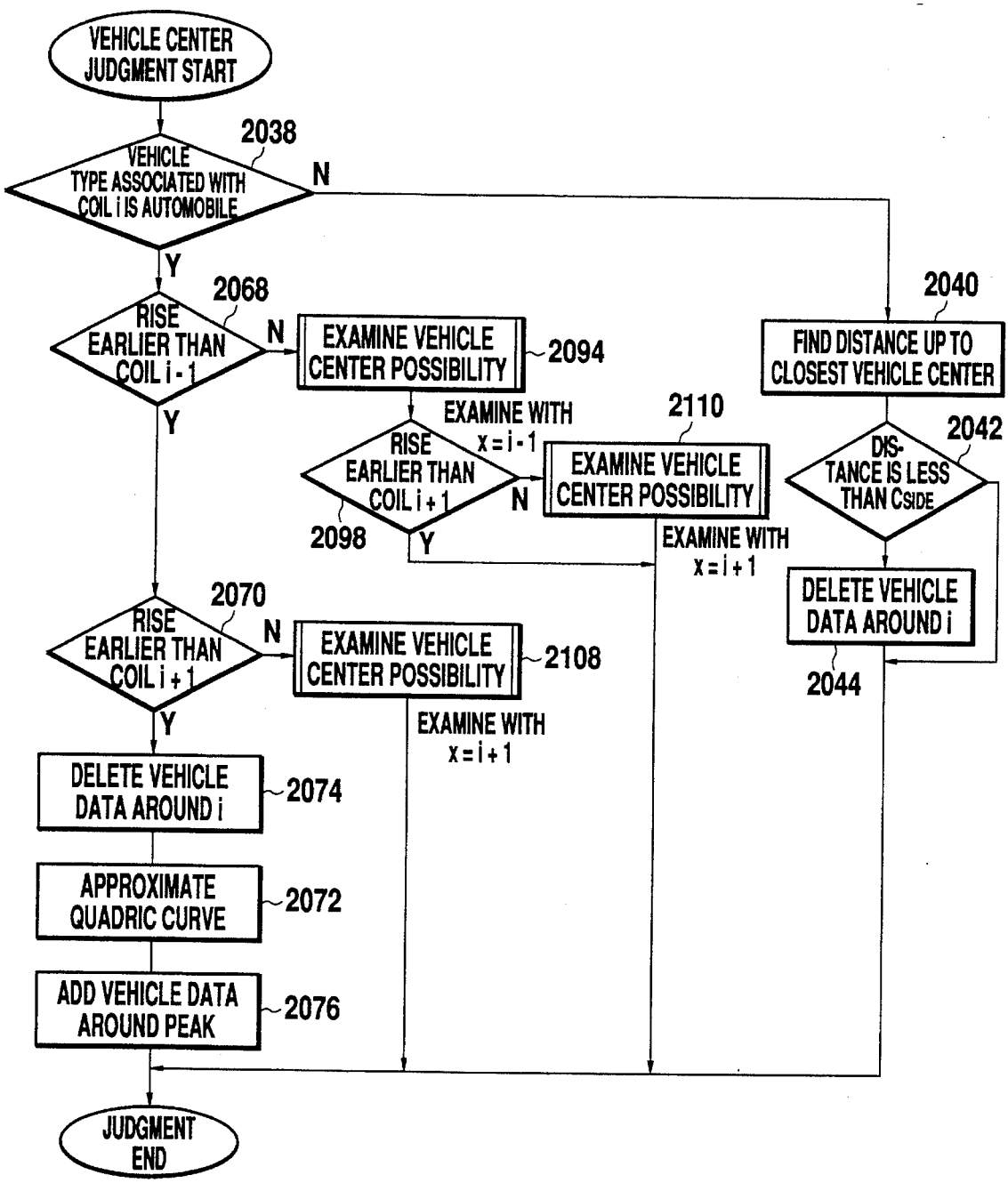
FIG. 35 is a flowchart representing a flow of vehicle center judgment processing in the vehicle center position judgment processing.

After the execution of the step 2034, the flow shown in FIG. 35 (2036) is executed. In the flow shown in FIG. 35, it is first judged whether or not the vehicle 48 which has entered the zone of the loop coil $L_i$ has been judged to be an automobile (2038). Since it has been judged at this point to be "a motorcycle" in the preceding step 2034, the action of the general control section 72 advances from the step 2038 to step 2040. In the step 2040 a distance between the loop coil $L_i$ and the vehicle center of the vehicle closest to that loop coil $L_i$ is found. The vehicle center used here refers to the vehicle center position of the vehicle 48 among the vehicles 48 whose vehicle center positions have been hitherto stored whose type has been judged to be an automobile. Provided that the thus found distance is less than the reference distance $C_{side}$ (2042), then the general control section 72 assumes that "the vehicle 48 having the above vehicle center as its vehicle center is the very same as the vehicle 48 which has passed over the loop coil $P_i$. Thus, the vehicle center positions stored in relation to the loop coil $L_i$ in the step 2026, and the vehicle type judgment results obtained in the step 2034 (2044) are deleted from the storage data. Providing that the calculated distance exceeds the reference distance $C_{side}$, then the general control section 72 omits the step 2044. The procedure exemplarily shown in FIGS. 20 and 21 is implemented in this manner.

After the execution of the step 2042 (and 2044), the action returns to the flow shown in FIG. 31 to execute the processing for definitely determining the vehicle center positions (2046). More specifically, the above automobile center (when it is obtained in step 2042 the judgment result that it is less than the reference distance $C_{side}$) or the vehicle center position stored in relation to the loop coil $L_i$ in step 2026 (when it is obtained in step 2042 the judgment result that it exceeds the reference distance $C_{side}$ is definitely determined as the vehicle center position of the vehicle 48 which has entered the zone of the loop coil $L_i$). Afterwards, in accordance with the thus established vehicle center position the general control section 72 sets the contents of the photographing command to be imparted to the vehicle photography section 114 in the step 2006 (2048). Namely, the general control section 72 specifies a single or a plurality of enforcement cameras 52, so as to be able to photograph the license plate of the vehicle 48 having the established vehicle center position as its vehicle center position, and if possible, generates a command for controlling the depression thereof.

b) Loop Coil $L_i$ whose High Sensitivity Output Turns On and whose Low Sensitivity Output thereafter Turns On/Off Only One Time Before its High Sensitivity Output Turns Off Consideration will now be given to a case where the high sensitivity output of the loop coil $L_1$ turns on and thereafter its low sensitivity output turns on and off only one time before the high sensitivity output turns off. In this case, at the time when the high sensitivity output turns on, the high sensitivity rise processing is executed (2016, 2020). Thus, the type of the vehicle is set to "waiting for judgment" (2024), and the position at which the loop coil $L_i$ is embedded (2026) is stored as a temporary vehicle center position. Thereafter, when the low sensitivity output turns on, the low sensitivity rise processing is executed (2018).

Figure 34:
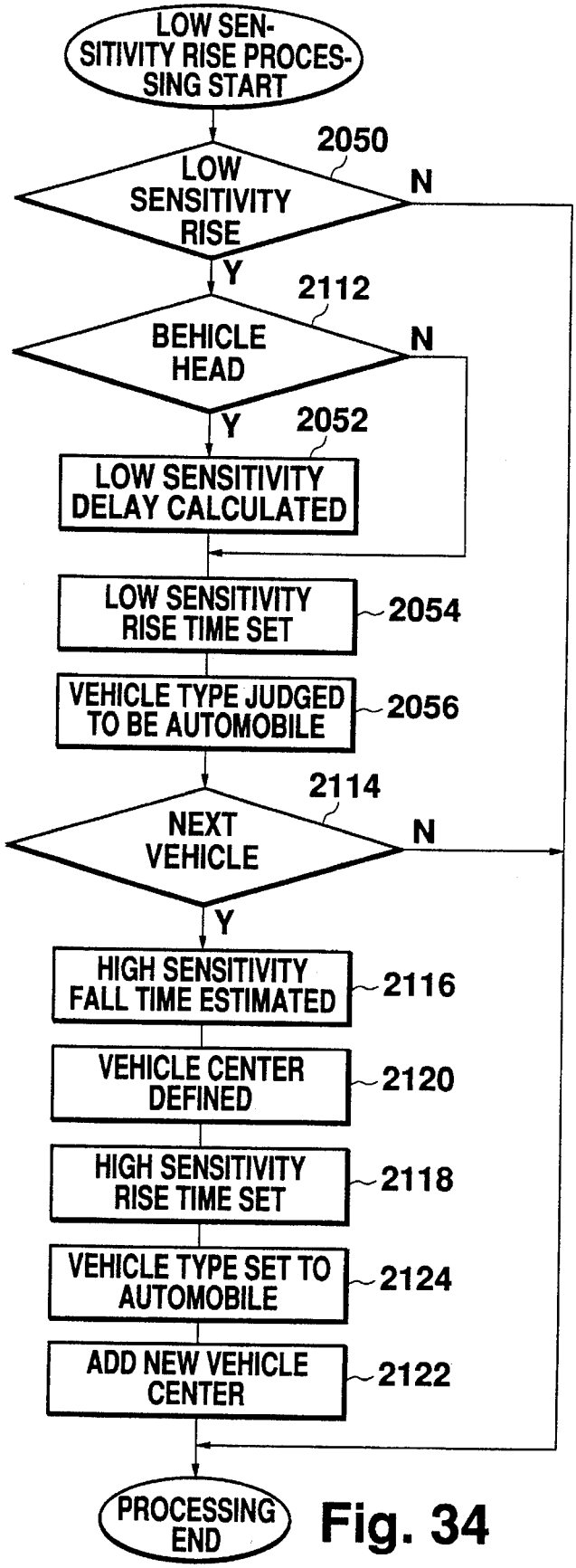
FIG. 34 is a flowchart depicting a flow of low sensitivity rise processing in the vehicle center position judgment processing.

At the time when the low sensitivity output of the loop coil $L_i$ turns on (2018, 2050), the low sensitivity delay time as shown in FIG. 34, i.e., time T' taken for the low sensitivity output to turn on after the high sensitivity output has turned on (2052, see FIG. 29) is calculated in principle. Afterwards, the general control section 72 stores the time when the low sensitivity output has turned on (2054), judges that the vehicle 48 which has entered the zone of the loop coil $L_i$ is an automobile (2056), and in principle returns to the flow of FIG. 30. The second procedure exemplarily shown in FIG. 18, etc is implemented in this manner.

Figure 32:
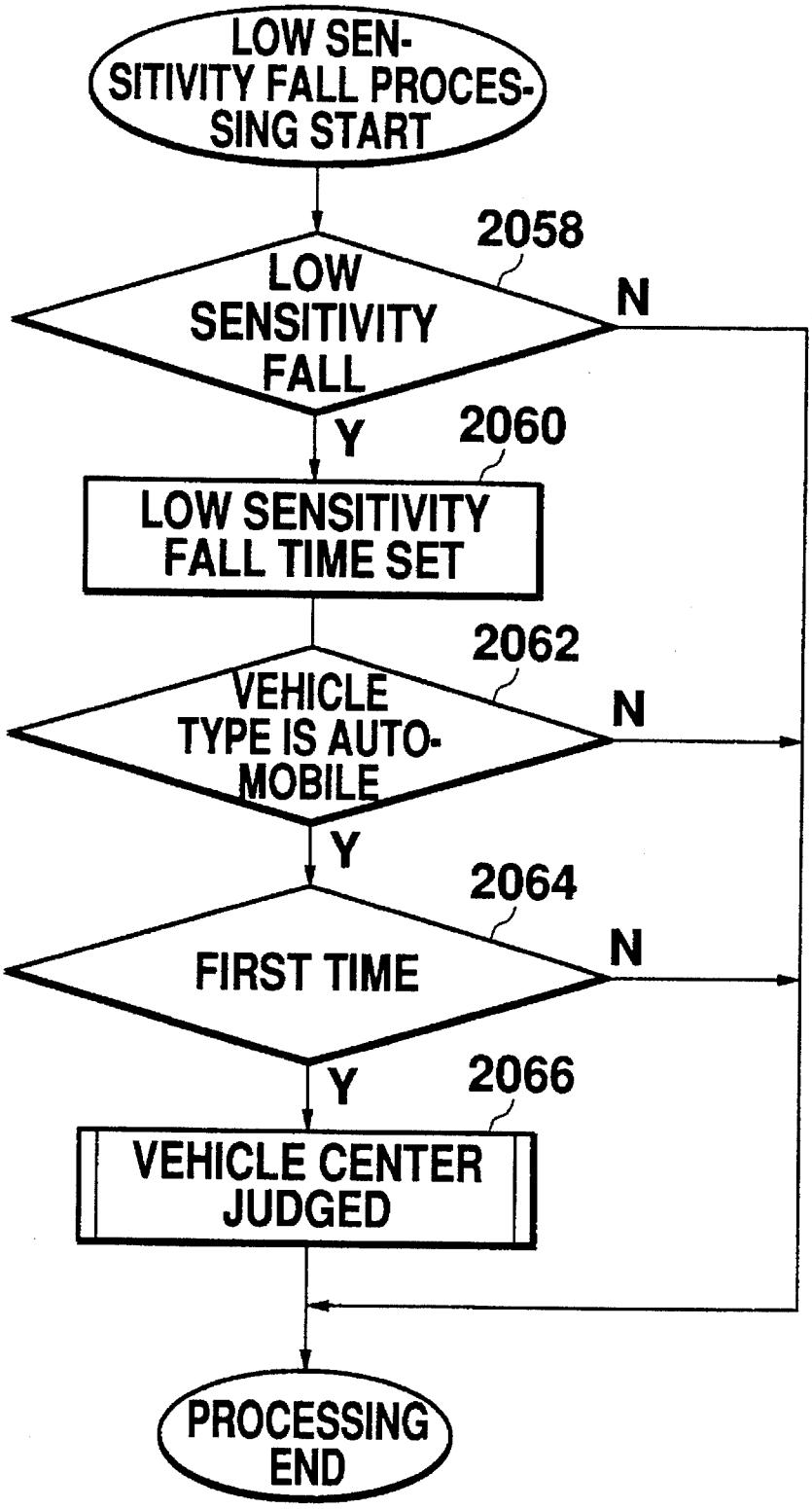
FIG. 32 is a flowchart depicting a flow of low sensitivity fall processing in the vehicle center position judgment processing.

Thereafter, when the low sensitivity output of the loop coil $L_i$ turns off (2014, 2058), the time is stored as shown in FIG. 32 (2060), and it is then judged whether or not the type of the vehicle has been judged to be an automobile (2062). Since it has been judged to be an automobile in the preceding step 2056, the action of the general control section 72 advances to step 2064. It is judged in step 2064 whether or not this low sensitivity fall is the first fall after the high sensitivity rise. Since here an example where the low sensitivity turns on and off only once after the high sensitivity output has turned on is considered, this low sensitivity fall is judged, in step 2064, to be the first fall after the high sensitivity rise. With such result of judgment, step 2066 is executed, whereupon the action of the general control section 72 advances to the flow shown in FIG. 35.

Since it has been Judged to be an automobile in the preceding step 2056, the action of the general control section 72 advances from step 2038 shown in FIG. 35 to the steps 2068 and 2070. In step 2068 is judged whether the high sensitivity output of the loop coil $L_i$ has turned on earlier than that of the loop coil $L_{i-1}$, and in the step 2070 it is judged whether or not the high sensitivity output of the loop coil $L_i$ has turned on earlier than that of the loop coil $L_{i+1}$.

b1) Case in which the high sensitivity output of the loop coil $L_i$ turns on earlier than the high sensitivity outputs of the loop coils $L_{i-1}$ and $L_{i+1}$;

The situation will be assumed to be as shown in any one of FIGS. 22 to 24 in the case where the high sensitivity output of the loop coil $L_i$ has been judged to have turned on earlier than the high sensitivity outputs of the loop coils $L_{i-1}$ and $L_{i+1}$. For this reason, the general control section 72 executes a quadric curve approximation depicted in FIG. 37 (2072), deletes data stored as the vehicle center position in step 2026 (2074), and stores a quadric curve peak found by the quadric curve approximation as the vehicle center position of the vehicle 48 which has entered the zone of the loop coil $L_i$ (2076).

Figure 37:
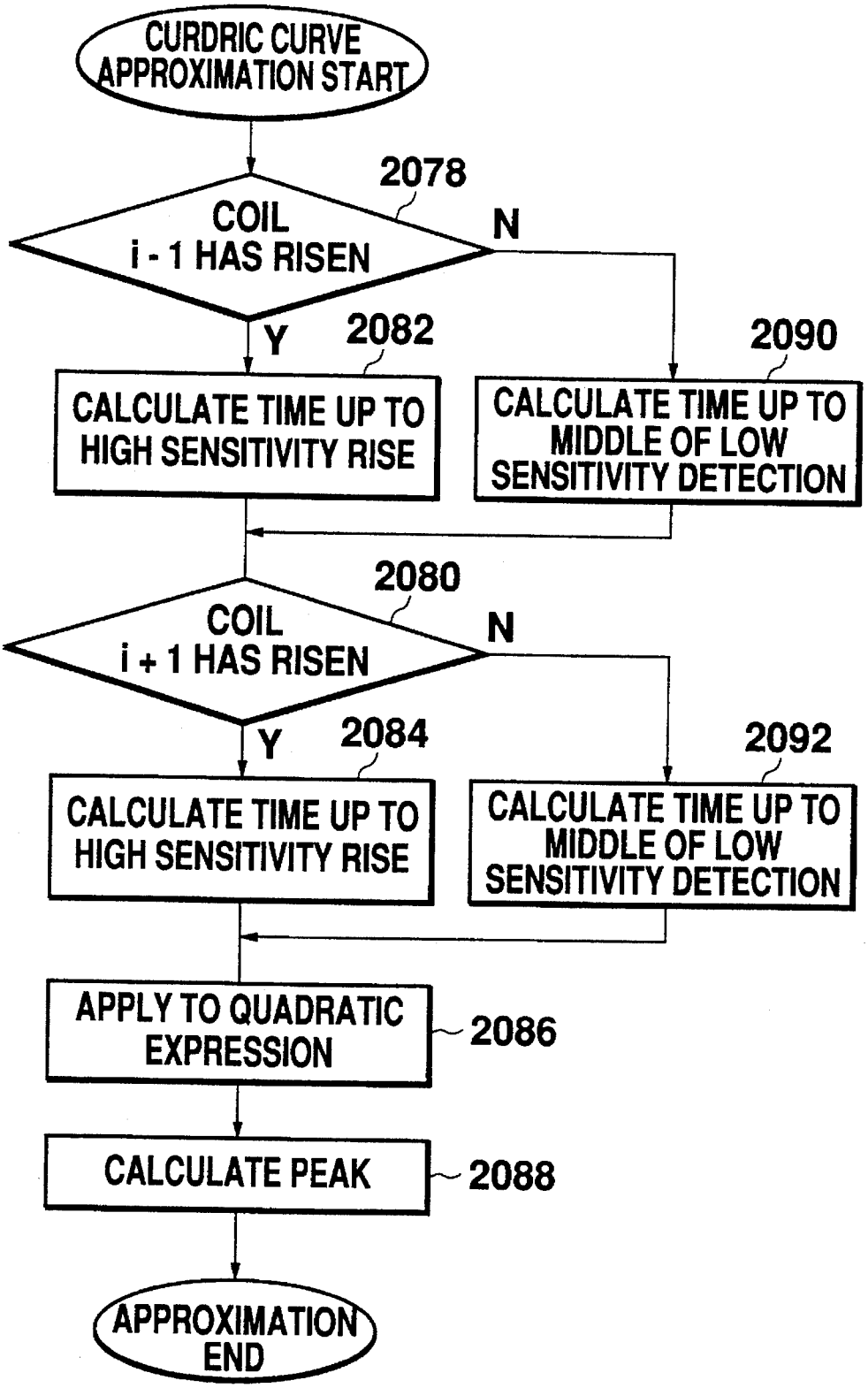
FIG. 37 is a flowchart representing a flow of quadric curve approximation processing in the vehicle center position judgment processing.

In the flow depicted in FIG. 37, the quadric curve approximation is implemented as follows. It is judged in this flow whether or not the high sensitivity outputs of the loop coils $L_{i-1}$ and $L_{i+1}$ are on (2078, 2080). In the case where the high sensitivity outputs of the loop coils $L_{i-1}$ and $L_{i+1}$ both turn on after the turning on of the high sensitivity output of the loop coil $L_i$ (see FIG. 22), the time lapse from the high sensitivity outputs of the loop coils $L_{i-1}$ and $L_{i+1}$ turning on after the high sensitivity output of the loop coil $L_i$ has turned on (2082, 2084) is respectively calculated. Together with the time (=0) when the high sensitivity output of the loop coil $_i$ has turned on, the resultant times are applied to a quadratic expression (2086), and then a peak of the quadratic expression is found (2088).

In the case where after the high sensitivity output of the loop coil $L_i$ has turned on, only one of the high sensitivity outputs of the loop coils $L_{i-1}$ and $L_{i+1}$ turns on with the other remaining off (including the case of absence of the other loop coil in question), half of the time lapse from the low sensitivity output of the loop coil $L_i$ turns off after its turning on (2090, 2092), and the result is applied to the quadratic expression. In consequence, it is possible to cope with the situations depicted in FIGS. 23 and 24.

b2) Case in which the high sensitivity output of the loop coil $L_i$ turns on later than or simultaneously with that of the loop coil $L_{i-1}$:

The situation will be assumed to be as shown in any one of FIGS. 25 to 28 when the high sensitivity output of the loop coil $L_i$ has been judged to have turned on later than or simultaneously with that of the loop coil $L_{i-1}$ in step 2068. For this reason, the general control section 72 evaluates whether or not the vehicle center position stored in connection with the loop coil $L_i$ in the step 2026 can be treated as a vehicle center position of the vehicle 48 which has entered the zone of the loop coil $L_i$ (possibility examination of the vehicle center; 2094).

Figure 36:
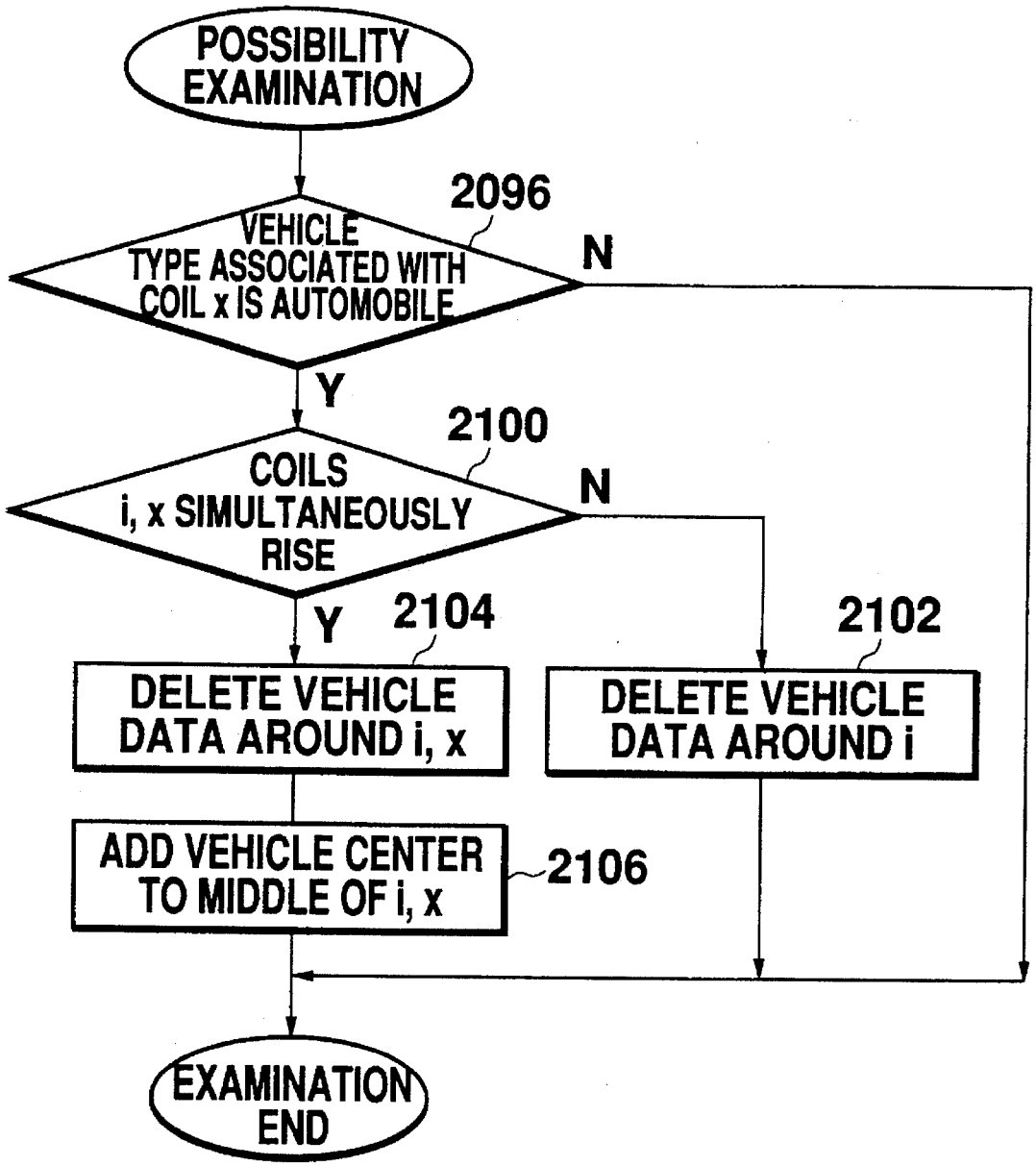
FIG. 36 is a flowchart representing a flow of vehicle center possibility examination processing in the vehicle center position judgment processing.

The processing of step 2094 is implemented by invoking the flow depicted in FIG. 36 with the setting of x=i−1. In the shown flow, it is first judged whether a judgment result that the type of the vehicle associated with the loop coil $L_x$ ($L_{i-1}$ in this case) is an automobile (2096) has already been obtained. If it is judged that the judgment result that the type of the vehicle associated with the loop coil $L_x$ is an automobile has not yet been obtained, then the situation can be regarded as one shown in FIG. 25 or 27. Thereupon, the action of the general control section 72 immediately advances to the step 2098 of FIG. 35. It is judged in the step 2098 whether or not the high sensitivity output of the loop coil $L_i$ has turned on earlier than the high sensitivity output of the loop coil $L_{i+1}$ does. If it is judged to have turned on earlier, the general control section assumes that "the vehicle center position stored in relation to the loop coil $L_i$ in the step 2026 can be treated as the vehicle center of the vehicle 48 which has entered the zone of the loop coil $L_i$", and brings the low sensitivity fall processing to a termination. As a result of this, it is possible to deal with the situations shown in FIGS. 25 and 27.

If it is judged, in step 2096 of FIG. 36, that the judgment result that the type of the vehicle associated with the loop coil $L_x$ is an automobile has been obtained, the situation can be regarded as one shown in FIG. 26 or 28. Thereupon, the general control section 72 judges whether or not the high sensitivity output of the loop coil $L_i$ has turned on simultaneously with the high sensitivity output of the loop coil $L_x$ (i.e., $L_{i-1}$) (2100).

If judged to be not simultaneous, it is conceivable that the high sensitivity output of the loop coil $L_i$ has turned on later than the high sensitivity output of the loop coil $L_x$ (see FIG. 26). Thereupon, the general control section 72 assumes that "the vehicle center position stored in connection with the loop coil $L_i$ in step 2026 is not to be treated as the vehicle center position of the vehicle 48 which has entered the zone of the loop coil $L_i$", and deletes the vehicle center position stored in relation to the loop coil $L_i$ in the step 2026 from the storage data (step 2102).

Conversely, if judged to have turned on simultaneously (see FIG. 28), then the general control section 72 assumes that "the vehicle center position stored in connection with the loop coils $L_i$ and $L_x$ in step 2026 is not to be treated as a vehicle center position of the vehicle 48 which has entered the zones of the loop coils $L_i$ and $L_x$", and deletes the vehicle center position stored with respect to the loop coils $L_i$ and $L_x$ in step 2026 from the storage data (step 2104). After the execution of step 2104, the general control section 72 stores a mid-position between the positions in which the loop coils $L_i$ and $L_x$ are separately embedded, as a vehicle center position of the vehicle 48 which has entered the zones of the loop coils $L_i$ and $L_x$ (step 2106). After the execution of step 2102 or 2106, the action of the general control section 72 advances to step 2098.

When in step 2070 or 2098 it is judged that the high sensitivity output of the loop coil $L_i$ has turned on later than or simultaneously with the high sensitivity output of the loop coil $L_{i+1}$, the general control section 72 invokes the flow shown in FIG. 36 with the setting of x=i+1. In the case where it has already been judged that the vehicle 48 which has entered the zone of the loop coil $L_{i+1}$ is an automobile, the general control section 72 assumes that "the vehicle center position stored in relation to the loop coil $L_i$ in step 2026 can be treated as the vehicle center position of the vehicle 48 which has entered the zone of the loop coil $L_i$", and terminates the low sensitivity fall processing (2096). In the case where it has not yet been judged that the vehicle 48 which has entered the loop coil $L_{i+1}$ is an automobile, the general control section 72 judges whether the high sensitivity output of the loop coil $L_i$ has turned on later than the high sensitivity output of the loop coil $L_{i+1}$ or the high sensitivity output of the loop coil $L_i$ has turned on simultaneously with the high sensitivity output of the loop coil $L_{i+1}$ (2100). If judged to be not simultaneous, the general control section 72 assumes that "the vehicle center position stored in relation to the loop coil $L_i$ in step 2026 is not to be treated as a vehicle center position of the vehicle 48 which has entered the zone of the loop coil $L_i$", and deletes the vehicle center position stored in relation to the loop coil $L_i$ in step 2026 from the storage data (step 2102). Conversely, if judged to be simultaneous, the general control section 72 assumes "the vehicle center position stored in relation to the loop coils $L_i$ and $L_x$ in step 2026 is not to be treated as the vehicle center position of the vehicle 48 which has entered the zones of the loop coils $L_i$ and $L_x2$", and deletes from the storage data the vehicle center position stored in relation to the loop coils $L_i$ and $L_x$ in step 2026, and stores a mid-position between the positions where the loop coils $L_i$ and $L_x$ are separately embedded, as the vehicle center position of the vehicle 48 which has entered the zones of the loop coils $L_i$ and $L_x$ (2106). After the execution of step 2102 or 2106, the action of the general control section 72 advances to the step 2098.

c) Loop Coil $L_i$ whose High Sensitivity Output Turns On and whose Low Sensitivity Output thereafter Turns On/Off a Plurality of Times Before its High Sensitivity Output Turns Off Consideration will be given of a case where the high sensitivity output of the loop coil $L_i$ turns on and thereafter the low sensitivity output thereof turns on and off a plurality of times before the high sensitivity output turns off. In this case, similar to the action as stated in b) the action is taken from the time when the high sensitivity output has turned on, through the first turn-on of the low sensitivity output, up to the time when the low sensitivity output turns off for the first time.

At a point in time when the low sensitivity output of the loop coil $L_1$ turns on and off once and thereafter turns on (2018, 2050) again, the step 2052 shown in FIG. 34 may be omitted. More specifically, the current "turn-on of the low sensitivity output" is assumed to "have been caused by the second vehicle out of a plurality of vehicles 48 which have entered the zones of the loop coils without keeping sufficient distances therebetween" or to "have been caused by a single vehicle 48 having two or more on-durations of the low sensitivity output such as a truck". Hence, in any case, there is no need to find the low sensitivity delay time T' depicted in FIG. 29. For this reason, it is judged in the flow of FIG. 34 that whether or not the current "turn-on of the low sensitivity output" is "the second or later turn-on of the low sensitivity output caused after the high sensitivity output of the loopcoil $L_i$ has turned on but before that high sensitivity output turns off (2112), and if the judgment is affirmative, the step 2052 is omitted.

After the execution of the step 2056, the general control section 72 judges whether the current "turn-on of the low sensitivity output" has been "caused by the second vehicle out of a plurality of vehicles 48 which have entered the zones of the loop coils without keeping sufficient distances therebetween" or "caused by a single vehicle 48 having two or more on-durations of the low sensitivity output such as a truck" (2114). To be concrete, this judgment is implemented by the comparison between T and $W_t$*T'. That is, with T>$W_t$*T', the general control section 72 judges that the current "turn-on of the low sensitivity output" has been "caused by the second vehicle out of a plurality of the vehicles 48 which have entered the zones of the loop coils without keeping sufficient distances therebetween", and executes the step 2116 and the steps which follow. Conversely, with T<$W_t$*T', the general control section 72 judges that the current "turn-on of the low sensitivity output" has been "caused by a single vehicle 48 having two or more on-durations of the low sensitivity output such as a truck", and completes the low sensitivity rise processing.

In the processing of the step 2116 and the steps which follow, the general control section assumes that at a point of time after a lapse of T/2 after the low sensitivity output has turned off, the preceding vehicle 48 has passed over the loop coil $L_i$ and that at the same point of time, the closely following vehicle 48 has entered the zone of the loop coil $L_i$ (estimation of the high sensitivity fall time and setting of high sensitivity rise time; 2116, 2118). The general control section 72 further definitely determines the vehicle center position which has been defined with respect to the last low sensitivity output on-duration by the previous action, as a vehicle center position pertaining to the current low sensitivity output on-duration (2120, 2122). Also, the general control section 72 judges the type of the vehicle to be an automobile (2124). In this manner the procedure exemplarily shown in FIG. 29 is impelemented. The same can be said of the third or later vehicles.

(7) Correlation Processing between Passage Vehicles and Communication Results

Figure 38:
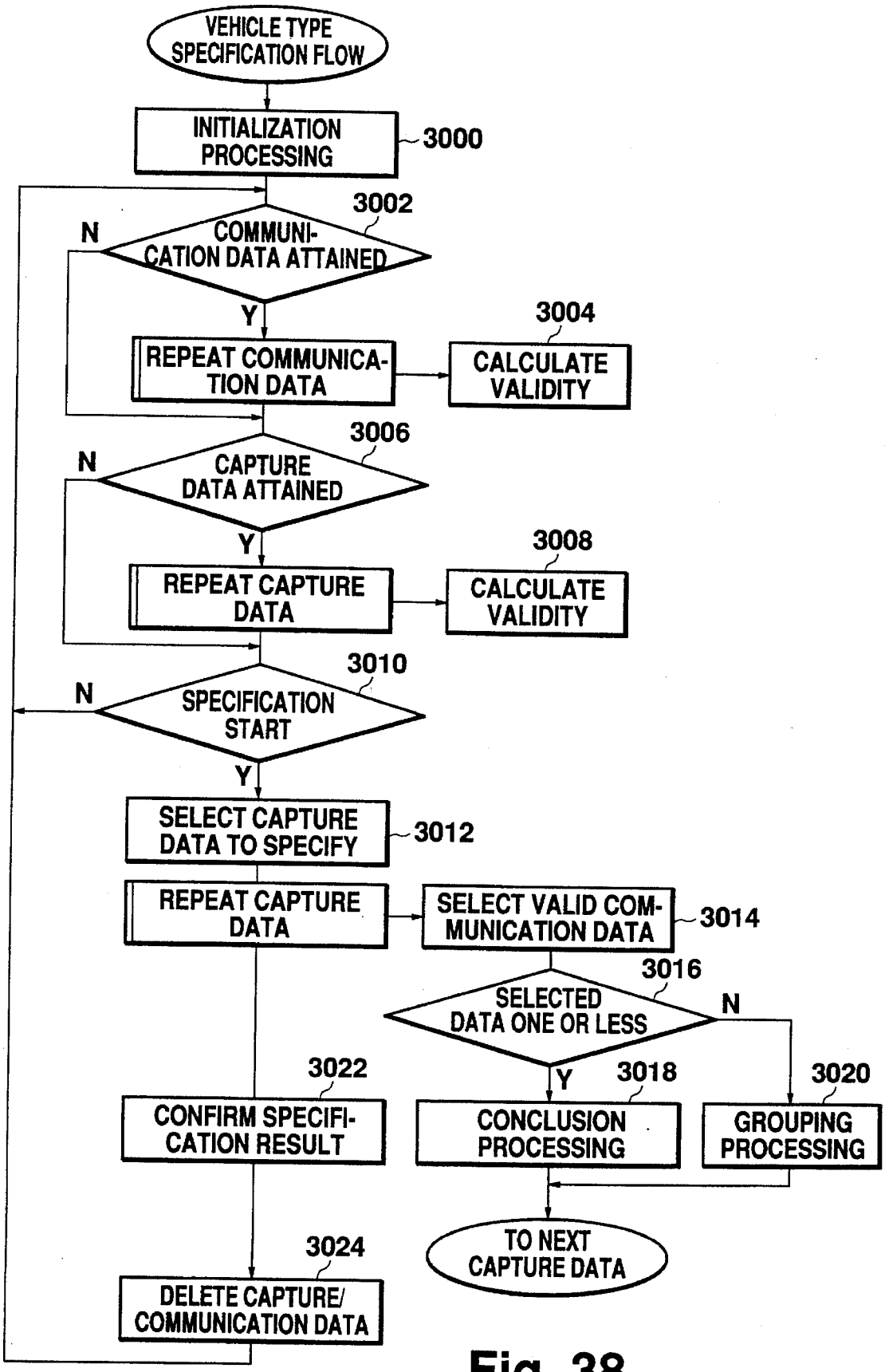
FIG. 38 is a flowchart representing a flow of processing for correlating vehicles which have passed by with the results of communication in order to ensure secure identification of illegal vehicles.

FIG. 38 depicts processing for correlating the passage vehicles with the communication results to ensure more accurate specification of the illegal vehicles.

As shown in this diagram, the local controller 66 first executes a predetermined initialization processing (3000). After the execution of the initialization processing and upon receipt of signals (communication data) from the IU 62 through the debiting antenna 50 or the debiting confirmation antenna 56 (3002), the local controller 66 stores the thus received communication data into a database within the general control section 72. The local controller 66 repeatedly makes coincidence calculations 56 depending on the number of the communication data items received (3004). As soon as information (capture data) on license plate images obtained by the actions of the loop coil 60 and the enforcement cameras 52 (3006), the local controller 66 stores them into the database within the interior of the general control section 72, and repeatedly makes coincidence calculations depending on the amount of capture data obtained (3008).

The instant conditions for initiating vehicle specification processing are satisfied such as a lapse of a predetermined time (3010), the local controller 66 initiates the vehicle specification processing (correlation mapping) while using as an index the validity calculated by a given algorithm in step 3004 or 3008. At that time, from among the capture data which have been heretofore attained and stored in the database, the local controller 66 selects the capture data available for the vehicle specification processing (3012), and supplies the thus selected capture data one by one to the processing associated with the steps 3014 to 3020. In other words, the processing associated with the steps 3014 to 3020 is repeatedly executed the number of times corresponding to the number of capture data selected.

In step 3014, communication data are selected for which the capture data being currently used for the vehicle specification processing are supposed to be valid according to the validity calculated in the steps 3004 and 3008. If the number of the communication data thus selected is one or less (3016), the local controller 66 concludes that the vehicle 48 associated with the selected communication data is identical to the vehicle 48 associated with the capture data being currently used for the vehicle specification processing (3018). On the contrary, if a plurality of communication data have been selected in the step 3014 (3016), then the local controller 66 groups these communication data and correlates them with the capture data being currently used for the vehicle specification processing (grouping processing; 3020).

After the execution of processing by steps 3014 to 3020 for all the capture data selected in step 3012, the local controller 66 combines the results of the processing by steps 3018 and 3020 so as to optimally correlate the capture data used for the vehicle specification with the communication data associated with a single vehicle (confirmation of the specification results; 3022). While carrying out the processing such as communication with the system central controller 68 in accordance with the results of the vehicle specification thus obtained, the local controller 66 deletes the capture data and communication data which have been correlated with each other by the vehicle specification processing, from the database within the interior of the general control section 72 (3024). Afterwards, the flow of the vehicle specification processing by the local controller 66 returns to step 3002 waiting for the communication data and capture data to be received.

Irrespective of the wider communication zones of the debiting antennas 50 and debiting confirmation antennas 56, the execution of such processing will allow identification of a plurality of vehicles 48 travelling side by side or in tandem and accurate correlation between the identified vehicles and the respective license plate images.

(8) Second Embodiment

Figure 39:
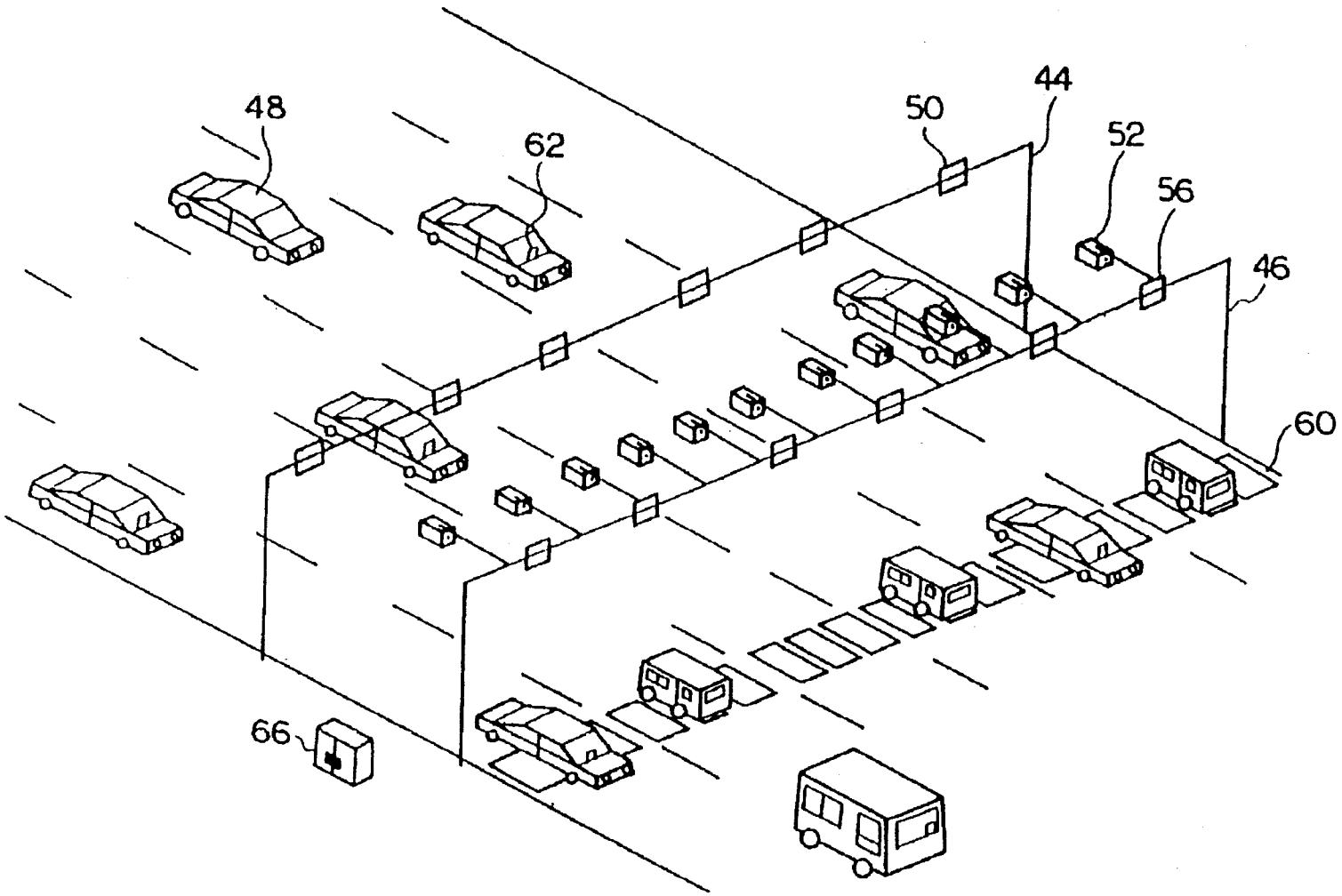
FIG. 39 is a perspective view showing another example of the external appearance of the system, especially in the vicinity of the first and second gantries.

Although the above description has been given on the basis of the system configuration as depicted in FIG. 1, the present invention is not intended to be limited to such a system configuration. With the obviating of the line 64 and the line scanners 58, as shown in FIG. 39 for example, the loop coils 60 may be disposed slightly toward the downstream side of the second gantry 46, and the enforcement cameras 24 may be arranged on the second gantry 46, not on the first gantry 44.

Figure 49:
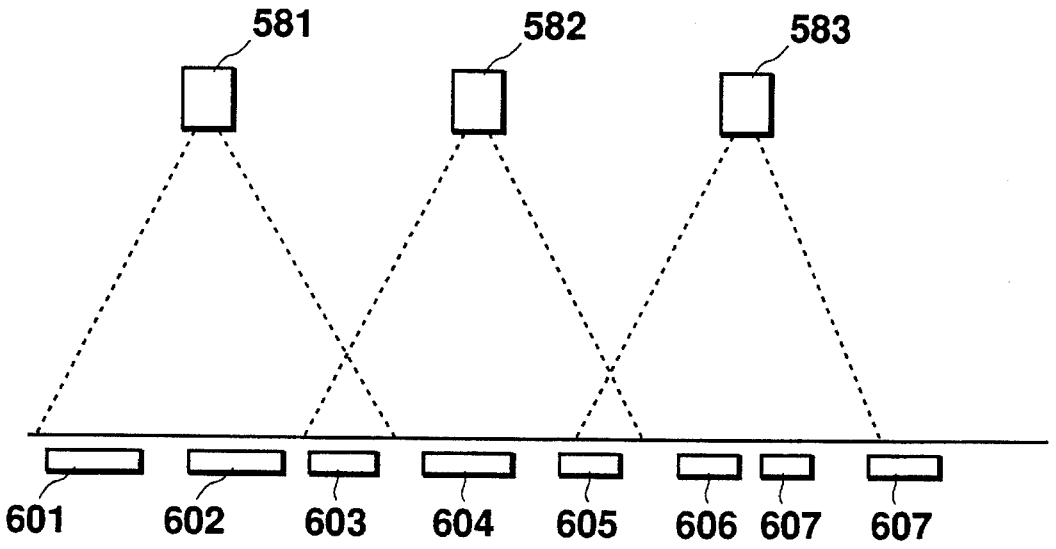
FIG. 49 shows an arrangement of line scanners and loop coils when the iris of line scanners is controlled by corresponding loop coils.

The absence of the line 64 and the line scanners 58 can obviate the maintenance of faded line 64 or the like. This means that no traffic will be blocked for such maintenance. Further, when covered by rain, snow, dust or the like, the line 64 is prone to a problem that it is optically shielded from the line scanners 58. This embodiment is free from such a problem since neither line 64 nor the line scanners 58 is used. Assume that the vehicle 48 stays on the line 64 for a relatively long period of time. In such a case, control of a diaphragm of the line scanners 58 may become unreliable or cannot be performed at all unless it is operated in response to an output of the loop coils 60. For preventing such a problem, in the first embodiment, each of the capture areas of line scanners 58 in FIG. 1 are correlated with loop coils 60. For example, as shown in FIG. 49, the line scanner 581 is correlated with the loop coils 601, 602 and 603; the; line scanner 582 is correlated with the loop coils 603, 604 and 605; and so on. Each of the line scanners 58 is operated, in accordance with the loop coil ON/OFF signal shown in FIG. 11, such that the value of its iris is kept when at least one of corresponding loop coils 60 is ON and is controlled to an adequate value when at least one of the corresponding loop coils 60.

In the second embodiment, as described above, the line scanners 58 are not necessary. Therefore, the problems caused by vehicles staying on the line 64 is obviated since no iris control for line scanners 58 are not necessary in this embodiment.

(9) Third Embodiment

Figure 40:
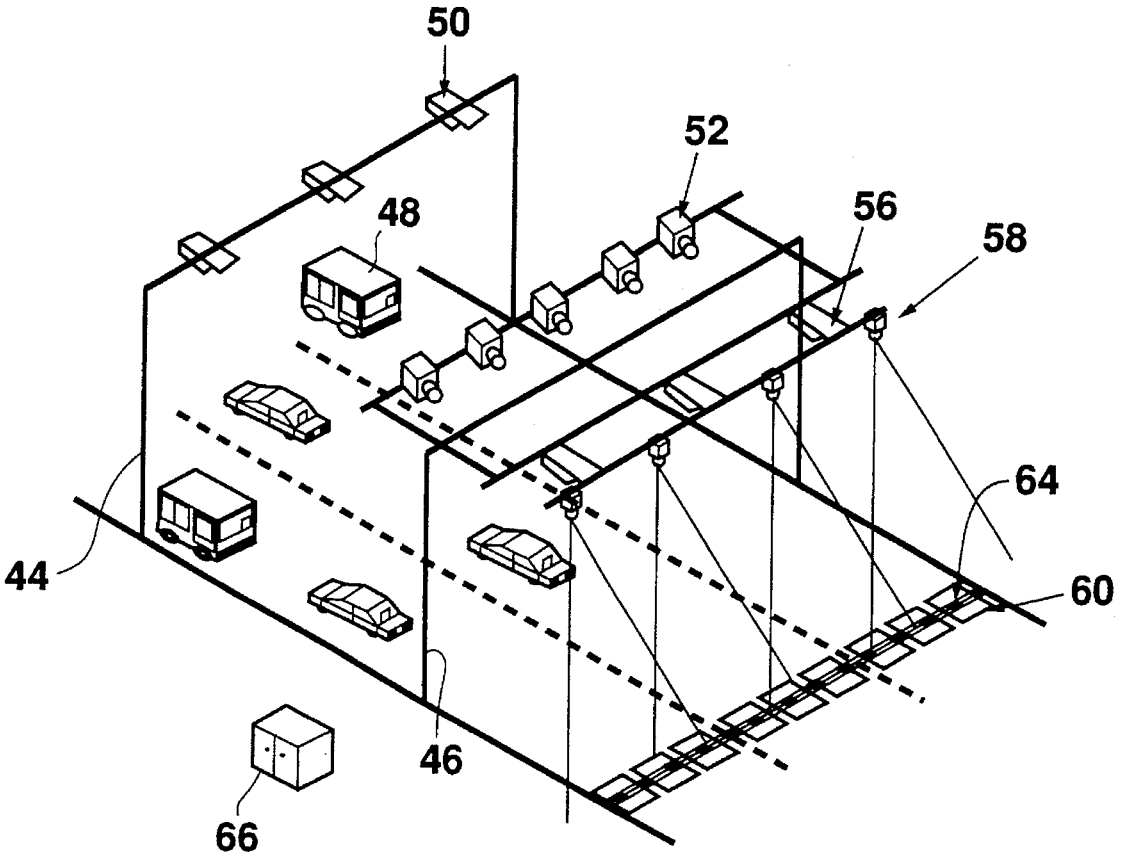
FIG. 40 is a perspective view showing an external appearance of a system according to a third embodiment of the invention, particularly, in the vicinity of first and second gantries.

FIG. 40 is a perspective view showing an external appearance of a system according to a third embodiment. In the this embodiment, both the loop coils 60 and the line 64 are disposed slightly downstream of the second gantry 46, and enforcement cameras 52 are arranged on the second gantry 46. This system is as effective as that of the first embodiment.

(10) Fourth Embodiment

Figure 41:
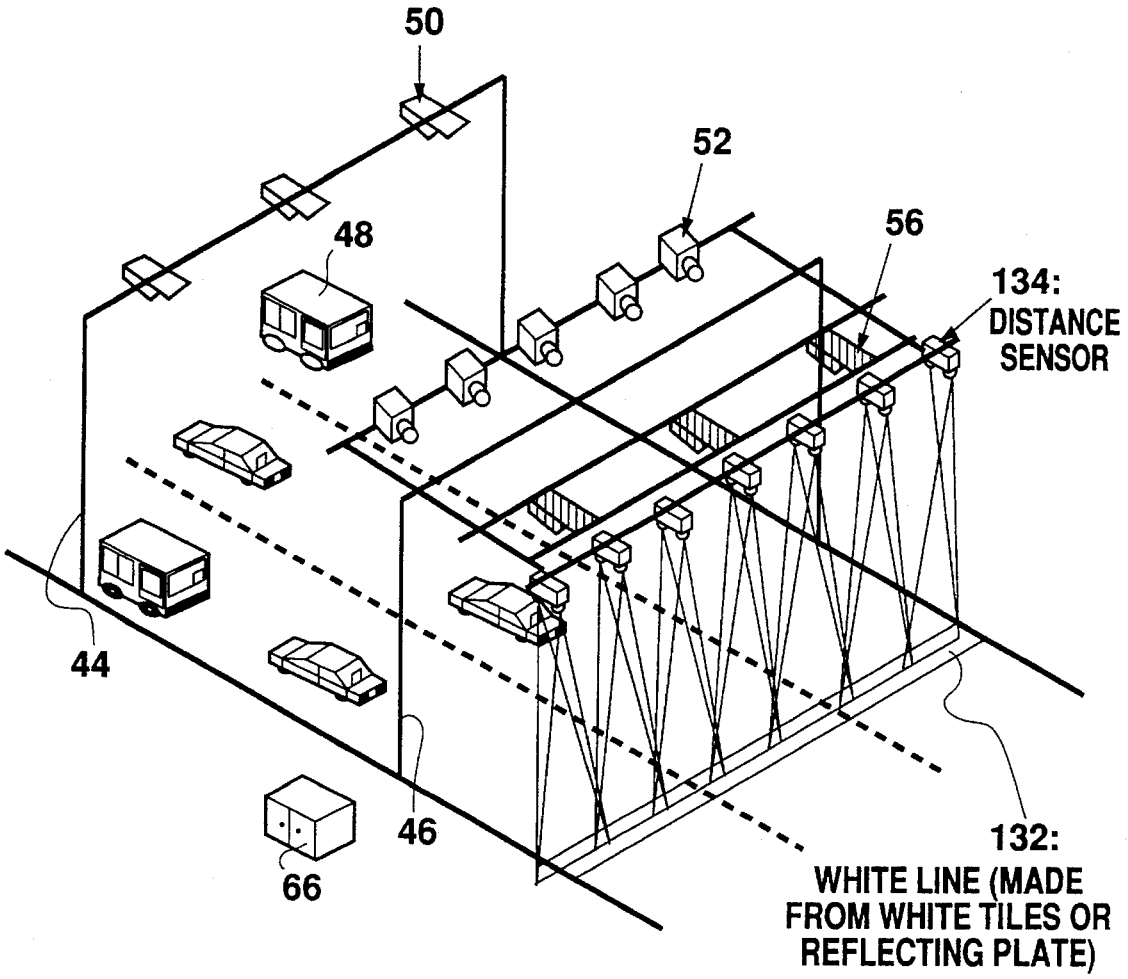
FIG. 41 is a perspective view showing an external appearance of a system according to a fourth embodiment of the invention, particularly, in the vicinity of first and second gantries.

A system according to a fourth embodiment is configured as shown in FIG. 41. In this embodiment, a white line 132 (made from white tiles or a reflecting plate) is formed across the road slightly downstream of the second gantry 46. A plurality of distance sensors 134 are arranged on the second gantry 46 so as to take pictures of the white line 132 to a predetermined width in the lane crossing direction and to perform the triangulation.

Figure 42:
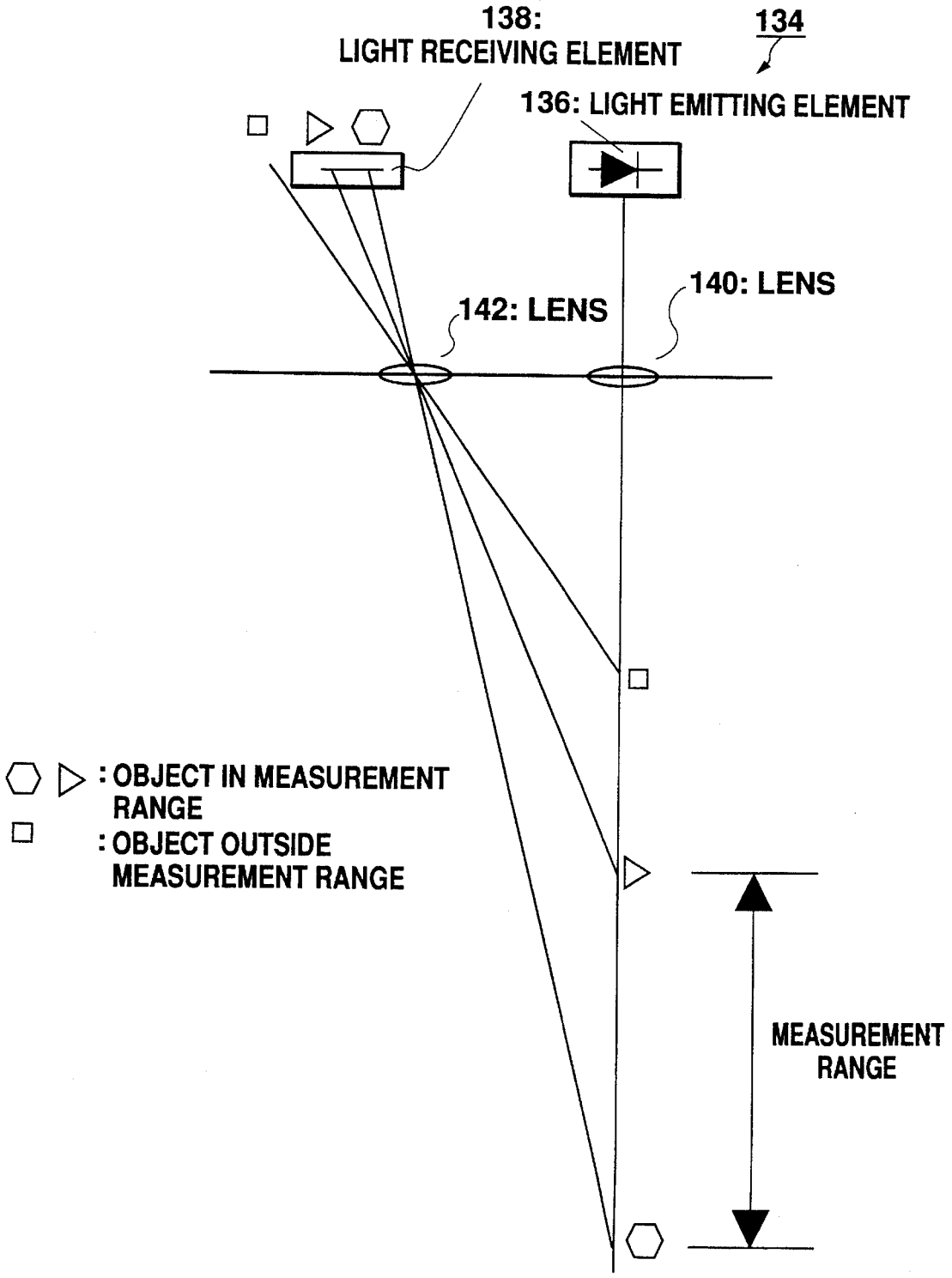
FIG. 42 is a schematic view showing a configuration of a distance sensor and positional relationships between the distance sensor and a measurement range in the fourth embodiment.

Referring to FIG. 42, each of the distance sensors 134 comprises a light emitting element 136 and a light receiving element 138. For instance, the light emitting element 136 is LED while the light receiving element 138 is PSD. Light beams from the light emitting element 136 are projected onto the road surface via a lens 140. Light beams reflected from the white line 132 or the vehicle 48 moving on the white line 132 are received by the light receiving element 138 via a lens 142 present below the light receiving element 138. Use of the distance sensors 134 enables the measurement of a distance between each distance sensor 134 and a reflecting object having a height shown by double arrows (e.g. the road surface, or the vehicle 48 which is relatively low) on the basis of the principle of the triangulation. In other words, it is possible to detect the presence or absence of vehicle 48 on the white line 132. Further, it is possible to measure the distance between the distance sensor 134 and the vehicle 48 present on the white line 132 when it has a relatively low height. When the light receiving element 138 does not receive any light beams emitted from the light emitting element 138 and reflected from an object, it is recognized that the object has a relatively large height as shown by a square in FIG. 42. Therefore, this system can also detect, in a preferable high and reflects the light beams from a position outside the measurement range.

Figure 43:
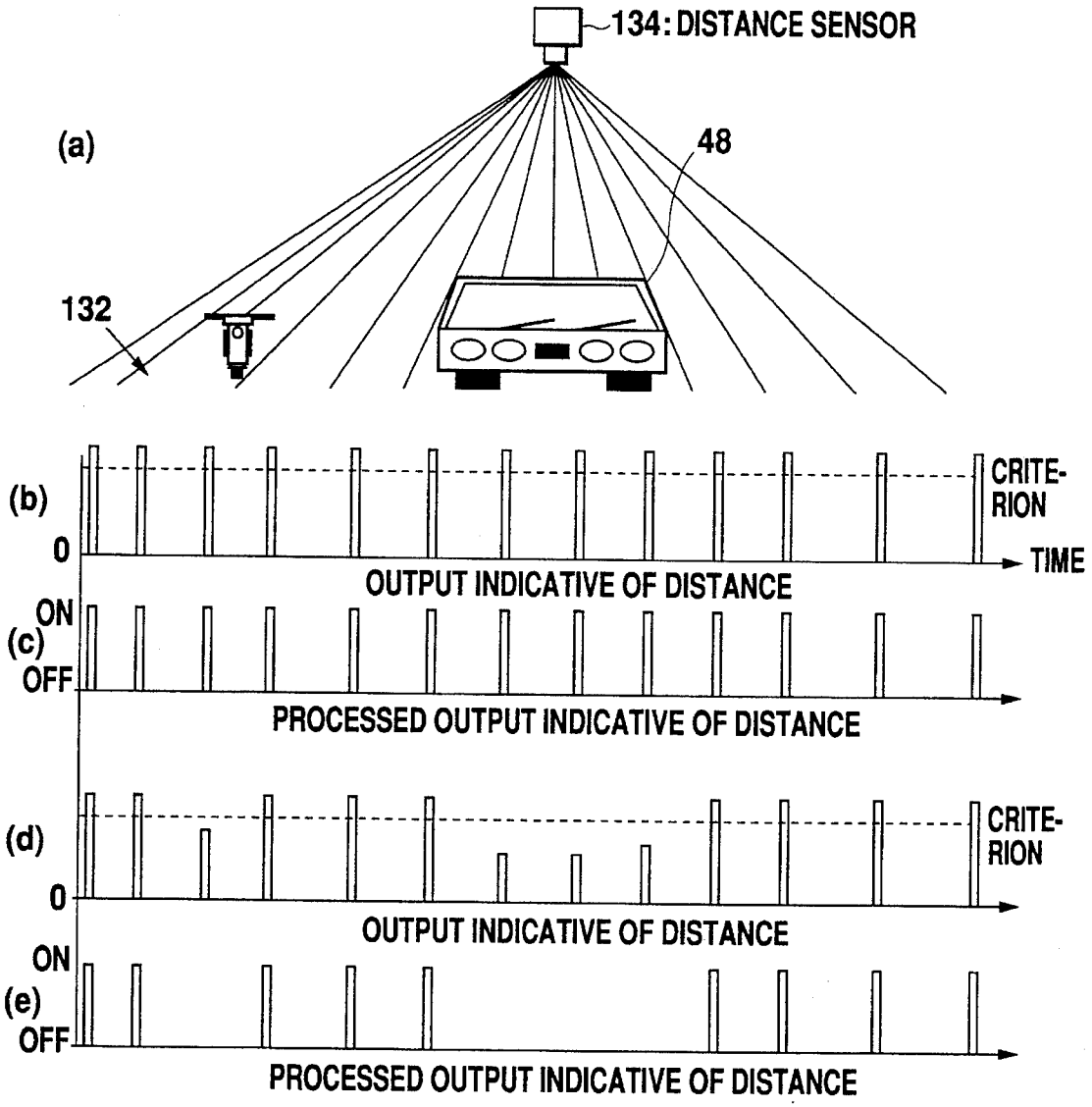
FIG. 43 illustrates the principle of detecting a position and a width of a vehicle according to the fourth embodiment; Specifically, (a) shows how the position sensor scans in the lane crossing direction, and actuation of light emitting and receiving elements on a time-divided basis; (b) shows a distance detection result indicating the absence of the vehicle on a white line; (c) shows a judged result by comparing the distance detection result of (b) with a criterion; (b) shows a distance detection result indicating the presence of the vehicle on the white line; and (e) shows a judged result by comparing the distance detection result of (d) with the criterion.

FIG. 43(*a*) shows the operation of the distance sensor 134 on a time-divided basis. In this embodiment, a plurality of, for example, 32 light emitting elements 136 are arranged in series along the lane crossing direction, and each of the light emitting elements 136 projects light beams along the white line 132 in such a manner as to scan across the road surface. During the scanning, both the light emitting 136 is receiving elements 136 and 138 are turned on a plurality of times (e.g. 32 times) so as to measure the distance to the road surface each time it is turned on. When there is no vehicle 48 on the white line 132, measurement results are always constant as shown in FIG. 43(*b*), i.e. indicate the height of the position where the sensor 134 is installed. In this state, the measurement results are compared to be a threshold value which is a criterion shown by a dashed line. This means the absence of the vehicle in the measurement range each time the light emitting 136 is turned on, as shown in FIG. 43(*c*). Conversely, when the vehicle is present on the white line 132 as shown in FIG. 43(*a*), the measurement results are as shown in FIG. 43(*d*) according to the height of the vehicle 48. The measurement results are checked with reference to the criterion shown by the dashed line. The position of the vehicle 48 in the lane crossing direction is detected on the basis of timing at which the light emitting 136 is receiving elements are turned on. Therefore, by using the triangulation, it is possible to recognize where the vehicle 48 is present along the lane crossing direction, and time-divided turning-on of the light emitting and element of the distance sensor 134.

Figure 44:
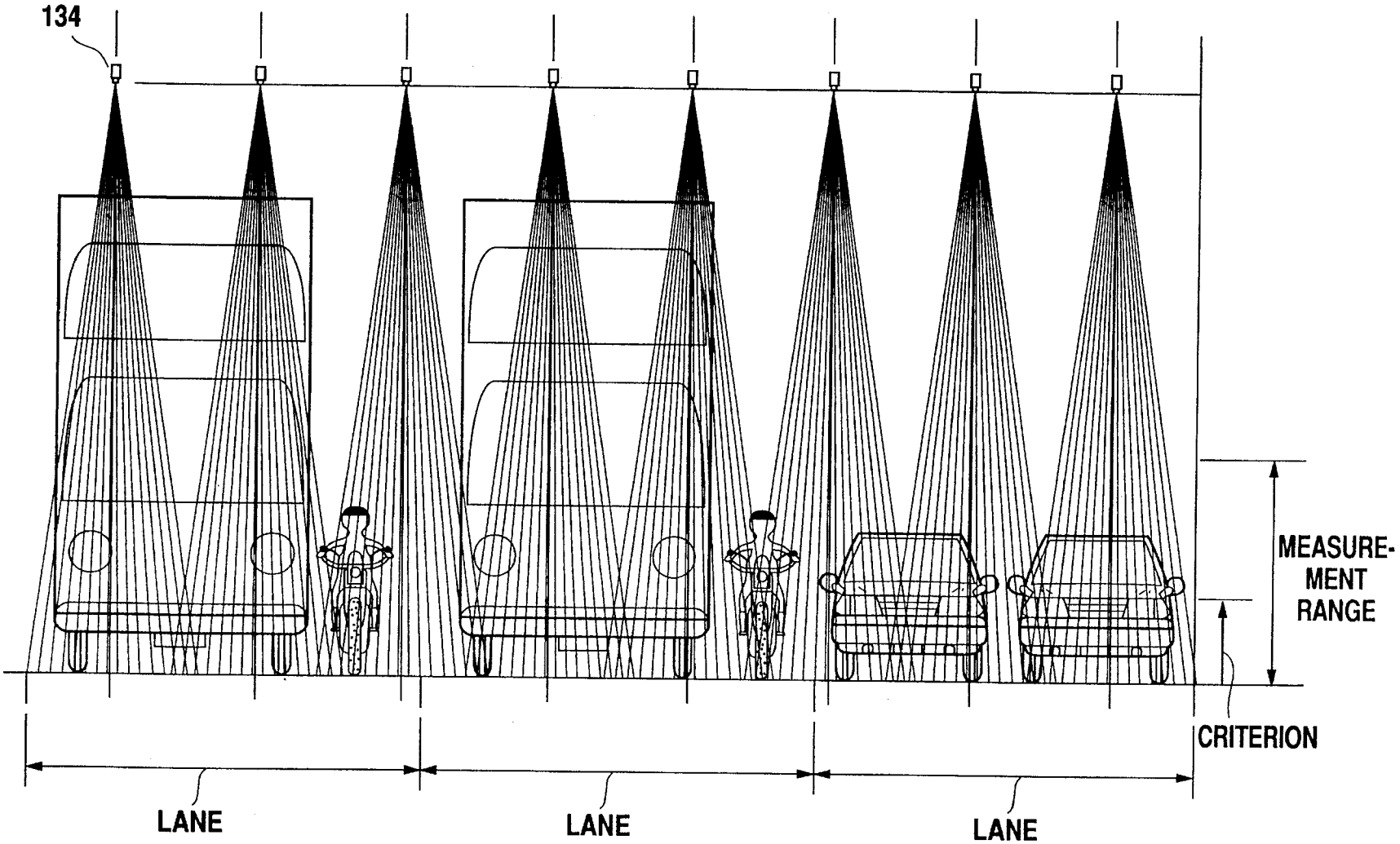
FIG. 44 shows an arrangement of the distance sensor in the crossing direction.

With this embodiment, a plurality of the distance sensors 134 are provided per lane as shown in FIG. 44. This arrangement can reduce the coverage of each distance sensor 134 so that the distance sensor 134 can have a high resolution even near the road surface. Thus, it is possible to separately detect vehicles having a relatively low height such as motorcycles and cars.

Figure 45:
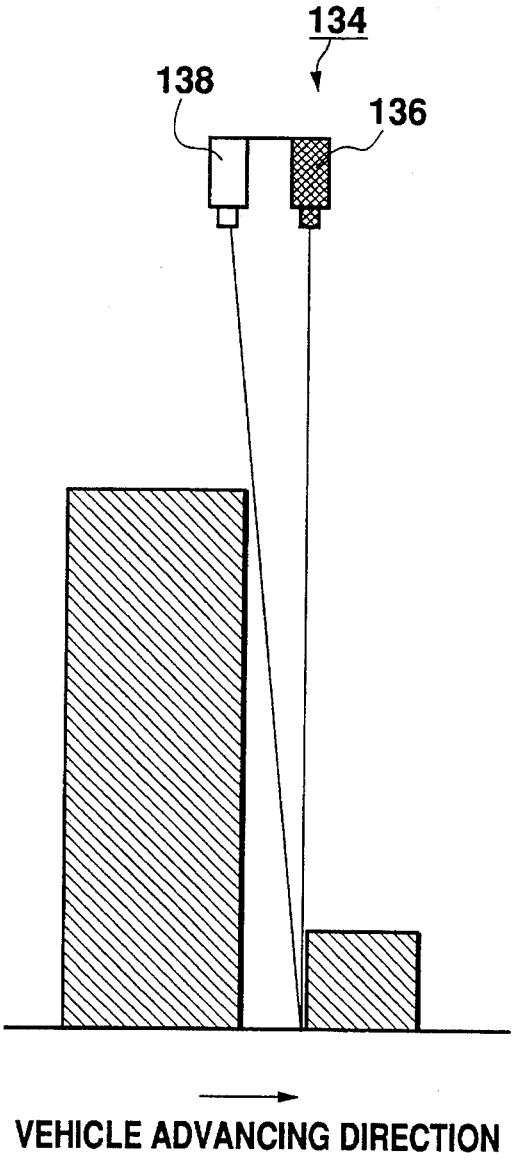
FIG. 45 shows an arrangement of the distance sensor in the vehicle advancing direction.
Figure 46:
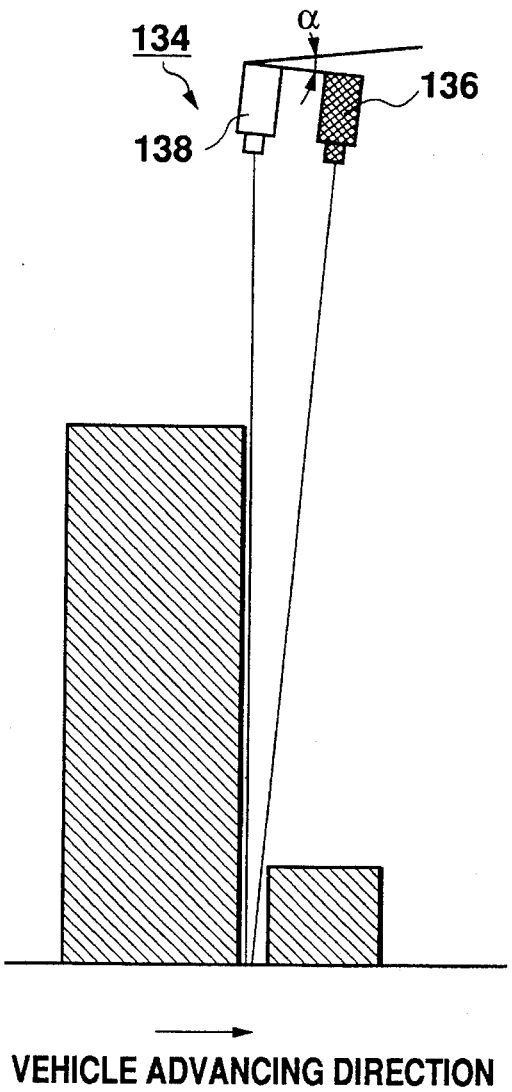
FIG. 46 shows another arrangement of the distance sensor in the vehicle advancing direction.

The distance sensor 134 may be configured such that the light emitting element 136 projects light beams straight onto the road surface and the light receiving element 138 received reflected light beams (as shown in FIG. 45). Preferably, the distance sensor 134 is installed with a predetermined angle $\alpha$ of depression such that the light emitting element 136 projects light beams slightly upstream of the advancing direction of the vehicle 48, and then the light receiving element 138 receives light beams reflected therefrom as shown in FIG. 46. The latter arrangement can narrow the dead angle of the sensor 134 along the advancing direction and therefore improve the resolution of the distance sensor 134 when compared with the arrangement shown in FIG. 45.

The white line 132 in this embodiment differs form the line 64 in the first and third embodiments, i.e. the white line 132 is painted white, or is made from white tiles or a reflecting plate. The white line 132 can maintained a high reflectance compared with other portions of the road surface made from asphalt or concrete. Thus, the distance measurement can be reliably performed without any adverse influence caused by a wet road surface or the like. In the first and third embodiments, to reliably detect the vehicle it is necessary to illuminate the wet line 64 with high-powered light beams from the line scanner 58. However, no high-powered light beams are necessary in this fourth embodiment. Further, the receiving level of the light receiving element 138 is reduced by a front or rear glass window of the vehicles 48. In such a case, firstly, it is judged whether the receiving level is lower than or equal to the threshold receiving level being set as the distance can be precisely measured therefrom. If the receiving level is lower than or equal to the threshold receiving level, it is notified that the distance is "infinity" as described later. In the case that the height of the road surface rises due to the snow or the like, the criterion shown by dotted line in FIG. 43 is adjusted such that the measurement range is shifted to more appropriate range.

Figure 47:
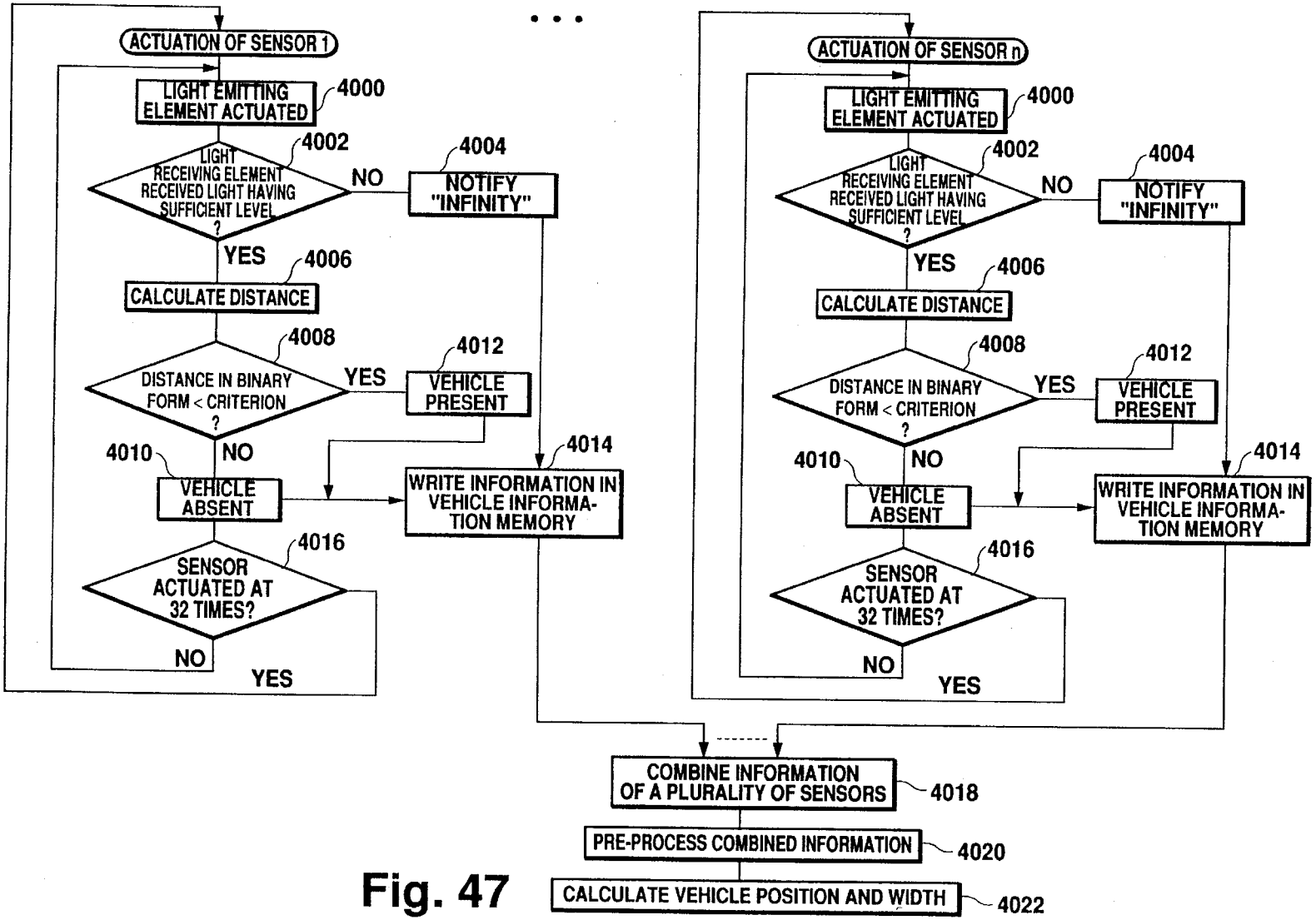
FIG. 47 is a flowchart showing the sequence of detecting the position and width of the vehicle.

FIG. 47 is a flowchart showing the vehicle position detecting sequence executed by the local controller 66 using the distance sensors 134. It is assumed here that there are "n" distance sensors 134. The same sequence 4000–4016 is conducted for each of the distance sensors 134.

In each distance sensor 134, its light emitting element 136 is turned on (step 4000). The light emitting element 136 projects light beams toward the white line 132, which are reflected by the white line 132 or an object such as the vehicle 48 travelling on the white line 132, and are received by the light receiving element 138. When a level of light beams received by the light receiving element 138 is below a predetermined value (step 4002), it is recognized that light beams are reflected from the object which is present outside the measurement range, as shown by the square in FIG. 42. Thus, the local controller 66 determines that a distance to the reflecting object is "infinity" (step 4004). For example, the object passing over the white line 132 is recognized to be the vehicle 48 having a large height.

When the level of light beams received by the light receiving element 138 is high enough to consider that they are reflected from the object within the measurement range, the local controller 66 calculates a distance between the distance sensor 134 and the object on the basis of the triangulation principle (step 4006). The local controller 66 converts the calculated distance into a binary form, and compares it with the criterion shown by the dashed line in FIG. 43. If the calculated distance is equal to or larger than the criterion, it is considered that not vehicle is present in the light projecting direction at least at that time (step 4010). Otherwise, it is considered that a vehicle 48 is present in the light projecting direction (step 4012). The local controller 66 writes the result obtained in step 4004, 4010 or 4012 in the vehicle information memory of the general control section 72 (step 4014). The foregoing sequence is repeated for each distance sensor 134 until its light emitting and receiving element 136 is turned on 32 times so as to scan their coverage in the lane crossing direction (step 4016).

The local control unit 66 combines the information written in the vehicle information memory in the central control unit (step 4018) and pre-processes (step 4020) the information, and calculated the position of the vehicle 48 in the lane crossing direction and a width of the vehicle 48 (step 4022). In other words, the position and width of the vehicle 48 can be known on the basis of the principle shown in FIG. 43.

Since the line 64 comprising white and black patterns is not necessary in this embodiment, no traffic will be blocked so as to maintain the line 64. Further, it is possible to prevent problems that the position of the vehicle in the lane crossing direction or the width of the vehicle becomes unreliable or cannot be detected due to rain, snow or dust covering the line 64. Further, this embodiment is free from a problem that the distance measurement cannot be performed because the vehicle 48 stays on the line 64 for a long period of time. Still further, a plurality of the distance sensors 134 are arranged in the lane crossing direction with the angle of depression $\alpha$ in the vehicle advancing direction, and can detect the vehicle with high resolution. This embodiment does not require any high-powered laser beams, and is free from any problem that the level of reflected light beams is affected by the front or rear window of the vehicle, or by snow or the like covering the road surface.

(11) Fifth Embodiment 5

Figure 48:
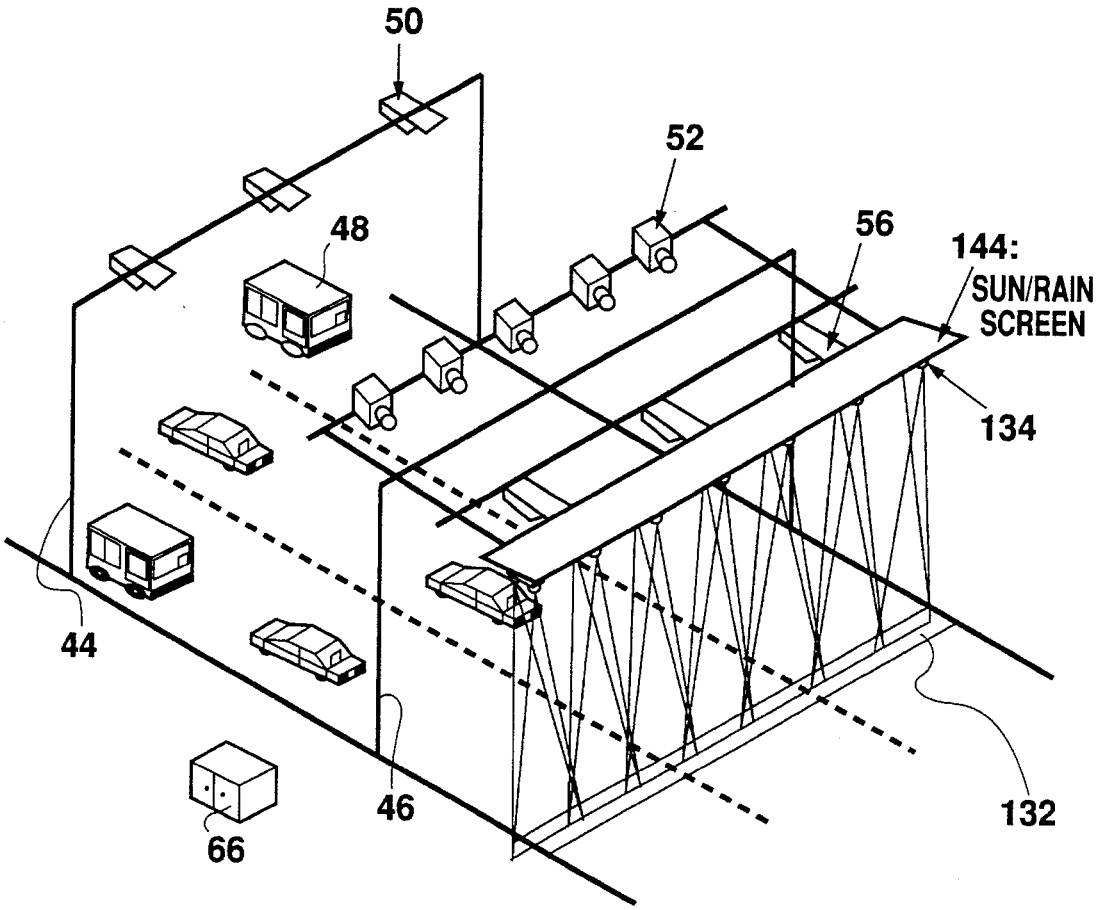
FIG. 48 is a perspective view showing an external appearance of a system according to a fifth embodiment, particularly, in the vicinity of first and second gantries.

FIG. 48 is a perspective view showing an external appearance of a system according to a fifth embodiment. The upper portion of the distance sensors 134 are covered by a sun/rain screen 144. The sun/rain screen 144 enables the system to be installed in areas which may suffer from heavy rain such as squalls, or may be exposed to the strong sunshine and prevents the rise intemperature of the distance sensors 134 and the peripheral thereof.

What is claimed is:

1. An automatic debiting system comprising:

a first gantry disposed so as to span a road having a predetermined number of lanes;

a second gantry disposed so as to span said road and positioned on a downstream side of said first gantry along a vehicle advancing direction;

debiting means arranged on said first gantry for radio communicating with vehicles traveling said road to impose tolls thereon; and debiting confirmation means arranged on said second gantry for radio communicating with vehicles traveling said road to confirm that tolls have been correctly imposed thereon.

2. A method of debiting comprising the steps of:

executing radio communication for imposing tolls on a vehicle between a first gantry disposed so as to span a road having a predetermined number of lanes and the vehicle traveling on the road; and executing radio communication for confirming that tolls are normally imposed on the vehicle between a second gantry disposed so as to span said road and arranged on a downstream side of said first gantry in a vehicle advancing direction and the vehicle traveling on said road.

3. A method as in claim 2, further including:

detecting a passage position in the lane crossing direction of the vehicle traveling on the road;

determining the points to be photographed in accordance with the passage position in the lane crossing direction; and photographing said points determined to be photographed.

4. An automatic debiting system according to claim 3, further comprising:

a plurality of detection elements embedded for each lane along the lane crossing direction output signal values of which vary in response to the passage of a vehicle through the vicinity thereof;

said passage position detection means determining said passage positions in the lane crossing direction in accordance with the positions of said detection elements whose output signal values have varied.

5. An automatic debiting system according to claim 3, further comprising:

vehicle type identification means for identifying the type of a vehicle traveling on said road;

said passage position detection means determining said passage positions in the lane crossing direction in accordance with the type of the vehicle identified by said vehicle type identification means.

6. An automatic debiting system according to claim 5, further comprising:

a plurality of detection elements embedded for each lane along the lane crossing direction and whose output signal values vary in response to the passage of a vehicle through the vicinity thereof, said vehicle type identification means comparing the output signal values of said detection elements whose output signal values have changed with the output signal values of the other detection elements, to thereby identify the type of the vehicle, said passage position detection means determining said passage positions in the lane crossing direction in accordance with the type of vehicle identified by said vehicle type identification means and with the positions of the detection elements whose output signal values have changed.

7. An automatic debiting system according to claim 6, wherein said plurality of detection elements are inductors whose inductances vary in response to the passage of a vehicle through the vicinity thereof and whose output signal values vary in amplitude and phase in response to the variation of the inductance.

8. An automatic debiting system according to claim 7, said vehicle type identification means including:

means for judging when the output signal values of said inductors have changed, whether the output signal values after change are relatively small values or relatively large value, respectively;

means for estimating, for an inductor whose output signal value after change is a relatively small value, that the vehicle which has passed through the vicinity thereof is a lightweight vehicle type having a relatively small mass; and means for estimating, for a inductor of which output signal value after change is a relative large value, that the vehicle which has passed through the vicinity thereof is a heavyweight vehicle type having a relatively large mass.

9. An automatic debiting system according to claim 8, wherein said passage position detection means includes:

means for comparing with a reference distance a distance between a first inductor through the vicinity of which the vehicle estimated to be the lightweight vehicle type has passed and each of the second inductors through the vicinity of which the vehicle estimated to be the heavyweight vehicle type has passed, out of the inductors whose output signal values have changed;

means for assuming, in the presence of at least one second inductor having said distance smaller than said reference distance, that the vehicles which have passed through the vicinity of the first inductor is identical to the vehicle which has passed through the vicinity of said at least one second inductors, and also for estimating the passage position of this vehicle in the lane crossing direction; and means for assuming, in the absence of the second inductors having said distance smaller than said reference distance, that the vehicle which has passed through the vicinity of the first inductor is an independent vehicle, and estimating the passage position of this vehicle in the line crossing direction.

10. An automatic debiting system according to claim 9, wherein said passage position detection means includes:

curve approximation means for approximating contexts of approximation points by a curve, said approximation points being timings at which variations have appeared in the output signal values of a plurality of inductors through the vicinity of which the same vehicle has been estimated to have passed, out of the plurality of inductors whose output signal values have changed; and means for estimating that said passage position in the lane crossing direction of said vehicle which has passed through the vicinity of said plurality of inductors lies on an inflection point of said curve.

11. An automatic debiting system according to claim 10, wherein said passage position detection means includes:

means for determining alternative approximation points the number of deficient approximation points and in accordance with the timing where variation has appeared in the output signal values of said second inductors, the first inductor and said second inductor of inductors whose output signal values have changed having a distance smaller than the reference distance and whose numbers are both deficient for the curve approximation.

12. An automatic debiting system according to claim 10, wherein said curve is a quadric curve.

13. An automatic debiting system according to claim 8, wherein said passage position detection means includes:

means for estimating the passage position of a vehicle in the lane crossing direction, in accordance with the position and timing of variations of output signal values of a plurality of second inductors in close proximity to each other, said vehicle which has passed through the vicinity of said plurality of second inductors, out of inductors whose output signal values have changed, being estimated to be a heavyweight vehicle type.

14. An automatic debiting system according to claim 8, wherein said passage position detection means includes:

means for detecting an initial transitional time during which the output signal value changes from a relatively small value into a relatively large value, and an intermediate transitional time during which the output signal value changes from the relatively small value back into the relatively large value for an inductor whose output signal value first changes into the relatively small value, then changes into the relatively large value and then changes again into the relatively large value;

means for comparing said initial transitional time with said intermediate transitional time;

means for estimating that a plurality of periods positioned before and after said intermediate transitional time and whose output signal values have a relatively large value represent a common vehicle in the case of a shorter intermediate transitional time compared with the initial transitional time; and means for estimating that a plurality of periods positioned before and after said intermediate transitional time and whose output signal values have a relatively large value represent different vehicles in the case of a longer intermediate transitional time compared with the initial transitional time.

15. An automatic debiting system according to claim 3, wherein said passage position detection means includes:

light and shade pattern photographing means for photographing a light and shade pattern formed on the road; and passage detection means for detecting the passage of a vehicle over the light and shade pattern in accordance with the disturbance of the light and shade pattern in the image photographed by the light and shade pattern photographing means.

16. An automatic debiting system according to claim 15, wherein said light and shade pattern photographing means are arranged at positions allowing the photographing of the vicinity of the boundaries of the lanes.

17. An automatic debiting system according to claim 3, further comprising:

passage speed detection means for detecting speeds of vehicles which have passed under said first gantry; and photographing timing regulation means for regulating the photographing timing of the vehicle in response to results of speed detection.

18. An automatic debiting system according to claim 3, further comprising:

a vehicle specification means for correlating the results of communication between said debiting means and the vehicles with said vehicle photographed by said illegal vehicle photographing means.

19. An automatic debiting system according to claim 3, wherein a plurality of lanes are provided under said first and second gantries.

20. An automatic debiting system according to claim 3, wherein said predetermined number of lanes are arranged under said first and second gantries so that said vehicles are capable of free lane traveling.

21. An automatic debiting system according to claim 3, wherein said photographing means photographs license plates.

22. An automatic debiting system according to claim 3, wherein the passage position detection means comprises a light emitting device for emitting a light onto the road, a light receiving device for receiving a reflected light, and means for scanning the road along the lane crossing direction by the light emitting device and also for causing emitting of the light at discrete points of time.

23. An automatic debiting system according to claim 1, further comprising:

passage position detection means for detecting passage positions in the lane crossing direction of said vehicles traveling said road;

photographing point decision means for deciding points to be photographed in accordance with said passage positions in the lane crossing direction; and photographing means for photographing said points to be photographed which have been determined by said photographing point decision means.

24. An automatic debiting system according to claim 23, further comprising:

illegal vehicle specifying means for specifying illegal vehicles from which confirmations have not been obtained that tolls have been correctly imposed thereon; and transaction means for transmitting, to an external apparatus, results of said radio communications by debiting means and/or debiting confirmation means with said illegal vehicles and photographed information corresponding thereto.

* * * * *